US007153638B2

(12) United States Patent
Hosokawa et al.

(10) Patent No.: US 7,153,638 B2
(45) Date of Patent: Dec. 26, 2006

(54) SILVER HALIDE COLOR PHOTOSENSITIVE MATERIAL

(75) Inventors: Junichiro Hosokawa, Minami-Ashigara (JP); Takanori Hioki, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 11/066,180

(22) Filed: Feb. 25, 2005

(65) Prior Publication Data

US 2005/0214696 A1 Sep. 29, 2005

(30) Foreign Application Priority Data

Feb. 27, 2004 (JP) ..... 2004-054650

(51) Int. Cl.
*G03C 1/46* (2006.01)
*G03C 1/06* (2006.01)
*G03C 1/08* (2006.01)

(52) U.S. Cl. ..... 430/502; 430/503; 430/505; 430/599; 430/600; 430/613; 430/614; 430/615; 430/551; 430/955

(58) Field of Classification Search ..... 430/505, 430/502, 503, 599, 600, 613–615, 551, 955
See application file for complete search history.

(56) References Cited

U.S. PATENT DOCUMENTS 6,455,242 B1 * 9/2002 Allway et al. ..... 430/600
6,893,809 B1 * 5/2005 Reed et al. ..... 430/505

* cited by examiner

*Primary Examiner*—Geraldine Letscher
(74) *Attorney, Agent, or Firm*—Sughrue Mion, PLLC

(57) ABSTRACT

A silver halide color photosensitive material comprising a support and, superimposed thereon, a blue-sensitive layer unit, a green-sensitive layer unit and a red-sensitive layer unit, each of these light-sensitive layer units composed of at least one silver halide emulsion layer, together with at least one nonphotosensitive layer, wherein at least one compound (A) and at least one compound (B) are contained, the compound (A) being a heterocyclic compound of less than 4.5 C log P which when added, is capable of enhancing the sensitivity of the silver halide color photosensitive material as compared with that exhibited when not added, the compound (B) being a heterocyclic compound of 4.5 or greater C log P which when added, is capable of enhancing the sensitivity of the silver halide color photosensitive material as compared with that exhibited when not added.

9 Claims, No Drawings

SILVER HALIDE COLOR PHOTOSENSITIVE MATERIAL

CROSS-REFERENCE TO RELATED APPLICATIONS

This application is based upon and claims the benefit of priority from prior Japanese Patent Application No. 2004-054650, filed Feb. 27, 2004, the entire contents of which are incorporated herein by reference.

BACKGROUND OF THE INVENTION

1. Field of the Invention

The present invention relates to a silver halide color photosensitive material. More particularly, the present invention relates to a silver halide color photosensitive material which is highly sensitive, excels in graininess and further excels in latent image storability under high temperature high humidity conditions.

2. Description of the Related Art

In the field of silver halide color photosensitive material, it is a longstanding issue to attain sensitivity enhancement without detriment to graininess. Generally, the photographic speed is determined by the size of silver halide emulsion grains. The larger the emulsion grains, the greater the photographic speed. However, since the graininess would be deteriorated in accordance with an increase of silver halide grain size, the speed and the graininess are in a tradeoff relationship. In the art to which the invention pertains, attaining sensitivity enhancement without detriment to graininess is the most fundamental and important task in the upgrading of the image quality of photographic sensitive materials.

The technology for attaining sensitivity enhancement without detriment to graininess by incorporating a compound having at least three heteroatoms in a silver halide photographic sensitive material has been disclosed (see, for example, Jpn. Pat. Appln. KOKAI Publication No. (hereinafter referred to as JP-A-) 2000-194085 and JP-A-2003-156823).

Although the sensitivity enhancement by the above technology can be recognized, the effect attained thereby is not satisfactory.

BRIEF SUMMARY OF THE INVENTION

It is an object of the present invention to provide a silver halide color photosensitive material which is highly sensitive and excels in graininess.

The inventors have made extensive studies with a view toward attaining the above object. As a result, it has been found that striking sensitivity enhancement can be attained without detriment to graininess by the following silver halide color photosensitive material.

It has further been found that the photosensitive material can have a novel effect by virtue of the present invention. That is, the use of the present invention leads to an unexpected effect that the dependence of photosensitive material on processing can be favorably improved.

Accordingly, the present invention provides the following silver halide color photosensitive material.

(1) A silver halide color photosensitive material comprising a support and, superimposed thereon, a blue-sensitive layer unit, a green-sensitive layer unit and a red-sensitive layer unit, each of these light-sensitive layer units composed of at least one silver halide emulsion layer, together with at least one nonphotosensitive layer, wherein at least one compound (A) and at least one compound (B) are contained, the compound (A) being a heterocyclic compound of less than 4.5 C log P which when added, is capable of enhancing the sensitivity of the silver halide color photosensitive material as compared with that exhibited when not added, the compound (B) being a heterocyclic compound of 4.5 or greater C log P which when added, is capable of enhancing the sensitivity of the silver halide color photosensitive material as compared with that exhibited when not added.

(2) The silver halide color photosensitive material according to item (1) above, wherein the compound (A) and compound (B) satisfy the following requirements, the compound (A) being a heterocyclic compound of −2 to 3 C log P which when added, is capable of enhancing the sensitivity of the silver halide color photosensitive material as compared with that exhibited when not added, the compound (B) being a heterocyclic compound of 6 to 16 C log P which when added, is capable of enhancing the sensitivity of the silver halide color photosensitive material as compared with that exhibited when not added.

(3) The silver halide color photosensitive material according to item (1) above, wherein the compound (A) and compound (B) satisfy the following requirements, the compound (A) being a heterocyclic compound of −1 to 1 C log P which when added, is capable of enhancing the sensitivity of the silver halide color photosensitive material as compared with that exhibited when not added, the compound (B) being a heterocyclic compound of 7.5 to 15 C log P which when added, is capable of enhancing the sensitivity of the silver halide color photosensitive material as compared with that exhibited when not added.

(4) The silver halide color photosensitive material according to any of items (1) to (3) above, wherein the compound (A) is a heterocyclic compound having 1 to 3 heteroatoms as ring constituent atoms which does not react with developing agent oxidation products while the compound (B) is a heterocyclic compound having 1 to 3 heteroatoms as ring constituent atoms.

(5) The silver halide color photosensitive material according to any of items (1) to (3) above, wherein the compound (A) and the compound (B) both are a heterocyclic compound having 1 or 2 heteroatoms as ring constituent atoms which does not react with developing agent oxidation products.

DETAILED DESCRIPTION OF THE INVENTION

The present invention will be described below.

In the present invention, when any specified moiety is referred to as "group", it is meant that the moiety per se may be unsubstituted or have one or more (up to possible largest number) substituents. For example, the "alkyl group" refers to a substituted or unsubstituted alkyl group. The substituents which can be employed in the compounds of the present invention are not limited irrespective of the existence of substitution.

When these substituents are referred to as W, the substituents represented by W are not particularly limited. As such, there can be mentioned, for example, halogen atoms, alkyl groups (including a cycloalkyl group, a bicycloalkyl group and a tricycloalkyl group), alkenyl groups (including a cycloalkenyl group and a bicycloalkenyl group), alkynyl groups, aryl groups, heterocyclic groups, a cyano group, a hydroxyl group, a nitro group, a carboxyl group, alkoxy groups, aryloxy groups, a silyloxy group, heterocyclic oxy groups, acyloxy groups, a carbamoyloxy group, alkoxycarbonyloxy groups, aryloxycarbonyloxy groups, amino groups (including alkylamino groups, arylamino groups and heterocyclic amino groups), an ammonio group, acylamino groups, an aminocarbonylamino group, alkoxycarbonylamino groups, aryloxycarbonylamino groups, a sulfamoylamino group, alkyl- or arylsulfonylamino group, a mercapto group, alkylthio groups, arylthio groups, heterocyclic thio groups, a sulfamoyl group, a sulfo group, alkyl- or arylsulfinyl groups, alkyl- or arylsulfonyl groups, acyl groups, aryloxycarbonyl groups, alkoxycarbonyl groups, a carbamoyl group, aryl- or heterocyclic azo groups, an imido group, a phosphino group, a phosphinyl group, a phosphinyloxy group, a phosphinylamino group, a phosphono group, a silyl group, a hydrazino group, a ureido group, a borate group (—$B(OH)_2$), a phosphato group (—$OPO(OH)_2$), a group (—$OSO_3H$) and other common substituents.

More specifically, W can represent any of halogen atoms (e.g., a fluorine atom, a chlorine atom, a bromine atom and an iodine atom); alkyl groups [each being a linear, branched or cyclic substituted or unsubstituted alkyl group, and including an alkyl group (preferably an alkyl group having 1 to 30 carbon atoms, such as methyl, ethyl, n-propyl, isopropyl, t-butyl, n-octyl, eicosyl, 2-chloroethyl, 2-cyanoethyl or 2-ethylhexyl), a cycloalkyl group (preferably a substituted or unsubstituted cycloalkyl group having 3 to 30 carbon atoms, such as cyclohexyl, cyclopentyl or 4-n-dodecylcyclohexyl), a bicycloalkyl group (preferably a substituted or unsubstituted bicycloalkyl group having 5 to 30 carbon atoms, which is a monovalent group corresponding to a bicycloalkane having 5 to 30 carbon atoms from which one hydrogen atom is removed, such as bicyclo[1,2,2]heptan-2-yl or bicyclo[2,2,2]octan-3-yl), and a tricyclo or more cycle structure; the alkyl contained in the following substituents (for example, alkyl of alkylthio group) means the alkyl group of this concept, which however further includes an alkenyl group and an alkynyl group]; alkenyl groups [each being a linear, branched or cyclic substituted or unsubstituted alkenyl group, and including an alkenyl group (preferably a substituted or unsubstituted alkenyl group having 2 to 30 carbon atoms, such as vinyl, allyl, pulenyl, geranyl or oleyl), a cycloalkenyl group (preferably a substituted or unsubstituted cycloalkenyl group having 3 to 30 carbon atoms, which is a monovalent group corresponding to a cycloalkene having 3 to 30 carbon atoms from which one hydrogen atom is removed, such as 2-cyclopenten-1-yl or 2-cyclohexen-1-yl), and a bicycloalkenyl group (substituted or unsubstituted bicycloalkenyl group, preferably a substituted or unsubstituted bicycloalkenyl group having 5 to 30 carbon atoms, which is a monovalent group corresponding to a bicycloalkene having one double bond from which one hydrogen atom is removed, such as bicyclo[2,2,1]hept-2-en-1-yl or bicyclo[2,2,2]oct-2-en-4-yl)]; alkynyl groups (preferably a substituted or unsubstituted alkynyl group having 2 to 30 carbon atoms, such as ethynyl, propargyl or trimethylsilylethynyl); aryl groups (preferably a substituted or unsubstituted aryl group having 6 to 30 carbon atoms, such as phenyl, p-tolyl, naphthyl, m-chlorophenyl or o-hexadecanoylaminophenyl); heterocyclic groups (preferably a monovalent group corresponding to a 5- or 6-membered substituted or unsubstituted aromatic or nonaromatic heterocyclic compound from which one hydrogen atom is removed (the monovalent group may be condensed with a benzene ring, etc.), more preferably a 5- or 6-membered aromatic heterocyclic group having 3 to 30 carbon atoms, such as 2-furyl, 2-thienyl, 2-pyrimidinyl or 2-benzothiazolyl (the heterocyclic group may be a cationic heterocyclic group such as 1-methyl-2-pyridinio or 1-methyl-2-quinolinio));

a cyano group; a hydroxyl group; a nitro group; a carboxyl group; alkoxy groups (preferably a substituted or unsubstituted alkoxy group having 1 to 30 carbon atoms, such as methoxy, ethoxy, isopropoxy, t-butoxy, n-octyloxy or 2-methoxyethoxy); aryloxy groups (preferably a substituted or unsubstituted aryloxy group having 6 to 30 carbon atoms, such as phenoxy, 2-methylphenoxy, 4-t-butylphenoxy, 3-nitrophenoxy or 2-tetradecanoylaminophenoxy); silyloxy groups (preferably a silyloxy group having 3 to 20 carbon atoms, such as trimethylsilyloxy or t-butyldimethylsilyloxy); heterocyclic oxy groups (preferably a substituted or unsubstituted heterocyclic oxy group having 2 to 30 carbon atoms, such as 1-phenyltetrazol-5-oxy or 2-tetrahydropyranyloxy); acyloxy groups (preferably a formyloxy group, a substituted or unsubstituted alkylcarbonyloxy group having 2 to 30 carbon atoms or a substituted or unsubstituted arylcarbonyloxy group having 7 to 30 carbon atoms, such as formyloxy, acetyloxy, pivaloyloxy, stearoyloxy, benzoyloxy or p-methoxyphenylcarbonyloxy); carbamoyloxy groups (preferably a substituted or unsubstituted carbamoyloxy group having 1 to 30 carbon atoms, such as N,N-dimethylcarbamoyloxy, N,N-diethylcarbamoyloxy, morpholinocarbonyloxy, N,N-di-n-octylaminocarbonyloxy or N-n-octylcarbamoyloxy); alkoxycarbonyloxy groups (preferably a substituted or unsubstituted alkoxycarbonyloxy group having 2 to 30 carbon atoms, such as methoxycarbonyloxy, ethoxycarbonyloxy, t-butoxycarbonyloxy or n-octylcarbonyloxy); aryloxycarbonyloxy groups (preferably a substituted or unsubstituted aryloxycarbonyloxy group having 7 to 30 carbon atoms, such as phenoxycarbonyloxy, p-methoxyphenoxycarbonyloxy or p-n-hexadecyloxyphenoxycarbonyloxy); amino groups (preferably an amino group, a substituted or unsubstituted alkylamino group having 1 to 30 carbon atoms, a substituted or unsubstituted arylamino group having 6 to 30 carbon atoms or heterocyclic amino groups, such as amino, methylamino, dimethylamino, anilino, N-methylanilino, diphenylamino or 2-pyridylamino); ammonio groups (preferably an ammonio group or an ammonio group substituted with a substituted or unsubstituted alkyl, aryl or heterocycle having 1 to 30 carbon atoms, such as trimethylammonio, triethylammonio or diphenylmethylammonio), acylamino groups (preferably an formylamino group, a substituted or unsubstituted alkylcarbonylamino group having 1 to 30 carbon atoms or a substituted or unsubstituted arylcarbonylamino group having 6 to 30 carbon atoms, such as formylamino, acetylamino, pivaloylamino, lauroylamino, benzoylamino or 3,4,5-tri-n-octyloxyphenylcarbonylamino); aminocarbonylamino groups (preferably a substituted or unsubstituted aminocarbonylamino group having 1 to 30 carbon atoms, such as carbamoylamino, N,N-dimethylaminocarbonylamino, N,N-diethylaminocarbonylamino or morpholinocarbonylamino);

alkoxycarbonylamino groups (preferably a substituted or unsubstituted alkoxycarbonylamino group having 2 to 30 carbon atoms, such as methoxycarbonylamino, ethoxycarbonylamino, t-butoxycarbonylamino, n-octadecyloxycarbonylamino or N-methyl-methoxycarbonylamino); aryloxycarbonylamino groups (preferably a substituted or unsubstituted aryloxycarbonylamino group having 7 to 30 carbon atoms, such as phenoxycarbonylamino, p-chlorophenoxycarbonylamino or m-n-octyloxyphenoxycarbonylamino); sulfamoylamino groups (preferably a substituted or unsubstituted sulfamoylamino group having 0 to 30 carbon atoms, such as sulfamoylamino, N,N-dimethylaminosulfonylamino or N-n-octylaminosulfonylamino); alkyl- or arylsulfonylamino groups (preferably a substituted or unsubstituted alkylsulfonylamino group having 1 to 30 carbon atoms or a substituted or unsubstituted arylsulfonylamino group having 6 to 30 carbon atoms, such as methylsulfonylamino, butylsulfonylamino, phenylsulfonylamino, 2,3,5-trichlorophenylsulfonylamino or p-methylphenylsulfonylamino); a mercapto group; alkylthio groups (preferably a substituted or unsubstituted alkylthio group having 1 to 30 carbon atoms, such as methylthio, ethylthio or n-hexadecylthio); arylthio groups (preferably a substituted or unsubstituted arylthio group having 6 to 30 carbon atoms, such as phenylthio, p-chlorophenylthio or m-methoxyphenylthio); heterocyclic thio groups (preferably a substituted or unsubstituted heterocyclic thio group having 2 to 30 carbon atoms, such as 2-benzothiazolylthio or 1-phenyltetrazol-5-ylthio); sulfamoyl groups (preferably a substituted or unsubstituted sulfamoyl group having 0 to 30 carbon atoms, such as N-ethylsulfamoyl, N-(3-dodecyloxypropyl)sulfamoyl, N,N-dimethylsulfamoyl, N-acetylsulfamoyl, N-benzoylsulfamoyl or N-(N'-phenylcarbamoyl)sulfamoyl); a sulfo group; alkyl- or arylsulfinyl groups (preferably a substituted or unsubstituted alkylsulfinyl group having 1 to 30 carbon atoms or a substituted or unsubstituted arylsulfinyl group having 6 to 30 carbon atoms, such as methylsulfinyl, ethylsulfinyl, phenylsulfinyl or p-methylphenylsulfinyl); alkyl- or arylsulfonyl groups (preferably a substituted or unsubstituted alkylsulfonyl group having 1 to 30 carbon atoms or a substituted or unsubstituted arylsulfonyl group having 6 to 30 carbon atoms, such as methylsulfonyl, ethylsulfonyl, phenylsulfonyl or p-methylphenylsulfonyl);

acyl groups (preferably a formyl group, a substituted or unsubstituted alkylcarbonyl group having 2 to 30 carbon atoms, a substituted or unsubstituted arylcarbonyl group having 7 to 30 carbon atoms or a substituted or unsubstituted heterocyclic carbonyl group having 4 to 30 carbon atoms wherein carbonyl is bonded with carbon atom thereof, such as acetyl, pivaloyl, 2-chloroacetyl, stearoyl, benzoyl, p-n-octyloxyphenylcarbonyl, 2-pyridylcarbonyl or 2-furylcarbonyl); aryloxycarbonyl groups (preferably a substituted or unsubstituted aryloxycarbonyl group having 7 to 30 carbon atoms, such as phenoxycarbonyl, o-chlorophenoxycarbonyl, m-nitrophenoxycarbonyl or p-t-butylphenoxycarbonyl); alkoxycarbonyl groups (preferably a substituted or unsubstituted alkoxycarbonyl group having 2 to 30 carbon atoms, such as methoxycarbonyl, ethoxycarbonyl, t-butoxycarbonyl or n-octadecyloxycarbonyl); carbamoyl groups (preferably a substituted or unsubstituted carbamoyl group having 1 to 30 carbon atoms, such as carbamoyl, N-methylcarbamoyl, N,N-dimethylcarbamoyl, N,N-di-n-octylcarbamoyl or N-(methylsulfonyl)carbamoyl); aryl- or heterocyclic azo groups (preferably a substituted or unsubstituted arylazo group having 6 to 30 carbon atoms or a substituted or unsubstituted heterocyclic azo group having 3 to 30 carbon atoms, such as phenylazo, p-chlorophenylazo or 5-ethylthio-1,3,4-thiadiazol-2-ylazo); imido groups (preferably N-succinimido or N-phthalimido); phosphino groups (preferably a substituted or unsubstituted phosphino group having 2 to 30 carbon atoms, such as dimethylphosphino, diphenylphosphino or methylphenoxyphosphino); phosphinyl groups (preferably a substituted or unsubstituted phosphinyl group having 2 to 30 carbon atoms, such as phosphinyl, dioctyloxyphosphinyl or diethoxyphosphinyl); phosphinyloxy groups (preferably a substituted or unsubstituted phosphinyloxy group having 2 to 30 carbon atoms, such as diphenoxyphosphinyloxy or dioctyloxyphosphinyloxy); phosphinylamino groups (preferably a substituted or unsubstituted phosphinylamino group having 2 to 30 carbon atoms, such as dimethoxyphosphinylamino or dimethylaminophosphinylamino); a phosphono group; silyl groups (preferably a substituted or unsubstituted silyl group having 3 to 30 carbon atoms, such as trimethylsilyl, t-butyldimethylsilyl or phenyldimethylsilyl); hydrazino groups (preferably a substituted or unsubstituted hydrazino group having 0 to 30 carbon atoms, such as trimethylhydrazino); and ureido groups (preferably a substituted or unsubstituted ureido group having 0 to 30 carbon atoms, such as N,N-dimethylureido).

Two W's can cooperate with each other to thereby form a ring (any of aromatic or nonaromatic hydrocarbon rings and heterocycles (these can be combined into polycyclic condensed rings), for example, a benzene ring, a naphthalene ring, an anthracene ring, a phenanthrene ring, a fluorene ring, a triphenylene ring, a naphthacene ring, a biphenyl ring, a pyrrole ring, a furan ring, a thiophene ring, an imidazole ring, an oxazole ring, a thiazole ring, a pyridine ring, a pyrazine ring, a pyrimidine ring, a pyridazine ring, an indolizine ring, an indole ring, a benzofuran ring, a benzothiophene ring, an isobenzofuran ring, a quinolizine ring, a quinoline ring, a phthalazine ring, a naphthylidine ring, a quinoxaline ring, a quinoxazoline ring, an isoquinoline ring, a carbazole ring, a phenanthridine ring, an acridine ring, a phenanthroline ring, a thianthrene ring, a chromene ring, a xanthene ring, a phenoxathine ring, a phenothiazine ring or a phenazine ring).

With respect to those having hydrogen atoms among the above substituents W, the hydrogen atoms may be replaced with the above substituents. Examples of such hydrogen having substituents include a —$CONHSO_2$— group (sulfonylcarbamoyl or carbonylsulfamoyl), a —CONHCO— group (carbonylcarbamoyl) and a —$SO_2NHSO_2$— group (sulfonylsulfamoyl).

More specifically, examples of such hydrogen having substituents include an alkylcarbonylaminosulfonyl group (e.g., acetylaminosulfonyl), an arylcarbonylaminosulfonyl group (e.g., benzoylaminosulfonyl), an alkylsulfonylaminocarbonyl group (e.g., methylsulfonylaminocarbonyl) and an arylsulfonylaminocarbonyl group (e.g., p-methylphenylsulfonylaminocarbonyl).

The heterocyclic compound of specified C log P for use in the present invention will be described below.

The C log P is used as a measure of hydrophilic/hydrophobic properties of compounds.

Generally, the hydrophilic/hydrophobic properties can be determined from the octanol/water partition coefficient of compounds (log P). Practically, the hydrophilic/hydrophobic properties can be determined by actual measurements conducted in accordance with the Flask Shaking method described in the following literature (1).

Literature (1): edited by Toshio Fujita, representative of Friendly Discussion Gathering on Structure Activity Correlation, Kagaku no Ryoiki, Extra Number 122 "Structure activity correlation of drug/guidance for drug design and action mechanism research", Nankodo Co., 1979, chap. 2 pp. 43–203. Specifically, the Flask Shaking method is described on pages 86 to 89 thereof.

However, since measurements may be difficult when the log P is 3 or greater, the log P is defined with the use of a model for calculation thereof in the present invention. The present invention is specified with the use of log P derived from thus calculated values (hereinafter referred to as C log P).

In the present invention, the above C log P is calculated by the use of CLOGP program of Hansch-Leo (Daylight Chemical Information Systems, USA; version: algorithm=4.01, fragment data base=17(*3)).

With respect to the compounds of the present invention, when multiple tautomers exist, the C log P of each of the tautomers can be calculated. When at least one of calculated values falls within specified range, the relevant compound is within the scope of the present invention.

On the other hand, when the above program data base does not contain molecule fragments, data supplementation can be effected by carrying out the above actual measurement of hydrophilic/hydrophobic properties to thereby determine the C log P thereof.

With respect to the compounds of the present invention, the C log P is calculated on the basis of the state thereof at pH=4. When a compound according to the present invention has carboxyl, the carboxyl is regarded as not being dissociated at that state.

The important feature of the compounds of the present invention resides in the hydrophilic/hydrophobic properties thereof. For maximizing photographic effects, it is required to control the distribution into water and the interaction with silver halide emulsions.

The present invention is characterized by containing at least one heterocyclic compound of less than 4.5 C log P and at least one heterocyclic compound of 4.5 or greater C log P. The joint use of these compounds can lead to maximization of photographic effects. In the present invention, although at least two of these compounds are contained, at least three thereof can also preferably be contained.

With respect to the heterocyclic compound of less than 4.5 C log P, the C log P value is preferably in the range of −5 to less than 4.5, more preferably −2 to 3, still more preferably −1 to 1, and most preferably −0.5 to 0.5. With respect to the heterocyclic compound of 4.5 or greater C log P, the C log P value is preferably in the range of 4.5 to 18, more preferably 6 to 16, further more preferably 7.5 to 15, still further more preferably 9 to 14, yet still further more preferably 10 to 13 and most preferably 10.5 to 11.5.

Further preferred photographic effects can be exerted when the above two types of heterocyclic compounds preferred are used in combination.

The heterocyclic compound refers to a cyclic compound having one or more heteroatoms. Hereinafter, the compound being a heterocycle having only one or two heteroatoms which does not react with developing agent oxidation products will be referred to as compound (H-1), the compound being a heterocycle having only one or two heteroatoms which reacts with developing agent oxidation products as compound (H-2), the compound being a heterocycle having three or more heteroatoms which reacts with developing agent oxidation products as compound (H-3), and the compound being a heterocycle having three or more heteroatoms which does not react with developing agent oxidation products as compound (H-4), and each thereof will be described.

The preferred combination of types of heterocyclic compounds (H-1) to (H-4) and C log P will be described below. In the present invention, use can be made of any heterocyclic compounds as long as at least one heterocyclic compound of less than 4.5 C log P and at least one heterocyclic compound of 4.5 or greater C log P are contained. The heterocyclic compound of less than 4.5 C log P is preferably compound (H-1) or compound (H-4), more preferably compound (H-1). The heterocyclic compound of 4.5 or greater C log P is preferably compound (H-1), compound (H-2) or compound (H-3), more preferably compound (H-1) or compound (H-3) and most preferably compound (H-1).

Further preferred photographic effects can be exerted when these varied types of heterocyclic compounds preferred are used in combination.

Specifically, combinations especially preferred in the present invention are as follows: use of compound (H-1) of less than 4.5 C log P combined with compound (H-1) of 4.5 or greater C log P, use of compound (H-1) of less than 4.5 C log P combined with compound (H-3) of 4.5 or greater C log P, and use of compound (H-1) of less than 4.5 C log P combined with compounds (H-1) and (H-3) of 4.5 or greater C log P, namely, three-compound combination. Most preferred combination is use of compound (H-1) of less than 4.5 C log P combined with compounds (H-1) and (H-3) of 4.5 or greater C log P, namely, three-compound combination. (The preferred ranges of C log P are as mentioned above.)

The heterocyclic compounds (H-1) and (H-2) having only one or two heteroatoms for use in the present invention will be described. Heteroatom refers to atoms other than carbon and hydrogen atoms. Heterocycle refers to a cyclic compound having at least one heteroatom. The heteroatom of the "heterocycle having only one or two heteroatoms" refers to only atoms as constituents of a heterocyclic ring system, and does not mean atoms positioned outside the ring system and atoms as parts of further substituents of the ring system.

With respect to polynuclear heterocycles, only those wherein the number of heteroatoms in all the ring systems is 1 or 2 are included. For example, 1,3,4,6-tetrazaindene is not included therein because the number of heteroatoms is 4.

Although any heterocyclic compounds satisfying the above requirements can be employed, the heteroatom is preferably a nitrogen atom, a sulfur atom, an oxygen atom, a selenium atom, a tellurium atom, a phosphorus atom, a silicon atom or a boron atom. More preferably, the heteroatom is a nitrogen atom, a sulfur atom, an oxygen atom or a selenium atom. Further more preferably, the heteroatom is a nitrogen atom, a sulfur atom or an oxygen atom. Most preferably, the heteroatom is a nitrogen atom or a sulfur atom.

Although the number of members of heterocycles is not limited, a 3- to 8-membered ring is preferred. A 5- to 7-membered ring is more preferred. A 5- or 6-membered ring is most preferred.

Although the heterocycles may be saturated or unsaturated, those having at least one unsaturated moiety are preferred. Those having at least two unsaturated moieties are more preferred. Stated in another way, although the heterocycle may be any of aromatic, pseudo-aromatic and non-aromatic heterocycles, aromatic and pseudo-aromatic heterocycles are preferred.

Examples of these heterocycles include a pyrrole ring, a thiophene ring, a furan ring, an imidazole ring, a pyrazole ring, a thiazole ring, an isothiazole ring, an oxazole ring, an isooxazole ring, a pyridine ring, a pyrazine ring, a pyrimidine ring, a pyridazine ring and an indolizine ring; resulting from benzo ring condensation thereof, an indole ring, a benzofuran ring, a benzothiophene ring, an isobenzofuran ring, a quinolizine ring, a quinoline ring, a phthalazine ring, a quinoxaline ring, an isoquinoline ring, a carbazole ring, a phenanthridine ring, a phenanthroline ring and an acridine ring; and resulting from partial or complete saturation thereof, a pyrrolidine ring, a pyrroline ring and an imidazoline ring.

Representative examples of heterocycles will be shown below.

(aa-1)
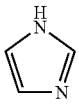
(aa-2)
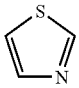
(aa-3)
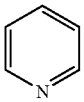
(aa-4)
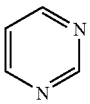
(aa-5)
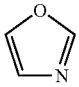
(aa-6)
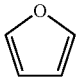
(aa-7)
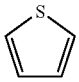
(aa-8)
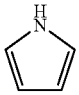
(aa-9)
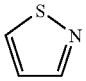
(aa-10)
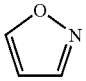
(aa-11)
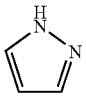
(aa-12)
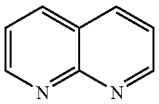
(aa-13)
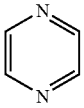
(aa-14)
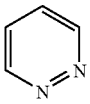
(aa-15)
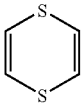
-continued
(aa-16)
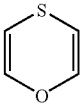
(aa-17)
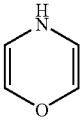
(aa-18)
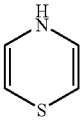
As the heterocycles resulting from benzene ring condensation, for example, the following can be shown.
(ab-1)
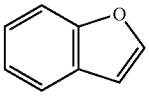
(ab-2)
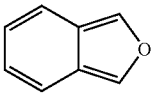
(ab-3)
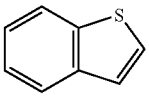
(ab-4)
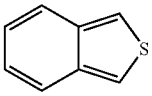
(ab-5)
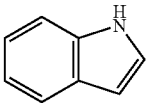
(ab-6)
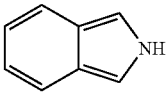
(ab-7)
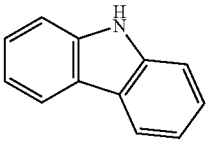
(ab-8)
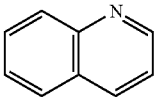
(ab-9)
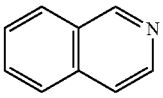

-continued
(ab-10)
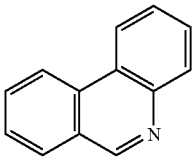
(ab-11)
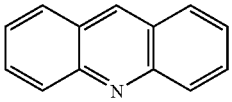
(ab-12)
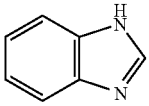
(ab-13)
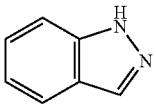
(ab-14)
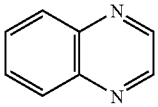
(ab-15)
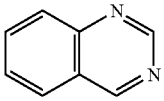
(ab-16)
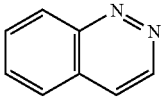
(ab-17)
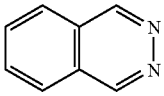
(ab-18)
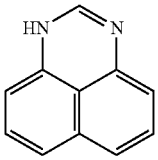
(ab-19)
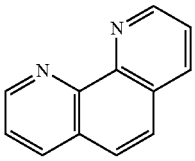
(ab-20)
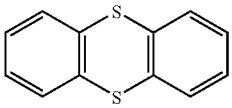
(ab-21)
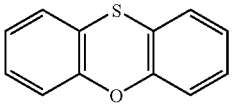
-continued
(ab-22)
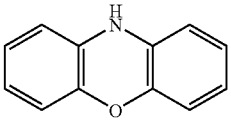
(ab-23)
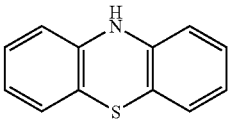
(ab-24)
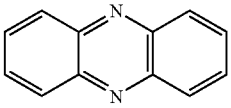
(ab-25)
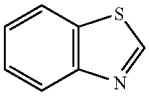
(ab-26)
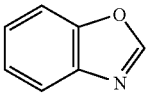
(ab-27)
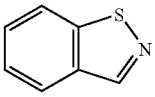
(ab-28)
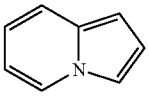
(ab-29)
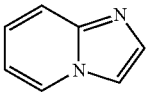
As the heterocycles resulting from partial or complete saturation, for example, the following can be shown.
(ac-1)
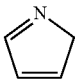
(ac-2)
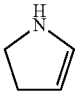
(ac-3)
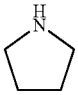
(ac-4)
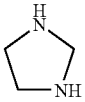
(ac-5)
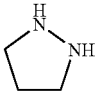

-continued (ac-6)

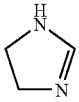

(ac-7)

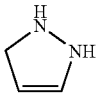

(ac-8)

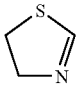

(ac-9)

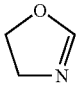

(ac-10)

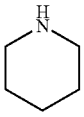

(ac-11)

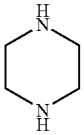

(ac-12)

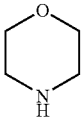

(ac-13)

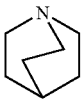

(ac-14)

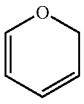

(ac-15)

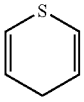

(ac-16)

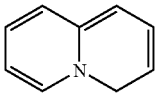

(ac-17)

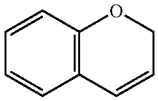

(ac-18)

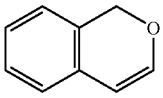

-continued (ac-19)

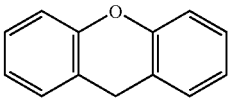

Furthermore, the following heterocycles can be used.

(ad-1)

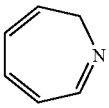

(ad-2)

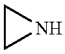

(ad-3)

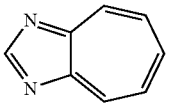

(ad-4)

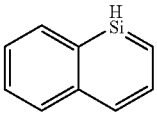

(ad-5)

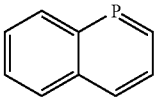

(ad-6)

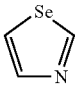

(ad-7)

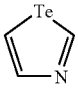

(ad-8)

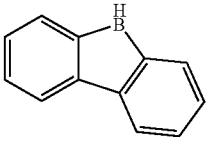

These heterocycles, unless contrary to the definition of "heterocycle having only one or two heteroatoms", may have any substituents or may be in the form of any condensed ring. As the substituents, there can be mentioned the aforementioned W. The tertiary nitrogen atom contained in heterocycles may be substituted into a quaternary nitrogen. Moreover, any other tautomeric structures which can be drawn with respect to heterocycles are chemically equivalent to each other.

With respect to the heterocycles having only one or two heteroatoms, it is preferred that free thiol (—SH) and thiocarbonyl (>C═S) be in unsubstituted form.

Among the heterocycles, heterocycles (aa-1) to (aa-4) are preferred. With respect to heterocycles (aa-2), heterocycle with benzene ring condensed thereto (ab-25) is more preferred.

Although the heterocyclic compounds having only one or two heteroatoms may react or may not react with oxidizing developing agents, preferred use can be made of heterocyclic compounds which do not react with oxidizing developing agents.

That is, heterocyclic compounds which induce no marked (5 to less than 10%) direct chemical reaction or redox reaction with oxidizing developing agents are preferred. Further, those which are not couplers, being incapable of reacting with oxidizing developing agents to form dyes or other products are preferred.

Among the heterocyclic compounds (H-1) and (H-2) described above, the heterocyclic compounds (H-1) are preferred.

Herein, the compounds that do not induce any significant direct chemical reaction or redox reaction with oxidative developing agents refer to those wherein the reactivity (CRV) determined in the following method is given value or below.

The reactivity (CRV) of compounds of the present invention with oxidizing developing agents is determined in the following manner.

Test sensitive material (A) will be exposed to white light and processed in the same manner as described in Example 1 except that the processing time in color development step will be changed to 1 min 30 sec. The yellow density, magenta density and cyan density of the sensitive material will be measured, and the respective differences from the yellow density, magenta density and cyan density of sensitive material containing none of compounds of the present invention will be calculated.

The highest value among the respective differences from the yellow density, magenta density and cyan density determined in the above method is defined as CRV value. When the CRV value is 0 to less than 0.05, the compound should be referred to as "the compound does not react with developing agent oxidation products", while when the CRV value is 0.05 or more, the compound should be referred to as "the compound reacts with developing agent oxidation products."

Test Sensitive Material (A)

(Support) Cellulose Triacetate (Emulsion Layer)

| | |
|---|---|
| Em-C in terms of Ag | 1.07 $g/m^2$ |
| Gelatin | 2.33 $g/m^2$ |
| Tricresyl phosphate | 0.62 $g/m^2$ |
| Compound of invention | $3.9 \times 10^{-4}$ $mol/m^2$ |

(Protective Layer)

| | |
|---|---|
| Gelatin | 2.00 $g/m^2$ |
| H-1 | 0.33 $g/m^2$ |
| B-1 (diam. 1.7 μm) | 0.10 $g/m^2$ |
| B-2 (diam. 1.7 μm) | 0.30 $g/m^2$ |
| B-3 | 0.10 $g/m^2$ |

The characteristics of emulsion Em-C and structural formulae of compounds employed in the above test sensitive material (A) were specified in Example 1 described later.

Among the heterocyclic compounds having only one or two heteroatoms, those of the following general formula (I) are more preferred.

General formula (I)

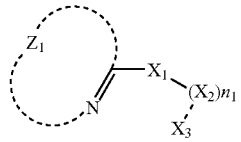

In the general formula (I), $Z_1$ represents a group for forming a heterocycle having only one or two heteroatoms including the nitrogen atom of the formula. $X_1$ represents a sulfur atom, an oxygen atom, a nitrogen atom (N(Va)) or a carbon atom (C(Vb)(Vc)). Each of Va, Vb and Vc represents a hydrogen atom or a substituent. $X_2$ has the same meaning as that of $X_1$. $n_1$ is 0, 1, 2 or 3. When $n_1$ is 2 or greater, $X_2$ becomes multiple. It is not necessary for the multiple groups to be identical with each other. $X_3$ represents a sulfur atom, an oxygen atom or a nitrogen atom. The bond between $X_2$ and $X_3$ is single or double. Accordingly, $X_3$ may further have a substituent or a charge.

Among the heterocyclic compounds having only one or two heteroatoms, those of the following general formula (II) are most preferred.

General formula (II)

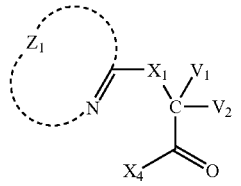

In the general formula (II), $Z_1$ and $X_1$ are as defined in the general formula (I). $X_4$ represents a sulfur atom (S(Vd)), an oxygen atom (O(Ve)) or a nitrogen atom (N(Vf)(Vg)). Each of Vd, Ve, Vf and Vg represents a hydrogen atom, a substituent or a negative charge. Each of $V_1$ and $V_2$ represents a hydrogen atom or a substituent.

The general formula (I) and general formula (II) will be described in detail below.

As the heterocycles formed by $Z_1$, there can preferably be mentioned those set forth above with respect to (aa-1) to (aa-18), (ab-1) to (ab-29), (ac-1) to (ac-19) and (ad-1) to (ad-8), and preferred examples thereof are also the same. These heterocycles, unless contrary to the definition of "heterocycle having only one or two heteroatoms", may further have any substituents (for example, aforementioned W) or may be in the form of any condensed ring.

$X_1$ preferably represents a sulfur atom, an oxygen atom or a nitrogen atom, more preferably a sulfur atom or a nitrogen atom, and most preferably a sulfur atom. As the substituent represented by Va, Vb and Vc, there can be mentioned the aforementioned W, and preferred substituents are an alkyl group, an aryl group and a heterocyclic group. $X_2$ preferably represents a carbon atom. $n_1$ is preferably 0, 1 or 2, more preferably 2. $X_3$ preferably represents an oxygen atom. The valence of $X_3$ changes depending on whether the bond between $X_2$ and $X_3$ is single or double. For example, when the bond between $X_2$ and $X_3$ is double and $X_3$ is an oxygen atom, $X_3$ represents a carbonyl group. On the other hand, when the bond between $X_2$ and $X_3$ is single and $X_3$ is an oxygen atom, $X_3$ represents, for example, a hydroxyl group, an alkoxy group, an oxygen atom having a negative charge or the like.

$X_4$ preferably represents an oxygen atom. As the substituents represented by Vd, Ve, Vf and Vg, there can be mentioned those aforementioned as being represented by W. Vd, Ve and at least one of Vf and Vg preferably represent hydrogen atoms and negative charges. As the substituent represented by $V_1$ and $V_2$, there can be mentioned the aforementioned W. At least one of $V_1$ and $V_2$ is preferably not a hydrogen atom, representing a substituent.

As the substituents, there can preferably be mentioned, for example, a halogen atom (e.g., a chlorine atom, a bromine atom or a fluorine atom); an alkyl group (having 1 to 60 carbon atoms, such as methyl, ethyl, propyl, isobutyl, t-butyl, t-octyl, 1-ethylhexyl, nonyl, undecyl, pentadecyl, n-hexadecyl or 3-decanamidopropyl); an alkenyl group (having 2 to 60 carbon atoms, such as vinyl, allyl or oleyl); a cycloalkyl group (having 5 to 60 carbon atoms, such as cyclopentyl, cyclohexyl, 4-t-butylcyclohexyl, 1-indanyl or cyclododecyl); an aryl group (having 6 to 60 carbon atoms, such as phenyl, p-tolyl or naphthyl); an acylamino group (having 2 to 60 carbon atoms, such as acetylamino, n-butanamido, octanoylamino, 2-hexyldecanamido, 2-(2',4'-di-t-amylphenoxy)butanamido, benzoylamino or nicotinamido); a sulfonamido group (having 1 to 60 carbon atoms, such as methanesulfonamido, octanesulfonamido or benzenesulfonamido); a ureido group (having 2 to 60 carbon atoms, such as decylaminocarbonylamino or di-n-octylaminocarbonylamino); a urethane group (having 2 to 60 carbon atoms, such as dodecyloxycarbonylamino, phenoxycarbonylamino or 2-ethylhexyloxycarbonylamino); an alkoxy group (having 1 to 60 carbon atoms, such as methoxy, ethoxy, butoxy, n-octyloxy, hexadecyloxy or methoxyethoxy); an aryloxy group (having 6 to 60 carbon atoms, such as phenoxy, 2,4-di-t-amylphenoxy, 4-t-octylphenoxy or naphthoxy); an alkylthio group (having 1 to 60 carbon atoms, such as methylthio, ethylthio, butylthio or hexadecylthio); an arylthio group (having 6 to 60 carbon atoms, such as phenylthio or 4-dodecyloxyphenylthio); an acyl group (having 1 to 60 carbon atoms, such as acetyl, benzoyl, butanoyl or dodecanoyl); a sulfonyl group (having 1 to 60 carbon atoms, such as methanesulfonyl, butanesulfonyl or toluenesulfonyl); a cyano group; a carbamoyl group (having 1 to 60 carbon atoms, such as N,N-dicyclohexylcarbamoyl); a sulfamoyl group (having 0 to 60 carbon atoms, such as N,N-dimethylsulfamoyl); a hydroxyl group; a sulfo group; a carboxyl group; a nitro group; an alkylamino group (having 1 to 60 carbon atoms, such as methylamino, diethylamino, octylamino or octadecylamino); an arylamino group (having 6 to 60 carbon atoms, such as phenylamino, naphthylaminor or N-methyl-N-phenylamino); a heterocyclic group (having 0 to 60 carbon atoms, preferably heterocyclic group wherein an atom selected from among a nitrogen atom, an oxygen atom and a sulfur atom is used as a heteroatom being a constituent of the ring, more preferably heterocyclic group wherein not only a heteroatom but also a carbon atom is used as constituent atoms of the ring, and especially heterocyclic group having a 3 to 8-, preferably 5 or 6-membered ring, such as heterocyclic groups listed above as being represented by W); and an acyloxy group (having 1 to 60 carbon atoms, such as formyloxy, acetyloxy, myristoyloxy or benzoyloxy).

Among these groups, the alkyl, cycloalkyl, aryl, acylamino, ureido, urethane, alkoxy, aryloxy, alkylthio, arylthio, acyl, sulfonyl, cyano, carbamoyl and sulfamoyl groups include those having substituents. Examples of such substituents include an alkyl group, a cycloalkyl group, an aryl group, an acylamino group, a ureido group, a urethane group, an alkoxy group, an aryloxy group, an alkylthio group, an arylthio group, an acyl group, a sulfonyl group, a cyano group, a carbamoyl group and a sulfamoyl group.

Among these substituents, an alkyl group, an aryl group, an alkoxy group and an aryloxy group are preferred. An alkyl group, an alkoxy group and an aryloxy group are more preferred. The most preferred substituent is a branched alkyl group.

The sum of carbon atoms of each of these substituents, although not particularly limited, is preferably in the range of 8 to 60, more preferably 10 to 57, still more preferably 12 to 55, and most preferably 16 to 53.

The compounds represented by the general formula (I) and general formula (II) are preferably those suitable for the following immobilization methods (1) to (7), more preferably immobilization method (1), (2) or (3), still more preferably immobilization method (1) or (2), and most preferably immobilization methods (1) and (2) simultaneously employed. That is, compounds simultaneously having specified pKa and ballasting group can most preferably be employed.

The compounds of the present invention can contain, when required for neutralizing the charge thereof, a required number of required cations or anions. As representative cations, there can be mentioned inorganic cations such as proton ($H^+$), alkali metal ions (e.g., sodium ion, potassium ion and lithium ion) and alkaline earth metal ions (e.g., calcium ion); and organic ions such as ammonium ions (e.g., ammonium ion, tetraalkylammonium ion, triethylammonium ion, pyridinium ion, ethylpyridinium ion and 1,8-diazabicyclo[5,4,0]-7-undecenium ion). The anions can be inorganic anions or organic anions. As such, there can be mentioned halide anions (e.g., fluoride ion, chloride ion and iodide ion), substituted arylsulfonate ions (e.g., p-toluenesulfonate ion and p-chlorobenzenesulfonate ion), aryldisulfonate ions (e.g., 1,3-benzenedisulfonate ion, 1,5-naphthalenedisulfonate ion and 2,6-naphthalenedisulfonate ion), alkylsulfate ions (e.g., methylsulfate ion), sulfate ion, thiocyanate ion, perchlorate ion, tetrafluoroborate ion, picrate ion, acetate ion and trifluoromethanesulfonate ion. Further, use can be made of ionic polymers and other dyes having charges opposite to those of dyes. $CO_2^-$ and $SO_3^-$, when having a proton as a counter ion, can be indicated as $CO_2H$ and $SO_3H$, respectively.

In the present invention, it is preferred to use combinations of individual preferred compounds (especially combinations of individual most preferred compounds) mentioned above.

Among the heterocyclic compounds each having only one or two heteroatoms according to the present invention, specified in the above section, especially preferred specific examples will be shown below, which however in no way limit the scope of the invention. Relevant C log P values will also be shown.

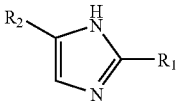
(a-1): $R_1$, $R_2$ = H ClogP = -0.029
(a-2): $R_1$ = $CH_3$, $R_2$ = H ClogP = 0.240
(a-3): $R_1$ = n-$C_3H_7$, $R_2$ = H ClogP = 1.298
(a-4): $R_1$ = $SCH_3$, $R_2$ = H ClogP = 1.110
(a-5): $R_1$ = H, $R_2$ = $CH_3$ ClogP = 0.240
(a-6): $R_1$ = H, $R_2$ = $CH_2CH_2NH_2$ ClogP = -0.968
(a-7): $R_1$ = H, $R_2$ = $CH_2CH(NH_2)CO_2H$) ClogP = 3.727
(a-8)
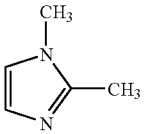
ClogP = 0.256
(a-9)
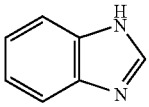
ClogP = 1.565
(a-10)
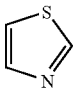
ClogP = 0.486
(a-11)
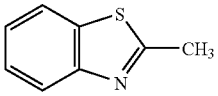
ClogP = 2.579
(a-12)
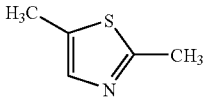
ClogP = 1.484
(a-13)
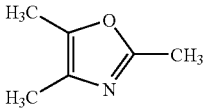
ClogP = 0.578
(a-14)
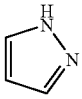
ClogP = 0.241
(a-15)
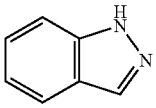
ClogP = 1.625
(a-16)
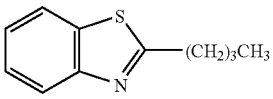
ClogP = 4.166
-continued
(b-1)
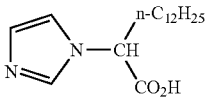
ClogP = 5.717
(b-2)
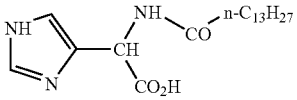
ClogP = 4.908
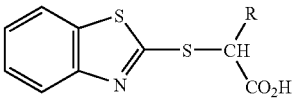
(b-3): R = n-$C_{12}H_{25}$ ClogP = 8.764
(b-4): R = n-$C_{16}H_{33}$ ClogP = 10.880
(b-5)
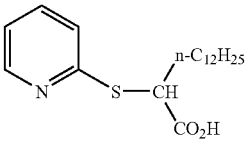
ClogP = 7.315
(b-6)
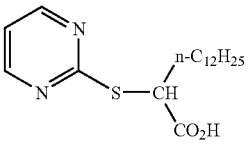
ClogP = 6.421
(b-7)
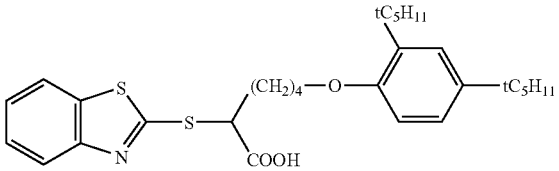
ClogP = 10.08
(b-8)
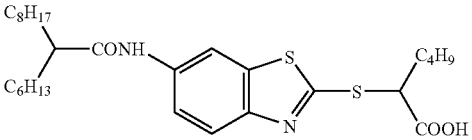
ClogP = 11.41
(b-9)
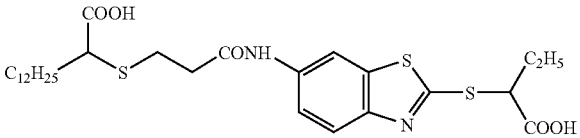
ClogP = 9.62

-continued (b-10)

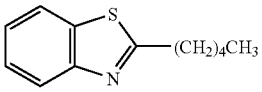

ClogP = 4.695

With respect to the heterocyclic compounds each having only one or two heteroatoms according to the present invention, although as aforementioned those not reactive with developing agent oxidation products are preferred, those reactive with developing agent oxidation products, i.e., H-2, include compounds of the following general formulae.

(III-1)

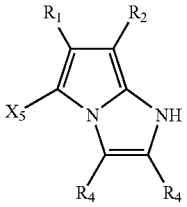

(III-2)

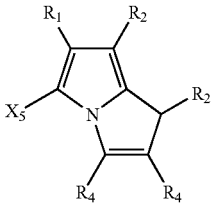

(III-3)

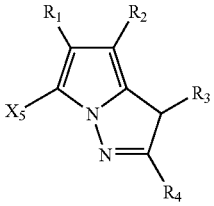

(III-4)

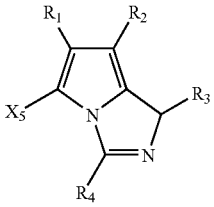

In the general formulae (III-1) to (III-4), each of $R_1$, $R_2$ and $R_3$ independently represents electron withdrawing groups whose Hammett substituent constant σp value is in the range of 0.2 to 1.0. $R_4$ represents a hydrogen atom or a substituent, provided that when there are two $R_4$'s in the formula, they may be identical with or different from each other. $X_5$ represents a hydrogen atom or a substituent. The groups represented by $R_1$, $R_2$, $R_3$, $R_4$ and $X_5$ are the same as those represented by $R_{11}$, $R_{12}$, $R_{13}$, $R_{14}$ and $X_{11}$ described later, respectively, and those preferred are also the same.

Among the heterocyclic compounds each having only one or two heteroatoms which react with developing agent oxidation products, i.e., H-2, especially preferred specific examples will be shown below, which however naturally in no way limit the scope of the invention. Relevant C log P values will also be shown.

(C-1)

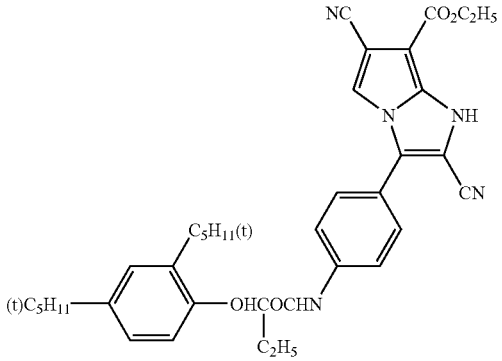

ClogP = 9.682

(C-2)

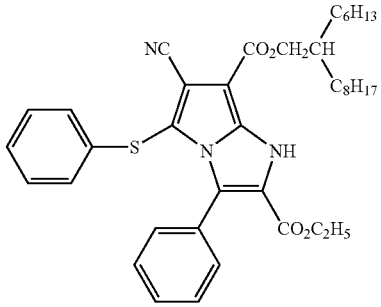

ClogP = 13.794

(C-3)

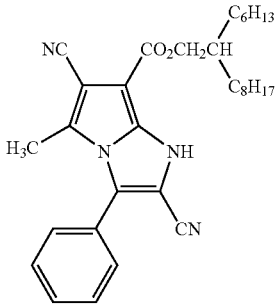

ClogP = 11.124

(C-4)

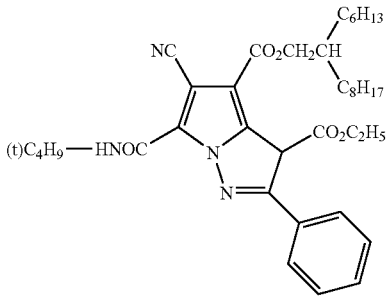

ClogP = 10.845

-continued (C-5)

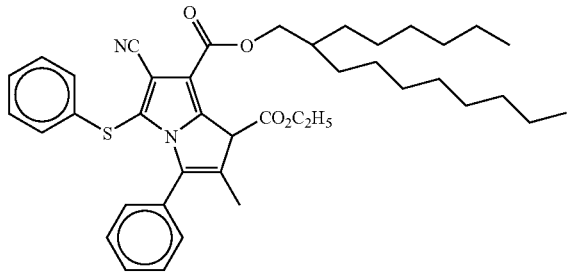

ClogP = 13.617

(C-6)

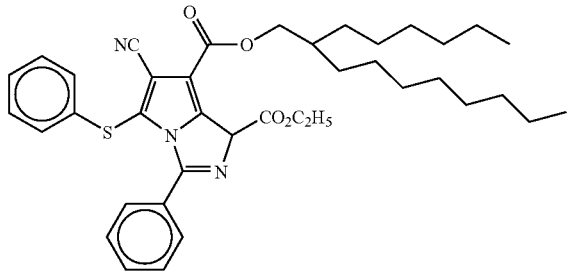

ClogP = 12.888

In addition to those shown above, the compounds (67), (68) and (84) described in JP-A-2004-046061 can preferably be used.

As the heterocyclic compounds each having only one or two heteroatoms, use can be made of those described in, for example, "The Chemistry of Heterocyclic Compounds—A Series of Monographs" vol. 1–59, edited by Edward C. Taylor and Arnold Weissberger and published by John Wiley & Sons and "Heterocyclic Compounds" vol. 1–6, edited by Robert C. Elderfield and published by John Wiley & Sons. The heterocyclic compounds each having only one or two heteroatoms can be synthesized by the processes described therein.

Synthetic Example: Synthesis of Compound (b-3)

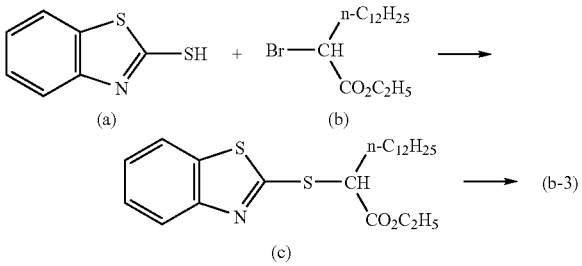

A mixture of 7.4 g of compound (a), 13.4 g of compound (b), 100 milliliters (hereinafter, milliliter also refered to as "mL") and 10 mL of dimethylacetamide was agitated at an internal temperature of 10° C. or below while cooling with ice. 6.1 mL of triethylamine was dropped into the mixture and agitated at room temperature for 2 hr. Thereafter 200 mL of ethyl acetate was added to the reaction solution. Washing with a dilute aqueous NaOH solution and fractionation, washing with a dilute hydrochloric acid and fractionation and washing with a saturated saline solution and fractionation were sequentially performed, and the obtained ethyl acetate layer was dried over magnesium sulfate. Solvent was evaporated in vacuum, and the concentrate was purified through silica gel column chromatography (eluant: 19:1 hexane and ethyl acetate), thereby obtaining 16.2 g of compound (c) (yield 96%). A mixture of 14.8 g of compound (c), 2.8 g of NaOH, 50 mL of ethanol and 5 mL of water was agitated at room temperature for 2 hr, and 200 mL of water was added thereto. The mixture was washed with hexane and fractionated, and the hexane layer was removed. 200 mL of ethyl acetate together with dilute hydrochloric acid was added to the water layer and fractionated, and the water layer was removed. Further, the mixture was washed with a saturated saline solution and fractionated. The ethyl acetate layer was dried over magnesium sulfate and concentrated in vacuum until the amount of solvent became 30 mL. Hexane was added to the concentrate, and agitated. Precipitated crystal was collected by suction filtration and dried. Thus, 13.2 g of colorless crystal (b-3) (melting point 75 to 77° C.) was obtained (yield 96%).

The heterocyclic compounds (H-3) and (H-4) each having three or more heteroatoms for use in the present invention will now be described. The heteroatom refers to an atom other than carbon and hydrogen atoms. The heterocycle refers to a cyclic compound having at least one heteroatom. In this aspect of the present invention, the heterocycle is a heterocyclic compound having three or more heteroatoms. The heteroatoms of the "heterocycle having three or more heteroatoms" refer to only atoms as constituents of a heterocyclic ring system, and do not mean atoms positioned outside the ring system, atoms separated through at least one nonconjugated single bond from the ring system and atoms as parts of further substituents of the ring system.

With respect to polynuclear heterocycles, only those wherein the number of heteroatoms in all the ring systems is 3 or more are included in the present invention. For example, with respect to 1H-pyrazolo[1,5-b][1,2,4]triazole, the number of heteroatoms is 4 and hence the compound is included in the heterocycles each having three or more heteroatoms according to the present invention.

The number of heteroatoms, although there is no particular upper limit, is preferably 10 or less, more preferably 8 or less, still more preferably 6 or less, and most preferably 4 or less.

Although any heterocyclic compounds satisfying the above requirements can be employed, the heteroatom is preferably a nitrogen atom, a sulfur atom, an oxygen atom, a selenium atom, a tellurium atom, a phosphorus atom, a silicon atom or a boron atom. More preferably, the heteroatom is a nitrogen atom, a sulfur atom or an oxygen atom. Still more preferably, the heteroatom is a nitrogen atom or a sulfur atom. Most preferably, the heteroatom is a nitrogen atom.

Although the number of members of heterocycles is not limited, a 3- to 8-membered ring is preferred. A 5- to 7-membered ring is more preferred. A 5- or 6-membered ring is still more preferred. A 5-membered ring is most preferred.

Although the heterocycles may be saturated or unsaturated, those having at least one unsaturated moiety are preferred. Those having at least two unsaturated moieties are more preferred. Stated in another way, although the heterocycle may be any of aromatic, pseudo-aromatic and non-aromatic heterocycles, aromatic and pseudo-aromatic heterocycles are preferred.

The heterocycle is preferably a polynuclear heterocycle resulting from ring condensation, most preferably a heterocycle of two rings.

Although the heterocyclic compounds having three or more heteroatoms may react or may not react with oxidizing developing agents, preferred use can be made of heterocyclic compounds which react with oxidizing developing agents.

Among the aforementioned heterocyclic compounds (H-3) having 3 or more heteroatoms and being reactive with oxidative developing agents and heterocyclic compounds (H-4) having 3 or more heteroatoms and not being reactive with oxidative developing agents, the heterocyclic compounds (H-3) are preferred.

Compounds (H-3) will be described in detail below.

Compounds represented by the following general formula (M) or general formula (C) can most preferably be used as the heterocycle having three or more heteroatoms according to the present invention.

(M)

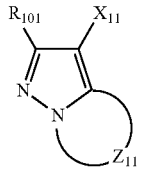

(C)

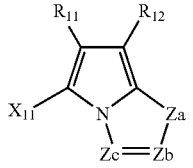

In the general formula (M), $R_{101}$ represents a hydrogen atom or a substituent. $Z_{11}$ represents a nonmetallic atom group required for forming a 5-membered azole ring containing 2 to 4 nitrogen atoms, which azole ring may have substituents (including a condensed ring). $X_{11}$ represents a hydrogen atom or a substituent.

In the general formula (C), Za represents —NH— or —CH($R_3$)—. Each of Zb and Zc independently represents —C($R_{14}$)═ or —N═, provided that when Za is —NH—, at least one of Zb and Zc is —N═ and that when Za is —CH($R_{13}$)—, both of Zb and Zc are —N═. Each of $R_{11}$, $R_{12}$ and $R_{13}$ independently represents electron withdrawing groups whose Hammett substituent constant up value is in the range of 0.2 to 1.0. $R_{14}$ represents a hydrogen atom or a substituent, provided that when there are two $R_{14}$'s in the formula, they may be identical with or different from each other. $X_{11}$ represents a hydrogen atom or a substituent.

These compounds will be described in detail below. Among the skeletons represented by the formula (M), those preferred are 1H-pyrazolo[1,5-b][1,2,4]triazole and 1H-pyrazolo[5,1-c][1,2,4]triazole, respectively represented by the formulae (M-1) and (M-2).

(M-1)

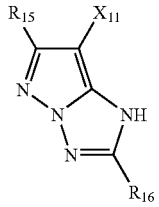

(M-2)

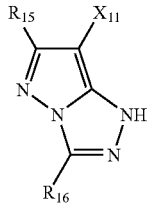

In the formulae, $R_{15}$ and $R_{16}$ represent substituents, and $X_{11}$ represents a hydrogen atom or a substituent.

The substituents $R_{15}$, $R_{16}$ and $X_{11}$ of the formulae (M-1) and (M-2) will be described in detail below.

As the substituent $R_{15}$, there can preferably be mentioned a halogen atom (e.g., a chlorine atom, a bromine atom or a fluorine atom); an alkyl group (having 1 to 60 carbon atoms, such as methyl, ethyl, propyl, isobutyl, t-butyl, t-octyl, 1-ethylhexyl, nonyl, undecyl, pentadecyl, n-hexadecyl or 3-decanamidopropyl); an alkenyl group (having 2 to 60 carbon atoms, such as vinyl, allyl or oleyl); a cycloalkyl group (having 5 to 60 carbon atoms, such as cyclopentyl, cyclohexyl, 4-t-butylcyclohexyl, 1-indanyl or cyclododecyl); an aryl group (having 6 to 60 carbon atoms, such as phenyl, p-tolyl or naphthyl); an acylamino group (having 2 to 60 carbon atoms, such as acetylamino, n-butanamido, octanoylamino, 2-hexyldecanamido, 2-(2',4'-di-t-amylphenoxy)butanamido, benzoylamino or nicotinamido); a sulfonamido group (having 1 to 60 carbon atoms, such as methanesulfonamido, octanesulfonamido or benzenesulfonamido); a ureido group (having 2 to 60 carbon atoms, such as decylaminocarbonylamino or di-n-octylaminocarbonylamino); a urethane group (having 2 to 60 carbon atoms, such as dodecyloxycarbonylamino, phenoxycarbonylamino or 2-ethylhexyloxycarbonylamino); an alkoxy group (having 1 to 60 carbon atoms, such as methoxy, ethoxy, butoxy, n-octyloxy, hexadecyloxy or methoxyethoxy); an aryloxy group (having 6 to 60 carbon atoms, such as phenoxy, 2,4-di-t-amylphenoxy, 4-t-octylphenoxy or naphthoxy); an alkylthio group (having 1 to 60 carbon atoms, such as methylthio, ethylthio, butylthio or hexadecylthio); an arylthio group (having 6 to 60 carbon atoms, such as phenylthio or 4-dodecyloxyphenylthio); an acyl group (having 1 to 60 carbon atoms, such as acetyl, benzoyl, butanoyl or dodecanoyl); a sulfonyl group (having 1 to 60 carbon atoms, such as methanesulfonyl, butanesulfonyl or toluenesulfonyl); a cyano group; a carbamoyl group (having 1 to 60 carbon atoms, such as N,N-dicyclohexylcarbamoyl); a sulfamoyl group (having 0 to 60 carbon atoms, such as N,N-dimethylsulfamoyl); a hydroxyl group; a sulfo group; a carboxyl group; a nitro group; an alkylamino group (having 1 to 60 carbon atoms, such as methylamino, diethylamino, octylamino or octadecylamino); an arylamino group (having 6 to 60 carbon atoms, such as phenylamino, naphthylaminor or N-methyl-N-phenylamino); a heterocyclic group (having 0 to 60 carbon atoms, preferably heterocyclic group wherein an atom selected from among a nitrogen atom, an oxygen atom and a sulfur atom is used as a heteroatom being a constituent of the ring, more preferably heterocyclic group wherein not only a heteroatom but also a carbon atom is used as constituent atoms of the ring, and especially heterocyclic group having a 3 to 8-, preferably 5 or 6-membered ring, such as heterocyclic groups listed below as being represented by $X_{11}$); or an acyloxy group (having 1 to 60 carbon atoms, such as formyloxy, acetyloxy, myristoyloxy or benzoyloxy).

Among these groups, the alkyl, cycloalkyl, aryl, acylamino, ureido, urethane, alkoxy, aryloxy, alkylthio, arylthio, acyl, sulfonyl, cyano, carbamoyl and sulfamoyl groups include those having substituents. Examples of such substituents include an alkyl group, a cycloalkyl group, an aryl group, an acylamino group, a ureido group, a urethane group, an alkoxy group, an aryloxy group, an alkylthio group, an arylthio group, an acyl group, a sulfonyl group, a cyano group, a carbamoyl group and a sulfamoyl group.

Among these substituents, an alkyl group, an aryl group, an alkoxy group and an aryloxy group are preferred as $R_{15}$. An alkyl group, an alkoxy group and an aryloxy group are more preferred. The most preferred substituent is a branched alkyl group.

It is preferred that $R_{16}$ represent substituents mentioned as being represented by $R_{12}$. More preferred substituents are an alkyl group, an aryl group, a heterocyclic group, an alkoxy group and an aryloxy group.

Still more preferred groups are an alkyl group and a substituted aryl group. The most preferred group is a substituted aryl group. The compounds of the general formulae (M-3) and (M-4) are preferred.

With respect to the substituents on the azole ring containing $R_{101}$, $X_{11}$ and $Z_{11}$ of the general formula (M), the sum of carbon atoms thereof, although not particularly limited, is preferably in the range of 13 to 60, more preferably 20 to 50 from the viewpoint that not only can the adsorption on emulsion grains be increased but also the sensitivity/graininess improving effect can be enhanced.

(M-3)

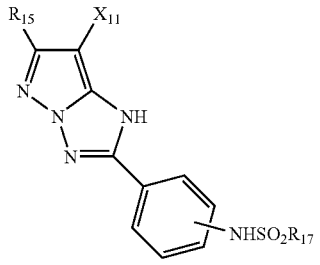

(M-4)

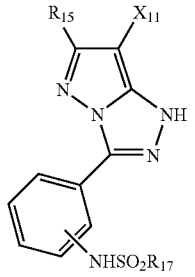

In the formulae, $R_{15}$ and $X_{11}$ are as defined in the general formulae (M-1) and (M-2). $R_{17}$ represents a substituent. As the substituents represented by $R_{17}$, there can preferably be mentioned those set forth above as examples of the $R_{15}$ substituents. As the $R_{17}$ substituents, there can more preferably be mentioned a substituted aryl group and a substituted or unsubstituted alkyl group. The substitution thereof is preferably accomplished by substituents mentioned above as examples of the $R_{15}$ substituents.

$X_{11}$ represents a hydrogen atom or a substituent. As the substituent, there can preferably be mentioned those set forth above as examples of the $R_{15}$ substituents. The substituent represented by $X_{11}$ is preferably an alkyl group, an alkoxycarbonyl group, a carbamoyl group or a group split off at the reaction with developing agent oxidation products. As this group, there can be mentioned, for example, a halogen atom (e.g., a fluorine atom, a chlorine atom or a bromine atom); an alkoxy group (e.g., ethoxy, methoxycarbonylmethoxy, carboxypropyloxy, methanesulfonylethoxy or perfluoropropoxy); an aryloxy group (e.g., 4-carboxyphenoxy, 4-(4-hydroxyphenylsulfonyl)phenoxy, 4-methanesulfonyl-3-carboxyphenoxy or 2-methanesulfonyl-4-acetylsulfamoylphenoxy); an acyloxy group (e.g., acetoxy or benzoyloxy); a sulfonyloxy group (e.g., methanesulfonyloxy or benzenesulfonyloxy); an acylamino group (e.g., heptafluorobutyrylamino); a sulfonamido group (e.g., methanesulfonamido); an alkoxycarbonyloxy group (e.g., ethoxycarbonyloxy); a carbamoyloxy group (e.g., diethylcarbamoyloxy, piperidinocarbonyloxy or morpholinocarbonyloxy); an alkylthio group (e.g., 2-carboxyethylthio); an arylthio group (e.g., 2-octyloxy-5-t-octylphenylthio or 2-(2,4-di-t-amylphenoxy)butyrylaminophenylthio); a heterocyclic thio group (e.g., 1-phenyltetrazolylthio or 2-benzimidazolylthio); a heterocyclic oxy group (e.g., 2-pyridyloxy or 5-nitro-2-pyridyloxy); a 5- or 6-membered nitrogenous heterocyclic group (e.g., 1-triazolyl, 1-imidazolyl, 1-pyrazolyl, 5-chloro-1-tetrazolyl, 1-benzotriazolyl, 2-phenylcarbamoyl-1-imidazolyl, 5,5-dimethylhydantoin-3-yl, 1-benzylhydantoin-3-yl, 5,5-dimethyloxazolidine-2,4-dion-3-yl or purine); or an azo group (e.g., 4-methoxyphenylazo or 4-pivaloylaminophenylazo).

The substituent represented by $X_{11}$ is preferably an alkyl group, an alkoxycarbonyl group, a carbamoyl group, a halogen atom, an alkoxy group, an aryloxy group, an alkyl- or arylthio group or a 5- or 6-membered nitrogenous heterocyclic group capable of bonding at a nitrogen atom with coupling activity. The substituent is more preferably an alkyl group, a carbamoyl group, a halogen atom, a substituted aryloxy group, a substituted arylthio group, an alkylthio group or a 1-pyrazolyl group.

The compounds of the above general formulae (M-1) and (M-2) preferably employed in the present invention may form a dimer or further polymer through $R_{11}$ or $R_{12}$, and may be bonded with a polymer chain. In the present invention, the general formula (M-1) is preferred, and the general formula (M-3) is more preferred.

Now, the general formula (C) will be described. The general formula (C) of the present invention can more specifically be any of the following general formulae (bc-3) to (bc-6).

(bc-3)

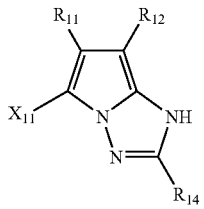

(bc-4)

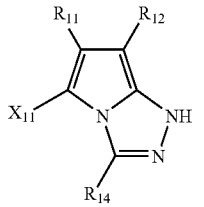

(bc-5)

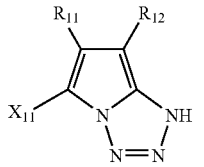

(bc-6)

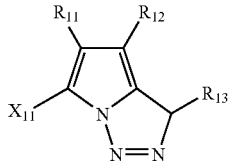

In the formulae, $R_{11}$ to $R_{14}$ and $X_{11}$ are as defined in the general formula (C).

In the present invention, the compounds of the general formulae (bc-3) and (bc-4) are preferred. The compounds of the general formula (bc-3) are more preferred.

In the general formula (C), the substituent represented by $R_{11}$, $R_{12}$ or $R_{13}$ is an electron withdrawing group whose Hammett substituent constant up value is in the range of 0.20 to 1.0. Preferably, the up value is in the range of 0.2 to 0.8. Hammett's rule is a rule of thumb advocated by L. P. Hammett in 1935 for quantitatively considering the effect of substituents on the reaction or equilibrium of benzene derivatives, and the appropriateness thereof is now widely recognized. The substituent constant determined in the Hammett's rule involves σp value and σm value. These values can be found in a multiplicity of general publications, and are detailed in, for example, "Lange's Handbook of Chemistry" 12th edition by J. A. Dean, 1979 (Mc Graw-Hill), "Kagaku no Ryoiki" special issue, no. 122, p.p. 96 to 103, 1979 (Nankodo), and Chemical Review, vol. 91, pp. 165–195, 1991.

Although in the present invention, the substituents $R_{11}$, $R_{12}$ and $R_{13}$ are limited by the Hammett substituent constant values, this should not be construed as limitation to only substituents whose values are known from literature and can be found in the above publications, and should naturally be construed as including substituents whose values, even if unknown from literature, would be included in stated ranges when measured according to the Hammett's rule.

Examples of the electron withdrawing groups whose σp values are in the range of 0.2 to 1.0 include an acyl group, an alkoxycarbonyl group, an aryloxycarbonyl group, a carbamoyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group and the like. Groups capable of having further substituents among these substituents may have further substituents as mentioned later with respect to $R_{14}$.

Each of $R_{11}$, $R_{12}$ and $R_{13}$ preferably represents an acyl group, an alkoxycarbonyl group, an aryloxycarbonyl group, a carbamoyl group, a cyano group or a sulfonyl group; and more preferably represents a cyano group, an acyl group, an alkoxycarbonyl group, an aryloxycarbonyl group or a carbamoyl group.

In a preferred combination of $R_{11}$ and $R_{12}$, $R_{11}$ represents a cyano group while $R_{12}$ represents an alkoxycarbonyl group.

$R_{14}$ represents a hydrogen atom or a substituent. This substituent can be any of the substituents mentioned above as being represented as $R_{15}$.

Preferred examples of the substituents represented by $R_{14}$ include an alkyl group, an aryl group, a heterocyclic group, an alkoxy group, an aryloxy group and an acylamino group. The substituent represented by $R_{14}$ is more preferably an alkyl group or a substituted aryl group, and most preferably a substituted aryl group. The substitution can be accomplished by any of those mentioned above.

$X_{11}$ has the same meaning as in the general formula (M).

Specific examples of compounds (H-3) will be shown below, which however in no way limit the scope of the present invention. Relevant C log P values will also be shown.

(D-1)

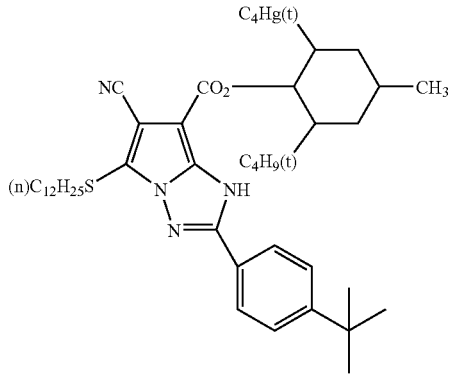

ClogP = 16.865

(D-2)

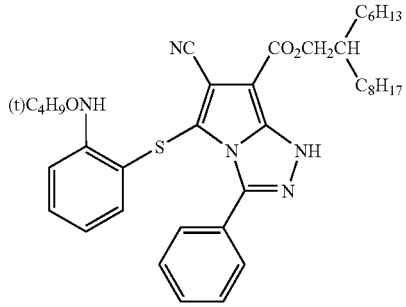

ClogP = 12.938

-continued (D-3)

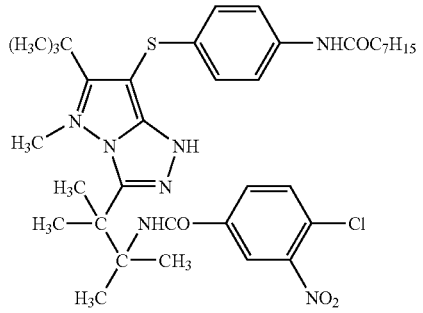

ClogP = 9.557

(D-4)

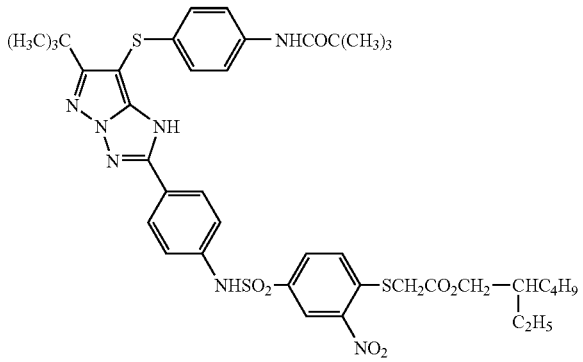

ClogP = 11.357

(D-5)

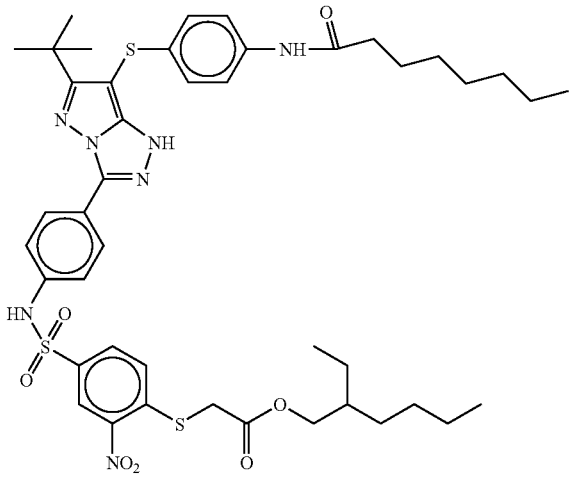

ClogP = 13.386

In addition to those shown above, the compounds (1) to (63), (70) to (80), (82), (83), (86) to (106) and (108) to (110) described in JP-A-2004-046061 can preferably be used.

The compounds of the present invention can be easily synthesized by the synthetic methods described in, for example, JP-A's-61-65245, 61-65246, 61-147254 and 8-122984.

Compounds (H-4) will be described in detail below.

As aforementioned, although as the heterocyclic compounds having three or more heteroatoms according to the present invention those which react with oxidizing developing agents are preferred, those which do not react with oxidizing developing agents can be used. These will be described below.

As the heterocycles thereof, there can be mentioned, for example, a triazole ring, an oxadiazole ring, a thiadiazole ring, a benzotriazole ring, a tetrazaindene ring, a pentazaindene ring, a purine ring, a tetrazole ring, a pyrazolotriazole ring and the like.

Representative examples of heterocycles will be listed below.

As examples of the 6/5 bicyclo heterocyclic compounds according to the present invention, there can be mentioned a tetrazaindene ring, a pentazaindene ring and a hexazaindene ring.

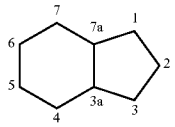

The position of nitrogen atom will be numbered in accordance with the above structures. Then, use can be made of, for example, 1,3,4,6- and 1,3,5,7- (these known as purines), 1,3,5,6-, 1,2,3a,5-, 1,2,3a,6-, 1,2,3a,7-, 1,3,3a,7-, 1,2,4,6-, 1,2,4,7-, 1,2,5,6- and 1,2,5,7-tetrazaindene rings. These compounds can also be expressed as derivatives of imidazo-, pyrazolo- or triazolopyrimidine ring, pyridazine ring and pyrazine ring. Further, use can be made of, for example, 1,2,3a,4,7-, 1,2,3a,5,7- and 1,3,3a,5,7-pentazaindene rings. Still further, use can be made of, for example, a 1,2,3a,4,6,7-hexazaindene ring. Preferably, use is made of 1,3,4,6-, 1,2,5,7-, 1,2,4,6-, 1,2,3a,7- and 1,3,3a,7-tetrazaindene rings.

Preferred examples thereof will be illustrated below.

(ca-1)

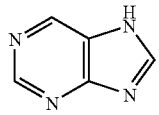

(ca-2)

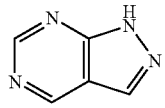

(ca-3)

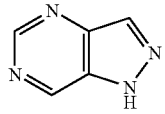

(ca-4)

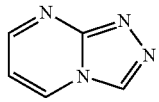

(ca-5)

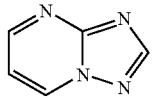

With respect to these tetrazaindene rings, pentazaindene rings and hexazaindene rings, it is preferred to avoid bonding of an ionizable substituent, such as hydroxyl, thiol, primary amino or secondary amino, to a ring atom so as to induce conjugation to ring nitrogen to thereby form a tautomer of heterocycle.

Furthermore, there can be mentioned the following heterocycles.

(ca-6)

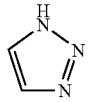

(ca-7)

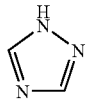

(ca-8)

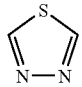

(ca-9)

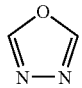

(ca-10)

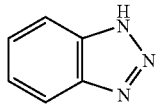

(ca-11)

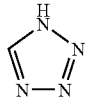

(ca-12)

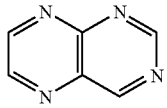

(ca-13)

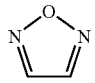

(ca-14)

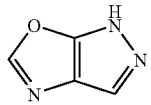

(ca-15)

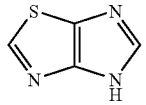

Although heterocycles resulting from partial or entire saturation of the above heterocycles can be used, it is preferred to employ those unsaturated as aforementioned.

These heterocycles, unless contrary to the definition of "heterocycle having three or more heteroatoms", may have any substituents or may be in the form of any condensed ring. As the substituents, there can be mentioned the aforementioned W. The tertiary nitrogen atom contained in heterocycles may be substituted into a quaternary nitrogen. Moreover, any other tautomeric structures which can be drawn with respect to heterocycles are chemically equivalent to each other.

With respect to the heterocycles of the present invention, it is preferred that free thiol (—SH) and thiocarbonyl (>C═S) be in unsubstituted form.

Among the above heterocycles, heterocycles (ca-1) to (ca-11) are preferred.

The heterocyclic compounds mentioned here are those which do not react with oxidizing developing agents. That is, heterocyclic compounds which induce no marked (less than 5 to 10%) direct chemical reaction or redox reaction with oxidizing developing agents are preferred. Further, those which are not couplers, being incapable of reacting with oxidizing developing agents to form dyes or other products are preferred.

Specific examples of the heterocyclic compounds (H-4) having three or more heteroatoms which do not react with oxidizing developing agents will be shown below, which however in no way limit the scope of the present invention. Relevant C log P values will also be shown.

(E-1)

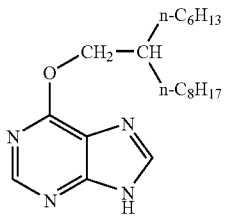

ClogP = 8.561

(E-2)

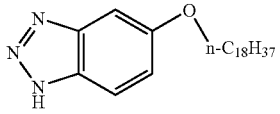

ClogP = 10.635

(E-3)

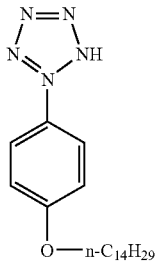

ClogP = 9.013

(E-4)

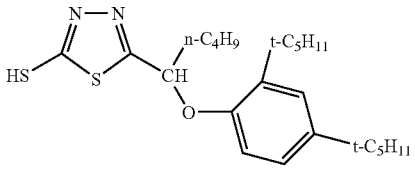

ClogP = 8.619

In addition to those shown above, the compounds (HET-1), (HET-2), (HET-4) to (HET-16), (HET-18) to (HET-22), (HET-24), (HET-25) and (HET-27) to (HET-43) described in JP-A-2003-156823 can preferably be used.

(F-1)

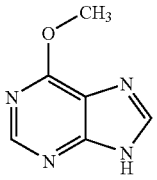

ClogP = 0.756

(F-2)

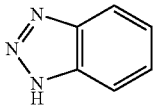

ClogP = 1.408

(F-3)

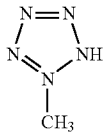

ClogP = 0.472

(F-4)

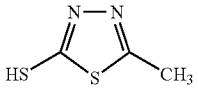

ClogP = 0.825

In addition to the above examples of compounds, compounds falling under the present invention described as examples in JP-A-2000-194085 can preferably be used as the compounds of the present invention.

As the compounds of the present invention, use can be made of compounds falling under the present invention among those described in, for example, "The Chemistry of Heterocyclic Compounds—A Series of Monographs" vol. 1–59, edited by Edward C. Taylor and Arnold Weissberger and published by John Wiley & Sons and "Heterocyclic Compounds" vol. 1–6, edited by Robert C. Elderfield and published by John Wiley & Sons. The compounds of the present invention can be synthesized by the processes described therein.

As substituents for the above compounds of the present invention, there can be selected any of those used by persons skilled in the art to which the present invention pertains for attaining desired photographic performance in specified usage. Such substituents include, for example, a hydrophobic group (ballasting group), a solubilizing group, a blocking group and a release or releasable group. With respect to these groups, generally, the number of carbon atoms thereof is preferably in the range of 1 to 60, more preferably 1 to 50.

For controlling the migration in photosensitive material, the compounds of the present invention in the molecules may contain a hydrophobic group or ballasting group of high molecular weight, or may contain a polymer main chain.

The number of carbon atoms of representative ballasting groups is preferably in the range of 8 to 60, more preferably 10 to 57, still more preferably 12 to 55, and most preferably 16 to 53. As these substituents, there can be mentioned substituted or unsubstituted alkyl, aryl and heterocyclic groups having 8 to 60, preferably 10 to 57, more preferably 13 to 55, still more preferably 16 to 53 and most preferably 20 to 50 carbon atoms. These preferably contain branches. Examples of representative substituents on these groups include alkyl, aryl, alkoxy, aryloxy, alkylthio, hydroxyl, halogen, alkoxycarbonyl, aryloxycarbonyl, carboxyl, acyl, acyloxy, amino, anilino, carbonamido, carbamoyl, alkylsulfonyl, arylsulfonyl, sulfonamido and sulfamoyl. These substituents generally each have 1 to 42 carbon atoms. For example, there can be mentioned the aforementioned W. These substituents may have further substituents.

The ballasting groups will be described in greater detail. Preferred examples thereof include an alkyl group (having 1 to 60 carbon atoms, such as methyl, ethyl, propyl, isobutyl, t-butyl, t-octyl, 1-ethylhexyl, nonyl, undecyl, pentadecyl, n-hexadecyl or 3-decanamidopropyl); an alkenyl group (having 2 to 60 carbon atoms, such as vinyl, allyl or oleyl); a cycloalkyl group (having 5 to 60 carbon atoms, such as cyclopentyl, cyclohexyl, 4-t-butylcyclohexyl, 1-indanyl or cyclododecyl); an aryl group (having 6 to 60 carbon atoms, such as phenyl, p-tolyl or naphthyl); an acylamino group (having 2 to 60 carbon atoms, such as acetylamino, n-butanamido, octanoylamino, 2-hexyldecanamido, 2-(2',4'-di-t-amylphenoxy)butanamido, benzoylamino or nicotinamido); a sulfonamido group (having 1 to 60 carbon atoms, such as methanesulfonamido, octanesulfonamido or benzenesulfonamido); a ureido group (having 2 to 60 carbon atoms, such as decylaminocarbonylamino or di-n-octylaminocarbonylamino); a urethane group (having 2 to 60 carbon atoms, such as dodecyloxycarbonylamino, phenoxycarbonylamino or 2-ethylhexyloxycarbonylamino); an alkoxy group (having 1 to 60 carbon atoms, such as methoxy, ethoxy, butoxy, n-octyloxy, hexadecyloxy or methoxyethoxy); an aryloxy group (having 6 to 60 carbon atoms, such as phenoxy, 2,4-di-t-amylphenoxy, 4-t-octylphenoxy or naphthoxy); an alkylthio group (having 1 to 60 carbon atoms, such as methylthio, ethylthio, butylthio or hexadecylthio); an arylthio group (having 6 to 60 carbon atoms, such as phenylthio or 4-dodecyloxyphenylthio); an acyl group (having 1 to 60 carbon atoms, such as acetyl, benzoyl, butanoyl or dodecanoyl); a sulfonyl group (having 1 to 60 carbon atoms, such as methanesulfonyl, butanesulfonyl or toluenesulfonyl); a cyano group; a carbamoyl group (having 1 to 60 carbon atoms, such as N,N-dicyclohexylcarbamoyl); a sulfamoyl group (having 0 to 60 carbon atoms, such as N,N-dimethylsulfamoyl); a hydroxyl group; a sulfo group; a carboxyl group; a nitro group; an alkylamino group (having 1 to 60 carbon atoms, such as methylamino, diethylamino, octylamino or octadecylamino); an arylamino group (having 6 to 60 carbon atoms, such as phenylamino, naphthylamino or N-methyl-N-phenylamino); a heterocyclic group (having 0 to 60 carbon atoms, preferably heterocyclic group wherein an atom selected from among a nitrogen atom, an oxygen atom and a sulfur atom is used as a heteroatom being a constituent of the ring, more preferably heterocyclic group wherein not only a heteroatom but also a carbon atom is used as constituent atoms of the ring, and especially heterocyclic group having a 3 to 8-, preferably 5 or 6-membered ring, such as groups listed above as being represented by W); or an acyloxy group (having 1 to 60 carbon atoms, such as formyloxy, acetyloxy, myristoyloxy or benzoyloxy).

Among these groups, the alkyl, cycloalkyl, aryl, acylamino, ureido, urethane, alkoxy, aryloxy, alkylthio, arylthio, acyl, sulfonyl, cyano, carbamoyl and sulfamoyl groups include those having substituents. Examples of such substituents include an alkyl group, a cycloalkyl group, an aryl group, an acylamino group, a ureido group, a urethane group, an alkoxy group, an aryloxy group, an alkylthio group, an arylthio group, an acyl group, a sulfonyl group, a cyano group, a carbamoyl group, a sulfamoyl group and a halogen atom.

Among these substituents, an alkyl group, an aryl group, an alkoxy group and an aryloxy group are preferred. An alkyl group, an alkoxy group and an aryloxy group are more preferred. The most preferred substituent is a branched alkyl group.

The total number of carbon atoms of these substituents, although not particularly limited, is preferably in the range of 8 to 60, more preferably 10 to 57, still more preferably 12 to 55, and most preferably 16 to 53.

In the incorporating of compounds of the present invention in a silver halide photosensitive material, preferred use may be made of a compound which can be immobilized in specified layer during storage but diffuses at appropriate time (preferably development processing) of photograph processing. Although any compounds and methods can be used for preventing the diffusion of the compounds of the present invention and immobilizing the same during the storage, there can preferably be mentioned the following compounds and methods.

(1) Method wherein a compound of specified pKa value together with a high-boiling organic solvent described later, etc. is emulsified and added so that the compound of the present invention is dissociated and dissolved out from oil only during development.

The pKa value of the compounds of the present invention is preferably 5.5 or higher, more preferably from 6.0 to 10.0, still more preferably 6.5 to 8.4, and most preferably 6.9 to 8.3.

The dissociative group, although not particularly limited, can preferably be selected from among carboxyl, —$CONHSO_2$— (sulfonylcarbamoyl or carbonylsulfamoyl), —CONHCO— (carbonylcarbamoyl), —$SO_2NHSO_2$— (sulfonylsulfamoyl), sulfonamido, sulfamoyl and phenolic hydroxyl. Of these, carboxyl, —$CONHSO_2$—, —CONHCO— and —$SO_2NHSO_2$— are more preferred. Carboxyl and —$CONHSO_2$— are most preferred.

(2) Method wherein a ballasting group is introduced in the compounds of the present invention to thereby cause them to be resistant to diffusion.

(3) Method wherein a blocking group is used. Use can be made of compounds whose properties are changed (for example, becoming diffusive) by chemical reactions, such as nucleophilic reaction, electrophilic reaction, oxidation reaction and reduction reaction, during the photographic processing, and, relating to these, chemistry and any techniques publicly known in the photographic field can be utilized.

By way of example, the nucleophilic reaction will be described in detail below. The nucleophilic reaction, although can be induced in arbitrary conditions, is accelerated by bases or heating, especially in the presence of bases. The bases, although not particularly limited, can be selected from among inorganic bases and organic bases. For example, there can be mentioned a tertiary amine such as triethylamine, an aromatic heterocyclic amine such as pyridine and a base having OH anion such as sodium hydroxide or potassium hydroxide. In particular, in the present invention, the nucleophilic reaction is accelerated by high-pH photographic processing, such as developer processing, among the photographic processings, and thus can preferably be employed.

Herein, the nucleophilic agent refers to chemical species having properties to attack atoms of low electron density, such as carbonyl carbon, contained in an atomic group which forms a group split off upon being attacked by the nucleophilic agent, thereby donating or sharing electrons. Although the structure of the nucleophilic agent is not particularly limited, as preferred examples thereof there can be mentioned a hydroxide ion donating reagent (e.g., sodium hydroxide, potassium hydroxide, lithium hydroxide, sodium carbonate or potassium carbonate), a sulfite ion donating reagent (e.g., sodium sulfite or potassium sulfite), a hydroxylamido ion donating reagent (e.g., hydroxyamine), a hydrazido ion donating reagent (e.g., hydrazine hydrate or dialkylhydrazine compound), a hexacyanoiron (II) acid ion donating reagent (e.g., yellow prussiate of potash) and a cyanide ion, tin (II) ion, ammonia ion or alkoxy ion donating reagent (e.g., sodium methoxide). As the group split off as a result of attack by nucleophilic agents, there can be mentioned a group utilizing reverse Michael reaction described in Can. J. Chem. vol. 44, page 2315 (1966) and JP-A's-59-137945 and 60-41034, a group utilizing nucleophilic reaction described in Chem. Lett. page 585 (1988), JP-A-59-218439 and Jpn. Pat. Appln. KOKOKU Publication No. (hereinafter referred to as JP-B)-5-78025, a group utilizing ester bond or amido bond hydrolyzing reaction, etc.

For imparting the above functions, the compounds of the present invention may be substituted with a block group capable of releasing compounds of the present invention during the photographic processing. As the block group, there can be employed known block groups, which include block groups such as acyl and sulfonyl groups as described in, for example, JP-B-48-9968, JP-A's-52-8828 and 57-82834, U.S. Pat. No. 3,311,476 and JP-B-47-44805 (U.S. Pat. No. 3,615,617); block groups utilizing the reverse Michael reaction as described in, for example, JP-B-55-17369 (U.S. Pat. No. 3,888,677), JP-B-55-9696 (U.S. Pat. No. 3,791,830), JP-B-55-34927 (U.S. Pat. No. 4,009,029), JP-A-56-77842 (U.S. Pat. No. 4,307,175) and JP-A's-59-105640, 59-105641 and 59-105642; block groups utilizing the formation of a quinone methide or quinone methide homologue through intramolecular electron transfer as described in, for example, JP-B-54-39727, U.S. Pat. Nos. 3,674,478, 3,932,480 and 3,993,661, JP-A-57-135944, JP-A-57-135945 (U.S. Pat. No. 4,420,554), JP-A's-57-136640 and 61-196239, JP-A-61-196240 (U.S. Pat. No. 4,702,999), JP-A-61-185743, JP-A-61-124941 (U.S. Pat. No. 4,639,408) and JP-A-2-280140; block groups utilizing an intramolecular nucleophilic substitution reaction as described in, for example, U.S. Pat. Nos. 4,358,525 and 4,330,617, JP-A-55-53330 (U.S. Pat. No. 4,310,612), JP-A's-59-121328 and 59-218439 and JP-A-63-318555 (EP 0295729); block groups utilizing a ring cleavage reaction of 5- or 6-membered ring as described in, for example, JP-A-57-76541 (U.S. Pat. No. 4,335,200), JP-A-57-135949 (U.S. Pat. No. 4,350,752), JP-A's-57-179842, 59-137945, 59-140445, 59-219741 and 59-202459, JP-A-60-41034 (U.S. Pat. No. 4,618,563), JP-A-62-59945 (U.S. Pat. No. 4,888,268), JP-A-62-65039 (U.S. Pat. No. 4,772,537), and JP-A's 62-80647, 3-236047 and 3-238445; block groups utilizing a reaction of addition of nucleophilic agent to conjugated unsaturated bond as described in, for example, JP-A's-59-201057 (U.S. Pat. No. 4,518,685), 61-43739 (U.S. Pat. No. 4,659,651), 61-95346 (U.S. Pat. No. 4,690,885), 61-95347 (U.S. Pat. No. 4,892,811), 64-7035, 4-42650 (U.S. Pat. No. 5,066,573), 1-245255, 2-207249, 2-235055 (U.S. Pat. No. 5,118,596) and 4-186344; block groups utilizing a β-elimination reaction as described in, for example, JP-A's-59-93442, 61-32839 and 62-163051 and JP-B-5-37299; block groups utilizing a nucleophilic substitution reaction of diarylmethanes as described in JP-A-61-188540; block groups utilizing Lossen rearrangement reaction as described in JP-A-62-187850; block groups utilizing a reaction between an N-acyl derivative of thiazolidine-2-thione and an amine as described in, for example, JP-A's-

62-80646, 62-144163 and 62-147457; block groups having two electrophilic groups and capable of reacting with a binucleophilic agent as described in, for example, JP-A's-2-296240 (U.S. Pat. No. 5,019,492), 4-177243, 4-177244, 4-177245, 4-177246, 4-177247, 4-177248, 4-177249, 4-179948, 4-184337 and 4-184338, WO 92/21064, JP-A-4-330438, WO 93/03419 and JP-A-5-45816; and block groups of JP-A's-3-236047 and 3-238445. Of these block groups, block groups having two electrophilic groups and capable of reacting with a binucleophilic agent as described in, for example, JP-A's-2-296240 (U.S. Pat. No. 5,019,492), 4-177243, 4-177244, 4-177245, 4-177246, 4-177247, 4-177248, 4-177249, 4-179948, 4-184337 and 4-184338, WO 92/21064, JP-A-4-330438, WO 93/03419 and JP-A-5-45816 are especially preferred. Moreover, these block groups may be those containing timing groups capable of inducing cleavage reaction with the use of electron transfer reaction as described in U.S. Pat. Nos. 4,409,323 and 4,421,845. With respect to such groups, it is preferred that timing group terminals inducing electron transfer reaction be blocked.

(4) Method wherein use is made of a dimer, trimer or higher polymer compound containing partial structure of compounds of the present invention.

(5) Method wherein immobilization is effected by the use of water-insoluble compounds of the present invention (solid dispersions). As mentioned with respect to method (1), compounds of the present invention exhibiting specified pKa values are preferred from the viewpoint that they are dissolved only at the stage of development. Examples of uses of water-insoluble dye solids (solid dispersions) are disclosed in JP-A's-56-12639, 55-155350, 55-155351, 63-27838 and 63-197943, EP 15601, etc.

Particular methods for solid dispersion will be specified later.

(6) Method wherein compounds of the present invention are immobilized by coexistence of a polymer having an electric charge counter to that thereof as a mordant. Examples of dye immobilizations are disclosed in U.S. Pat. Nos. 2,548,564, 4,124,386 and 3,625,694, etc.

(7) Method wherein compounds of the present invention are immobilized by effecting adsorption thereof on metal salts such as silver halides. Examples of dye immobilizations are disclosed in U.S. Pat. Nos. 2,719,088, 2,496,841 and 2,496,843, JP-A-60-45237, etc.

As representative examples of adsorptive groups on silver halides which can be used in compounds of the present invention, there can be mentioned groups described in JP-A-2003-156823, page 16 right column line 1 to page 17 right column line 12.

As preferred adsorptive groups, there can be mentioned a mercapto-substituted nitrogenous heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazoium-3-thiolate group) and a nitrogenous heterocyclic group capable of forming an iminosilver (>NAg) and having —NH— as a partial structure of heterocycle (e.g., benzotriazole group, benzimidazole group or indazole group). Among these, a 5-mercaptotetrazole group, a 3-mercapto-1,2,4-triazole group and a benzotriazole group are more preferred. A 3-mercapto-1,2,4-triazole group and a 5-mercaptotetrazole group are most preferred.

An adsorptive group having two or more mercapto groups as a partial structure in the molecule is also especially preferred. The mercapto group (—SH) when tautomerizable may be in the form of a thione group. As preferred examples of adsorptive groups each having two or more mercapto groups as a partial structure (e.g., dimercapto-substituted nitrogenous heterocyclic groups), there can be mentioned a 2,4-dimercaptopyrimidine group, a 2,4-dimercaptotriazine group and a 3,5-dimercapto-1,2,4-triazole group.

Moreover, a quaternary salt structure of nitrogen or phosphorus can preferably be used as the adsorptive group. As the quaternary salt structure of nitrogen, there can be mentioned, for example, an ammonio group (such as trialkylammonio, dialkylaryl(heteroaryl)ammonio or alkyldiaryl(heteroaryl)ammonio) or a group containing a nitrogenous heterocyclic group containing a quaternarized nitrogen atom. As the quaternary salt structure of phosphorus, there can be mentioned, a phosphonio group (such as trialkylphosphonio, dialkylaryl(heteroaryl)phosphonio, alkyldiaryl(heteroaryl)phosphonio or triaryl(heteroaryl)phosphonio). Among these, the quaternary salt structure of nitrogen is more preferred. The 5- or 6-membered nitrogenous aromatic heterocyclic group containing a quaternarized nitrogen atom is still more preferred. A pyridinio group, a quinolinio group and an isoquinolinio group are most preferred. The above nitrogenous heterocyclic group containing a quaternarized nitrogen atom may have any arbitrary substituent.

As examples of counter anions to the quaternary salts, there can be mentioned a halide ion, a carboxylate ion, a sulfonate ion, a sulfate ion, a perchlorate ion, a carbonate ion, a nitrate ion, $BF_4^-$, $PF_6^-$ and $Ph_4^-$. When in the molecule a group with negative charge is had by carboxylate, etc., an intramolecular salt may be formed therewith. A chloro ion, a bromo ion or a methanesulfonate ion is most preferred as a counter anion not present in the molecule.

Among the above methods for immobilizing compounds of the present invention, there can preferably be employed the method of using a compound of specified pKa (1), the method of using a compound having a ballasting group (2), the method of using a compound having a blocking group (3) and the method of using a solid dispersion (5). It is preferred to employ compounds suitable for the methods. Using the method (1), (2) or (3) together with suitable compounds is more preferred. Using the method (1) or (2) together with suitable compounds is still more preferred. Simultaneously using the methods (1) and (2) is most preferred. That is, compounds simultaneously having specified pKa and ballasting group according to the present invention can most preferably be employed.

The compounds of the present invention, when required for neutralizing the charges thereof, can contain a required number of required cations or anions. As representative cations, there can be mentioned inorganic cations such as proton ($H^+$), alkali metal ions (e.g., sodium ion, potassium ion and lithium ion) and alkaline earth metal ions (e.g., calcium ion); and organic ions such as ammonium ions (e.g., ammonium ion, tetraalkylammonium ion, triethylammonium ion, pyridinium ion, ethylpyridinium ion and 1,8-diazabicyclo[5,4,0]-7-undecenium ion). The anions can be inorganic anions or organic anions. As such, there can be mentioned halide anions (e.g., fluoride ion, chloride ion and iodide ion), substituted arylsulfonate ions (e.g., p-toluenesulfonate ion and p-chlorobenzenesulfonate ion), aryldisulfonate ions (e.g., 1,3-benzenedisulfonate ion, 1,5-naphthalenedisulfonate ion and 2,6-naphthalenedisulfonate ion), alkylsulfate ions (e.g., methylsulfate ion), sulfate ion, thiocyanate ion, perchlorate ion, tetrafluoroborate ion, picrate ion, acetate ion and trifluoromethanesulfonate ion. Further, use can be made of ionic polymers and other dyes having charges opposite to those of dyes. $CO_2^-$ and $SO_3^-$, when having a proton as a counter ion, can be indicated as $CO_2H$ and $SO_3H$, respectively.

It is preferred to use combinations of aforementioned individual preferred compounds (especially combinations of individual most preferred compounds) as the compound of the present invention.

When compounds of the present invention each have two or more asymmetric carbon atoms in the molecule, there are multiple stereoisomers per any particular structure. This description involves all possible stereoisomers. In the present invention, use can be made of any one of multiple stereoisomers, or some thereof in the form of a mixture.

With respect to the compounds of the present invention, any one thereof can be used, or two or more can be used in combination. The number and type of compounds for use can be arbitrarily selected.

Further, the compounds of the present invention may be used in combination with compounds each having at least three heteroatoms as described in JP-A's-2000-194085 and 2003-156823.

The compounds of the present invention can be used in combination with one or more arbitrary methods capable of exerting sensitivity enhancing effects or compounds capable of exerting sensitivity enhancing effects. The number and type of employed methods and contained compounds can be arbitrarily selected.

In the present invention, as long as the compounds of the present invention can be applied to a silver halide photosensitive sensitive material (preferably a silver halide color photosensitive material), the addition site therefor, etc. are not particularly limited, and the compounds may be added to any of silver halide photosensitive layer and nonsensitive layer.

In the use in a silver halide photosensitive layer consisting of multiple layers of different speeds, although the addition may be effected to any of these layers, it is preferred that the compounds be incorporated in the layer of highest speed.

In the use in nonsensitive layer, the compounds are preferably incorporated in a nonsensitive layer disposed between a red-sensitive layer and a green-sensitive layer or between a green-sensitive layer and a blue-sensitive layer. The nonsensitive layer refers to any of all layers other than the silver halide emulsion layers which include an antihalation layer, an interlayer, a yellow filter layer and a protective layer.

The compound of less than 4.5 C log P and compound of 4.5 or greater C log P according to the present invention can be simultaneously used in any single layer, or can be added to different layers.

When the compound of the present invention is one with water solubility diffusibility, the compound can preferably be added to nonphotosensitive layers such as a protective layer and diffused into emulsion layers so as to exert an effect of sensitivity enhancement. This is preferred from the viewpoint that as compared with the addition to photosensitive layers, any adverse effect of fog caused by, for example, aging during coating liquid production, etc. on silver halide emulsions can be avoided.

As preferred methods of addition layer combinations, there can be mentioned, for example, the method in which a compound of less than 4.5 C log P and a compound of 4.5 or greater C log P are added to an emulsion layer and the method in which a compound of less than 4.5 C log P is added to a nonphotosensitive layer while a compound of 4.5 or greater C log P is added to an emulsion layer.

The method of incorporating the compounds of the present invention in a photosensitive material, although not particularly limited, can be selected from among, for example, the method of adding through emulsification dispersion of the compounds together with a high boiling organic solvent or the like, the method of adding through solid dispersion, the method of adding the compounds in solution form to a coating liquid (for example, dissolving the compounds in water, an organic solvent such as methanol or a mixed solvent before addition) and the method of adding during the preparation of silver halide emulsion. Among these, when the compounds of the present invention may be immobilized, the method of incorporating in a photosensitive material through emulsification dispersion or solid dispersion is preferred. The method of incorporating in a photosensitive material through emulsification dispersion is more preferred.

When the compound of the present invention is one with water solubility, it can preferably be added to the light-sensitive material with an aqueous water thereof, while when the compound of the present invention is one with oil solubility, it can preferably be added to the light-sensitive material by the emulsification dispersion method.

As the emulsification dispersion method, use can be made of the in-water oil droplet dispersing method wherein the compounds are dissolved in a high-boiling organic solvent (optionally in combination with a low-boiling organic solvent), emulsified and dispersed in an aqueous solution of gelatin and added to a silver halide emulsion.

Examples of the high-boiling organic solvents for use in the in-water oil droplet dispersing method are listed in, for example, U.S. Pat. No. 2,322,027. Particulars of a latex dispersing method as one of polymer dispersing methods are described in, for example, U.S. Pat. No. 4,199,363, DE (OLS) 2,541,274, JP-B-53-41091 and EP's 0,727,703 and 0,727,704. Further, a method of dispersion by an organic solvent soluble polymer is described in WO 88/00723.

Examples of the high-boiling organic solvents which can be employed in the above in-water oil droplet dispersing method include phthalic acid esters (e.g., dibutyl phthalate, dioctyl phthalate and di-2-ethylhexyl phthalate), esters of phosphoric acid or phosphonic acid (e.g., triphenyl phosphate, tricresyl phosphate and tri-2-ethylhexyl phosphate), fatty acid esters (e.g., di-2-ethylhexyl succinate and tributyl citrate), benzoic acid esters (e.g., 2-ethylhexyl benzoate and dodecyl benzoate), amides (e.g., N,N-diethyldodecanamide and N,N-dimethyloleamide, alcohols or phenols (e.g., isostearyl alcohol and 2,4-di-tert-amylphenol), anilines (e.g., N,N-dibutyl-2-butoxy-5-tert-octylaniline), chlorinated paraffins, hydrocarbons (e.g., dodecylbenzene and diisopropylnaphthalene) and carboxylic acids (e.g., 2-(2,4-di-tert-amylphenoxy)butyric acid). Further, as an auxiliary solvent, an organic solvent having a boiling point of 30 to 160° C. (e.g., ethyl acetate, butyl acetate, methyl ethyl ketone, cyclohexanone, methyl cellosolve acetate or dimethylformamide) may be used in combination therewith. The high-boiling organic solvents are preferably used in a mass ratio to compounds of the present invention of 0 to 10, more preferably 0 to 4.

The whole or portion of the auxiliary solvent can be removed from the emulsified dispersion by vacuum distillation, noodle washing, ultrafiltration or other appropriate means according to necessity from the viewpoint of enhancing of aging stability during storage in the state of emulsified dispersion and inhibiting of photographic property change and enhancing of aging stability with respect to a final coating composition after emulsion mixing.

The average particle size of thus obtained lipophilic fine particle dispersion is preferably in the range of 0.04 to 0.50 μm, more preferably 0.05 to 0.30 μm and most preferably 0.08 to 0.20 μm. The average particle size can be measured by the use of, for example, Coulter submicron particle analyzer model N4 (trade name, manufactured by Coulter Electronic).

As means for solid fine particle dispersion, there can be mentioned the method wherein powdery compounds of the present invention are dispersed in an appropriate solvent such as water with the use of a ball mill, a colloid mill, a vibration ball mill, a sand mill, a jet mill, a roller mill or ultrasonic so as to obtain a solid dispersion. During the dispersing, use can be made of a protective colloid (e.g., polyvinyl alcohol) or a surfactant (e.g., anionic surfactant such as sodium triisopropylbutanesulfonate (mixture of those whose three isopropyl substitution sites are different from each other)). In the above mills, beads such as those of zirconia are generally used as dispersing media. Thus, Zr, etc. leached from the beads may be mixed in the dispersion. The amount thereof is generally in the range of 1 to 1000 ppm although depending on dispersing conditions. When the content of Zr in photosensitive material is 0.5 mg or less per g of silver, there would occur practically no adverse effect. The water dispersion can be doped with an antiseptic (e.g., benzoisothiazolinone sodium salt).

In the present invention, in order to obtain a coagulation-free solid dispersion of high S/N and small grain size, use can be made of the dispersing method wherein a water dispersion liquid is converted to a high-velocity stream and thereafter a pressure drop is effected. The solid dispersing apparatus and technology employed for carrying out this dispersing method are described in detail in, for example, "Dispersion Rheology and Dispersing Technology" written by Toshio Kajiuchi and Hiroki Usui, pp. 357–403, Shinzansha Shuppan (1991) and "Progress of Chemical Engineering, 24th Series" edited by the corporate juridical person Society of Chemical Engineering, Tokai Chapter, pp. 184–185, Maki Shoten (1990).

The addition amount of compounds of the present invention is not limited as long as being capable of enhancing the sensitivity of the silver halide color photosensitive material when added, as compared with that exhibited when not added. In the present invention, "the sensitivity enhancement" is defined as an increase of $S_{0.2}$ is 0.02 or greater. $S_{0.2}$ means the logarithm of inverse number of exposure intensity realizing a density of fog+0.2 in the light-sensitive material developed by the method described in example 1 of this specification. Accordingly, the sensitivity enhancement means that the $S_{0.2}$ value increases 0.02 or greater when the compound of the present invention is added, as compared with that exhibited when not added. The addition amount of compounds of the present invention is preferably in the range of 0.1 to 1000 mg/m$^2$, more preferably 1 to 500 mg/m$^2$ and most preferably 5 to 100 mg/m$^2$. In the use in photosensitive silver halide emulsion layers, the addition amount is preferably in the range of $1\times10^{-5}$ to 1 mol, more preferably $1\times10^{-4}$ to $1\times10^{-1}$ mol and most preferably $1\times10^{-3}$ to $5\times10^{-2}$ mol per mol of silver contained in the same layer. Two or more compounds of the present invention may be used in combination. These compounds may be incorporated in the same layer or separate layers.

The pKa values of compounds of the present invention are those determined in the following manner. 0.5 milliliter (hereinafter also expressed as "mL") of 1 N sodium chloride is added to 100 mL of a solution dissolving 0.01 mmol of compound of the present invention in a 6:4 (mass ratio) mixture of tetrahydrofuran and water, and titrated with a 0.5 N aqueous potassium hydroxide solution under agitation in a nitrogen gas atmosphere. The pKa refers to the pH at the central position of inflexion point of titration curve having an axis of abscissas indicating the amount of aqueous potassium hydroxide solution dropped and an axis of ordinate indicating pH values. With respect to compounds having multiple dissociation sites, multiple inflexion points exist and multiple pKa values can be determined. Also, the inflexion point can be determined by monitoring ultraviolet/visible light absorption spectra and checking absorption changes.

Generally, the photographic speed depends on the size of silver halide emulsion grains. The larger the emulsion grains, the higher the photographic speed. However, the graininess is deteriorated in accordance with an increase of the size of silver halide grains. Therefore, the speed and the graininess fall in trade-off relationship.

The speed increase can be accomplished by the method of increasing coupler activity or the method of decreasing the amount of development inhibitor release coupler (DIR coupler) as well as the above increasing of the size of silver halide emulsion grains. However, when the speed increase is effected by these methods, graininess deterioration accompanies the same. These methods of changing of the size of emulsion grains, regulation of coupler activity and regulation of the amount of DIR coupler, in speed/graininess trade-off relationship, provide only "regulatory means" for deteriorating graininess while increasing speed, or improving graininess while lowering speed.

In the present invention, it is not intended to provide a method of speed increase accompanied by graininess deterioration matching the speed increase.

According to the present invention, there is provided a method of speed increase not accompanied by graininess deterioration, or a method of speed increase wherein the speed increase is conspicuous as compared with graininess deterioration. In the present invention, when speed increase and graininess deterioration simultaneously occur, speed comparison is effected after graininess matching conducted by the above "regulatory means" to thereby find a substantial speed increase.

It is preferred that the photosensitive material of the present invention contain "a compound which undergoes a one-electron oxidation so as to form a one-electron oxidation product capable of releasing one or more electrons".

This compound is preferably selected from among the following compounds of type 1 and type 2.

(Type 1)

Compound which undergoes a one-electron oxidation so as to form a one-electron oxidation product capable of, through subsequent bond cleavage reaction, releasing one or more electrons.

(Type 2)

Compound which undergoes a one-electron oxidation so as to form a one-electron oxidation product capable of, after subsequent bond formation reaction, releasing one or more electrons.

First, the compound of type 1 will be described.

With respect to the compound of type 1, as the compound which undergoes a one-electron oxidation so as to form a one-electron oxidation product capable of, through subsequent bond cleavage reaction, releasing one electron, there can be mentioned compounds referred to as "one photon two electrons sensitizers" or "deprotonating electron donating sensitizers", as described in, for example, JP-A-9-211769

(examples: compounds PMT-1 to S-37 listed in Tables E and F on pages 28 to 32), JP-A-9-211774, JP-A-11-95355 (examples: compounds INV 1 to 36), PCT Japanese Translation Publication 2001-500996 (examples: compounds 1 to 74, 80 to 87 and 92 to 122), U.S. Pat. Nos. 5,747,235 and 5,747,236, EP 786692A1 (examples: compounds INV 1 to 35), EP 893732A1 and U.S. Pat. Nos. 6,054,260 and 5,994,051. Preferred ranges of these compounds are the same as described in the cited patent specifications.

With respect to the compound of type 1, as the compound which undergoes a one-electron oxidation so as to form a one-electron oxidation product capable of, through subsequent bond cleavage reaction, releasing one or more electrons, there can be mentioned compounds of the general formula (1) (identical with the general formula (1) described in JP-A-2003-114487), the general formula (2) (identical with the general formula (2) described in JP-A-2003-114487), the general formula (3) (identical with the general formula (3) described in JP-A-2003-114487), the general formula (3) (identical with the general formula (1) described in JP-A-2003-114488), the general formula (4) (identical with the general formula (2) described in JP-A-2003-114488), the general formula (5) (identical with the general formula (3) described in JP-A-2003-114488), the general formula (6) (identical with the general formula (1) described in JP-A-2003-75950), the general formula (8) (identical with the general formula (1) described in JP-A-2004-239943) and the general formula (9) (identical with the general formula (3) described in JP-A-2004-245929) among the compounds of inducing the reaction represented by the chemical reaction formula (1) (identical with the chemical reaction formula (1) described in JP-A-2004-245929). Preferred ranges of these compounds are the same as described in the cited patent specifications.

General formula (1)

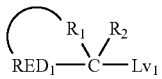

General formula (2)

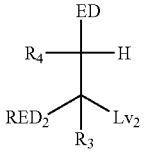

In the general formulae (1) and (2), each of $RED_1$ and $RED_2$ represents a reducing group. $R_1$ represents a nonmetallic atom group capable of forming a cyclic structure corresponding to a tetrahydro form or hexahydro form of 5-membered or 6-membered aromatic ring (including aromatic heterocycle) in cooperation with carbon atom (C) and $RED_1$. Each of $R_2$, $R_3$ and $R_4$ represents a hydrogen atom or a substituent. Each of $L_{v1}$ and $L_{v2}$ represents a split off group.

ED represents an electron donating group.

General formula (3)

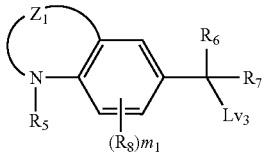

-continued

General formula (4)

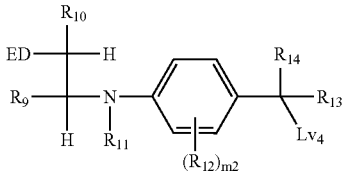

General formula (5)

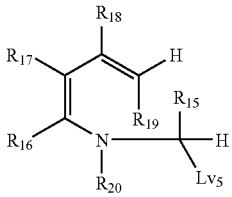

In the general formulae (3), (4) and (5), $Z_1$ represents an atomic group capable of forming a 6-membered ring in cooperation with a nitrogen atom and two carbon atoms of benzene ring. Each of $R_5$, $R_6$, $R_7$, $R_9$, $R_{10}$, $R_{11}$, $R_{13}$, $R_{14}$, $R_{15}$, $R_{16}$, $R_{17}$, $R_{18}$ and $R_{19}$ represents a hydrogen atom or a substituent. $R_{20}$ represents a hydrogen atom or a substituent, provided that when $R_{20}$ represents a non-aryl group, $R_{16}$ and $R_{17}$ are bonded to each other to thereby form an aromatic ring or aromatic heterocycle. Each of $R_8$ and $R_{12}$ represents a substituent capable of substitution on benzene ring. $m_1$ is an integer of 0 to 3. $m_2$ is an integer of 0 to 4. Each of $L_{v3}$, $L_{v4}$ and $L_{v5}$ represents a split off group.

General formula (6)

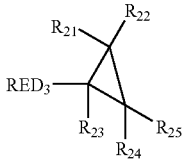

General formula (7)

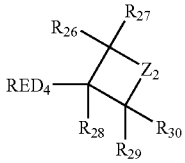

In the general formulae (6) and (7), each of $RED_3$ and $RED_4$ represents a reducing group. Each of $R_{21}$ to $R_{30}$ represents a hydrogen atom or a substituent. $Z_2$ represents —$CR_{111}R_{112}$—, —$NR_{113}$— or —O—. Each of $R_{111}$ and $R_{112}$ independently represents a hydrogen atom or a substituent. $R_{113}$ represents a hydrogen atom, an alkyl group, an aryl group or a heterocyclic group.

General formula (8)

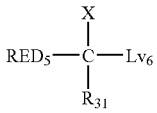

In the general formula (8), $RED_5$ is a reducing group, representing an arylamino group or a heterocyclic amino group. $R_{31}$ represents a hydrogen atom or a substituent. X represents an alkoxy group, an aryloxy group, a heterocyclic oxy group, an alkylthio group, an arylthio group, a heterocyclic thio group, an alkylamino group, an arylamino group or a heterocyclic amino group. $L_{v6}$ is a split off group, representing carboxyl or its salt or a hydrogen atom.

Chemical reaction formula (1)

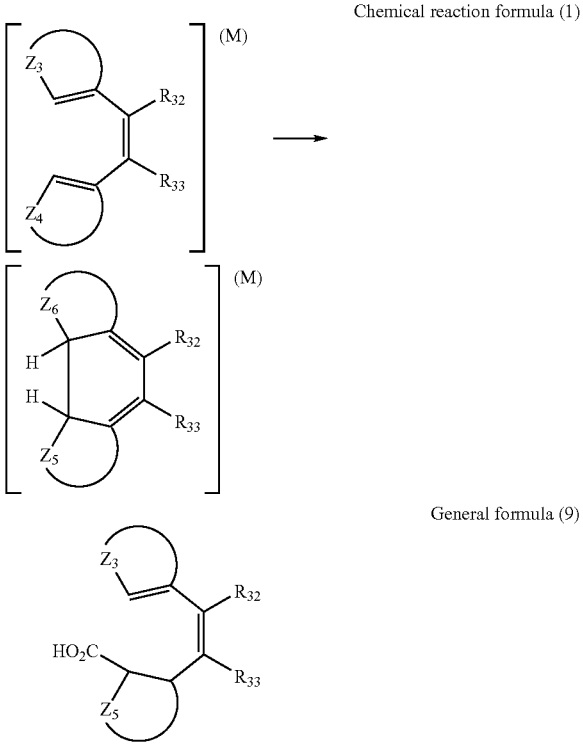

General formula (9)

The compound represented by the general formula (9) is one which undergoes a two-electron oxidation accompanied by decarbonation and is further oxidized to thereby effect a bond forming reaction of chemical reaction formula (1). In the chemical reaction formula (1), each of $R_{32}$ and $R_{33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. M represents a radical, a radical cation or a cation. In the general formula (9), $R_{32}$, $R_{33}$ and $Z_3$ have the same meaning as in the chemical reaction formula (1). Each of $Z_5$ and $Z_6$ represents a group capable of forming a 5- or 6-membered cycloaliphatic hydrocarbon group or heterocyclic ring in cooperation with C—C.

Now, the compounds of type 2 will be described.

As the compounds of type 2, namely, compounds which undergo a one-electron oxidation so as to form a one-electron oxidation product capable of, through subsequent bond formation reaction, releasing one or more electrons, there can be mentioned compounds of the general formula (10) (identical with the general formula (1) described in JP-A-2003-140287) and compounds of the general formula (11) (identical with the general formula (2) described in JP-A-2004-245929) capable of inducing the reaction represented by the chemical reaction formula (1) (identical with the chemical reaction formula (1) described in JP-A-2004-245929). Preferred ranges of these compounds are the same as described in the cited patent specifications.

$RED_6$-Q-Y General formula (10)

In the general formula (10), $RED_6$ represents a reducing group which undergoes a one-electron oxidation. Y represents a reactive group containing carbon to carbon double bond moiety, carbon to carbon triple bond moiety, aromatic group moiety or nonaromatic heterocyclic moiety of benzo condensation ring capable of reacting with a one-electron oxidation product formed by a one-electron oxidation of $RED_6$ to thereby form a new bond. Q represents a linking group capable of linking $RED_6$ with Y.

Chemical reaction formula (1)

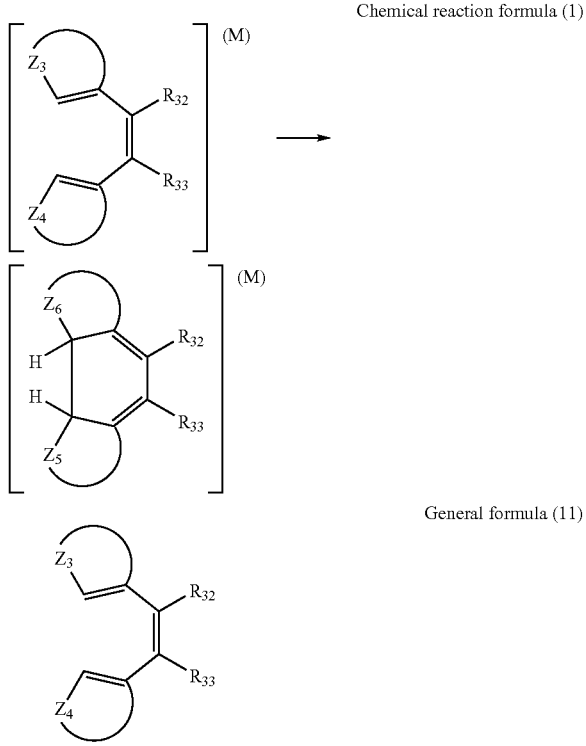

General formula (11)

The compound represented by the general formula (11) is one oxidized to thereby effect a bond forming reaction of chemical reaction formula (1). In the chemical reaction formula (1), each of $R_{32}$ and $R_{33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. Each of $Z_5$ and $Z_6$ represents a group capable of forming a 5- or 6-membered cycloaliphatic hydrocarbon group or heterocyclic ring in cooperation with C—C. M represents a radical, a radical cation or a cation. In the general formula (11), $R_{32}$, $R_{33}$, $Z_3$ and $Z_4$ have the same meaning as in the chemical reaction formula (1).

Among the compounds of types 1 and 2, "compounds having in the molecule an adsorptive group on silver halides" and "compounds having in the molecule a partial structure of spectral sensitizing dye" are preferred. As representative examples of adsorptive groups on silver halides, there can be mentioned groups described in JP-A-2003-156823, page 16 right column line 1 to page 17 right column line 12. The partial structure of spectral sensitizing dye is as described in the same reference, page 17 right column line 34 to page 18 left column line 6.

Among the compounds of types 1 and 2, "compounds having in the molecule at least one adsorptive group on silver halides" are more preferred. "Compounds having in the same molecule two or more adsorptive groups on silver halides" are still more preferred. When two or more adsorptive groups are present in a single molecule, they may be identical with or different from each other.

As preferred adsorptive groups, there can be mentioned a mercapto-substituted nitrogenous heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazoium-3-thiolate group) and a nitrogenous heterocyclic group capable of forming an iminosilver (>NAg) and having —NH— as a partial structure of heterocycle (e.g., benzotriazole group, benzimidazole group or indazole group). Among these, a 5-mercaptotetrazole group, a 3-mercapto-1,2,4-triazole group and a benzotriazole group are more preferred. A 3-mercapto-1,2,4-triazole group and a 5-mercaptotetrazole group are most preferred.

An adsorptive group having two or more mercapto groups as a partial structure in the molecule is also especially preferred. The mercapto group (—SH) when tautomerizable may be in the form of a thione group. As preferred examples of adsorptive groups each having two or more mercapto groups as a partial structure (e.g., dimercapto-substituted nitrogenous heterocyclic groups), there can be mentioned a 2,4-dimercaptopyrimidine group, a 2,4-dimercaptotriazine group and a 3,5-dimercapto-1,2,4-triazole group.

Moreover, a quaternary salt structure of nitrogen or phosphorus can preferably be used as the adsorptive group. As the quaternary salt structure of nitrogen, there can be mentioned, for example, an ammonio group (such as trialkylammonio, dialkylaryl(heteroaryl)ammonio or alkyldiaryl(heteroaryl)ammonio) or a group containing a nitrogenous heterocyclic group containing a quaternarized nitrogen atom. As the quaternary salt structure of phosphorus, there can be mentioned, a phosphonio group (such as trialkylphosphonio, dialkylaryl(heteroaryl)phosphonio, alkyldiaryl(heteroaryl)phosphonio or triaryl(heteroaryl)phosphonio). Among these, the quaternary salt structure of nitrogen is more preferred. The 5- or 6-membered nitrogenous aromatic heterocyclic group containing a quaternarized nitrogen atom is still more preferred. A pyridinio group, a quinolinio group and an isoquinolinio group are most preferred. The above nitrogenous heterocyclic group containing a quaternarized nitrogen atom may have any arbitrary substituent.

As examples of counter anions to the quaternary salts, there can be mentioned a halide ion, a carboxylate ion, a sulfonate ion, a sulfate ion, aperchlorate ion, a carbonate ion, a nitrate ion, $BF_4^-$, $PF_6^-$ and $Ph_4B^-$. When in the molecule a group with negative charge is had by carboxylate, etc., an intramolecular salt may be formed therewith. A chloro ion, a bromo ion or a methanesulfonate ion is most preferred as a counter anion not present in the molecule.

Among the compounds of types 1 and 2 having the structure of quaternary salt of nitrogen or phosphorus as the adsorptive group, preferred structures can be represented by the general formula (X).

$$(P\text{-}Q_1\text{-})_i\text{-}R(\text{-}Q_2\text{-}S)_j \qquad \text{General formula (X)}$$

In the general formula (X), each of P and R independently represents the structure of quaternary salt of nitrogen or phosphorus, which is not a partial structure of sensitizing dye. Each of $Q_1$ and $Q_2$ independently represents a linking group, which may be, for example, a single bond, an alkylene group, an arylene group, a heterocyclic group, —O—, —S—, —$NR_N$—, —C(=O)—, —$SO_2$—, —SO— and —P(=O)—, these used individually or in combination. $R_N$ represents a hydrogen atom, an alkyl group, an aryl group or a heterocyclic group. S represents a residue resulting from removal of one atom from the compound of type 1 or type 2. Each of i and j is an integer of 1 or greater, provided that i+j is in the range of 2 to 6. i=1 to 3 while j=1 to 2 is preferred, i=1 or 2 while j=1 is more preferred, and i=j=1 is most preferred. With respect to the compounds represented by the general formula (X), the total number of carbon atoms thereof is preferably in the range of 10 to 100, more preferably 10 to 70, still more preferably 11 to 60, and most preferably 12 to 50.

Specific examples of compounds of type 1 and type 2 will be shown below. Naturally, they in no way limit the scope of the present invention.

1

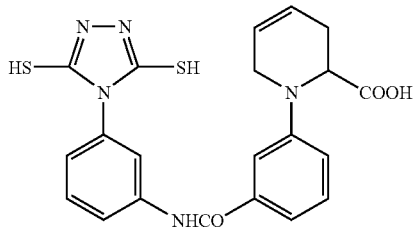

2

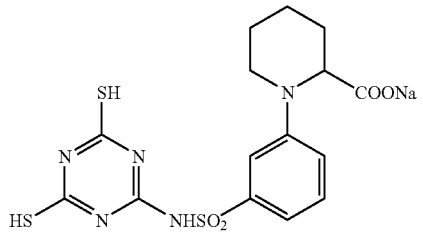

3

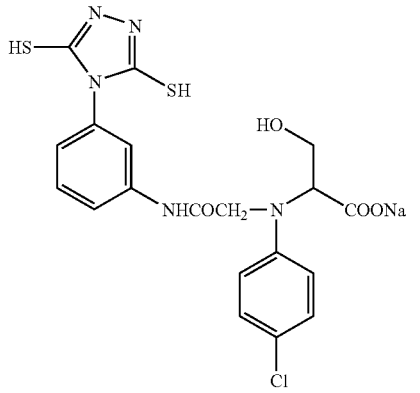

4

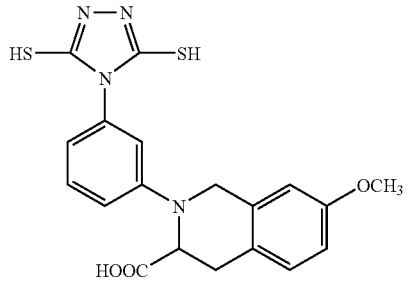

-continued
5
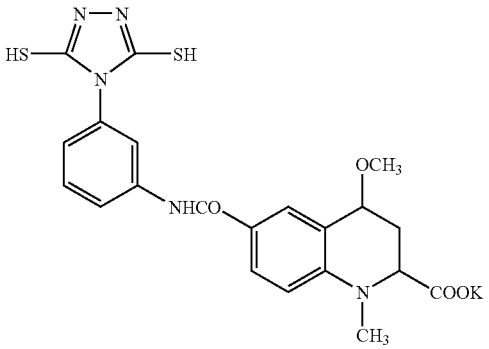
6
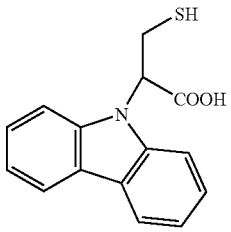
7
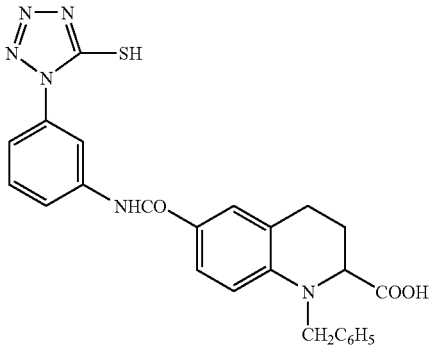
8
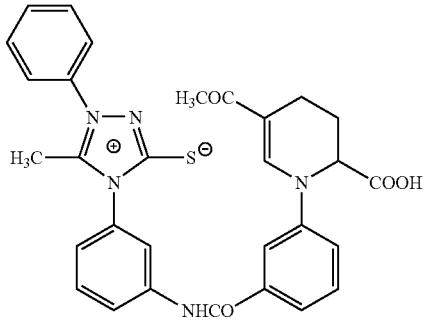
9
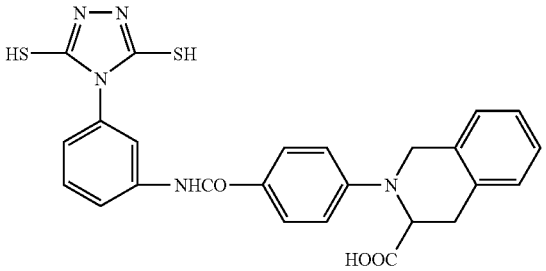
10
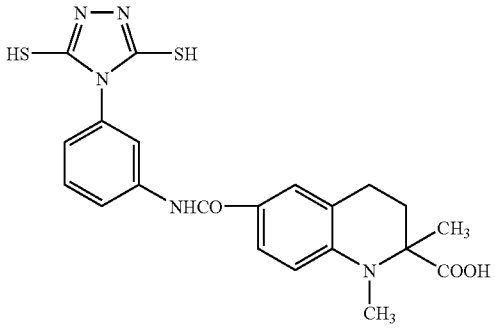
11
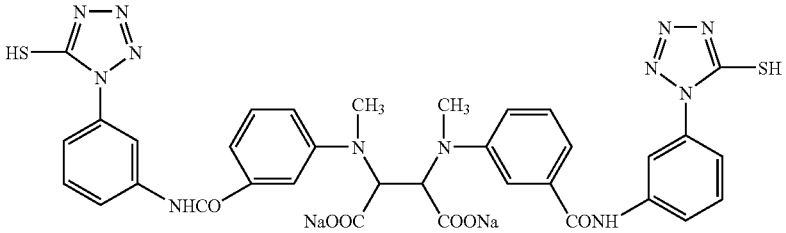
12
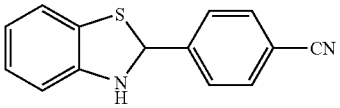
13
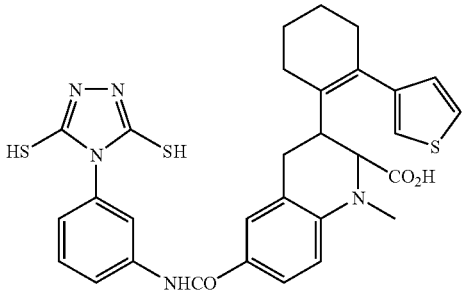

-continued
14
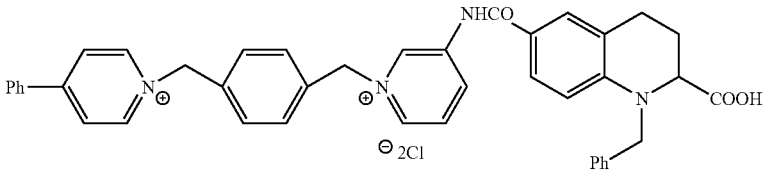
15
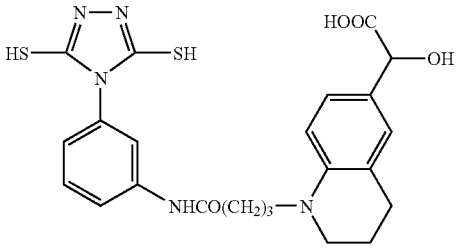
16
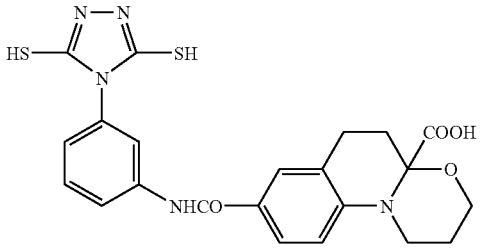
17
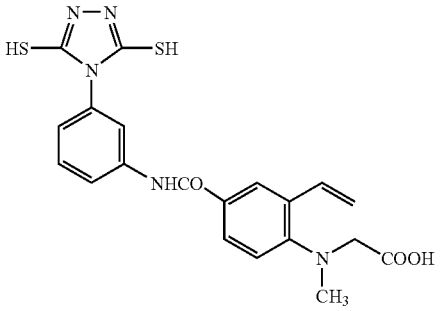
18
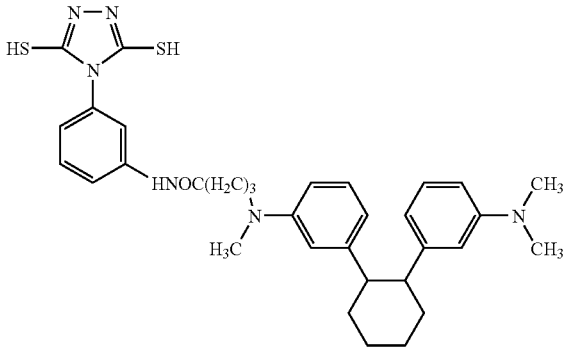
19
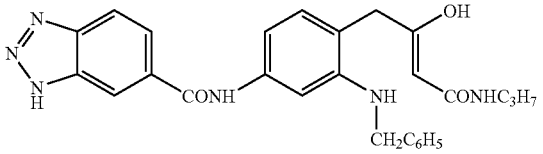
20
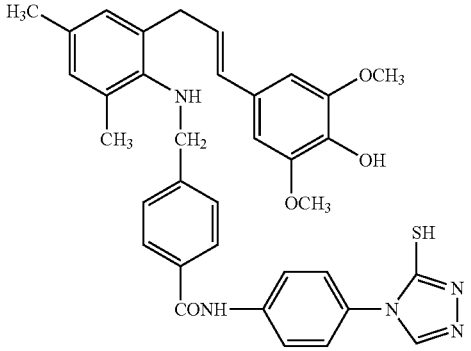
21
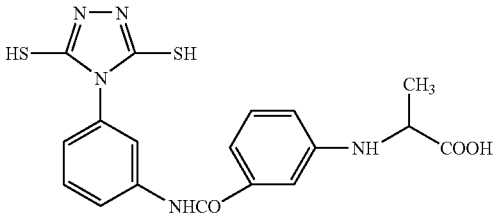
22
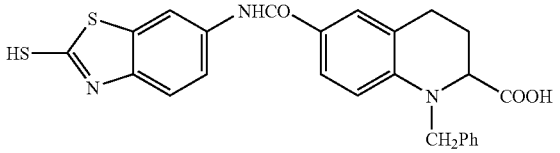

-continued
23
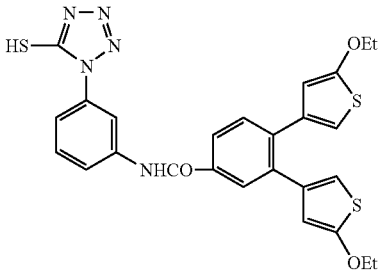
24
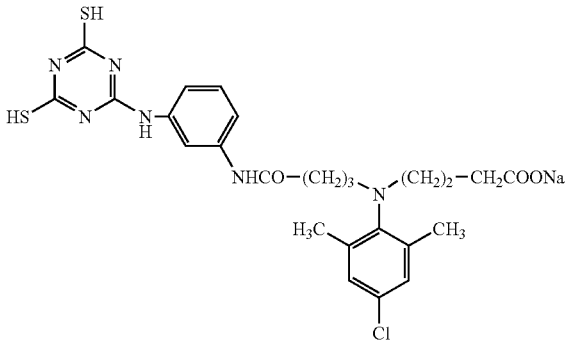
25
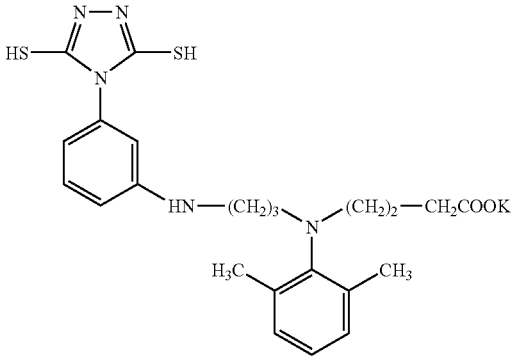
26
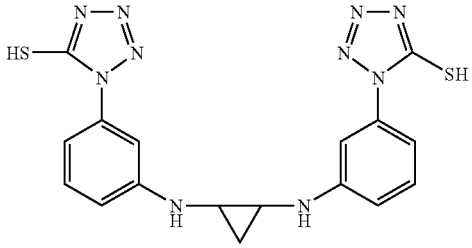
27
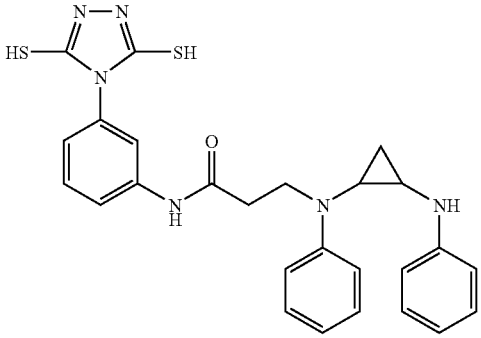
28
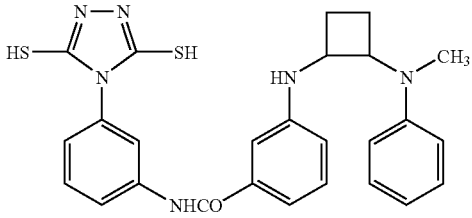
29
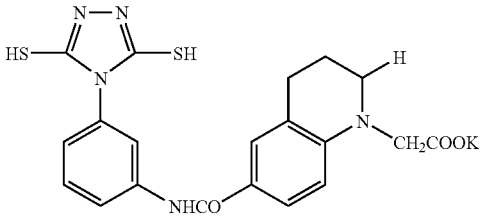
30
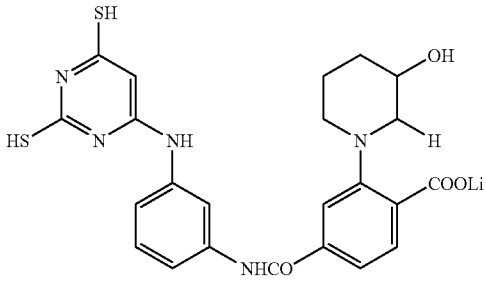

-continued
31
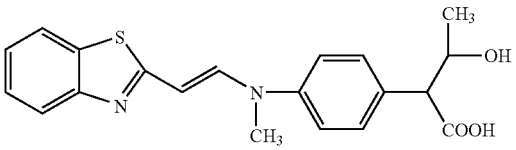
32
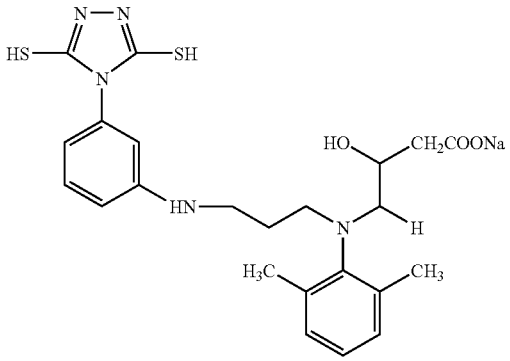
33
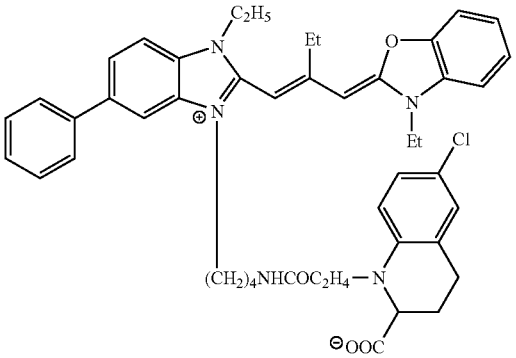
34
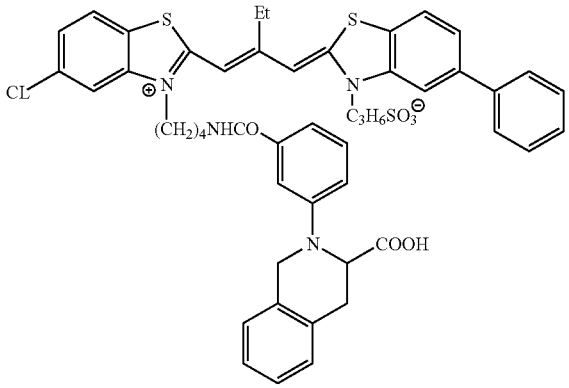
35
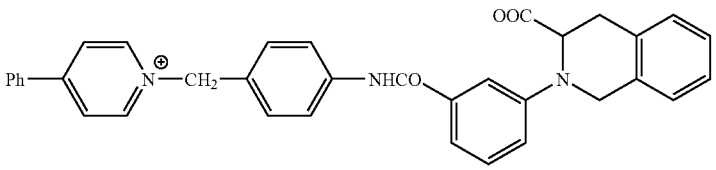
36
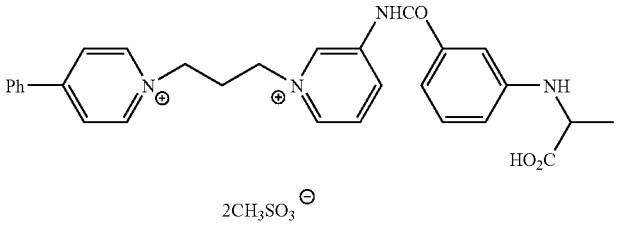
37
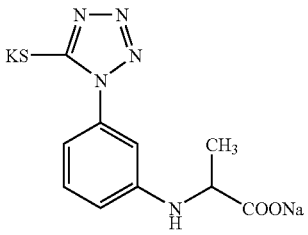
38
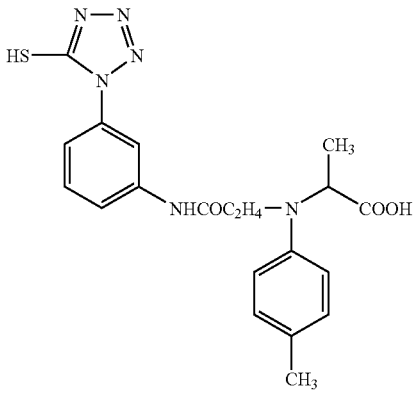

-continued
39
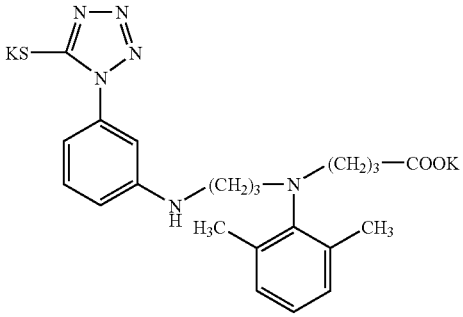
40
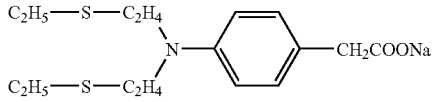
41
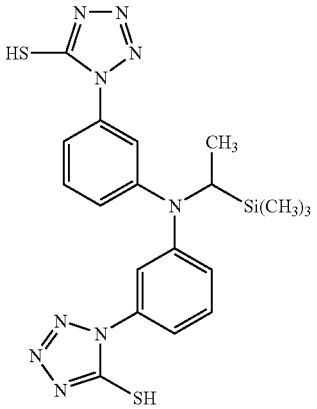
42
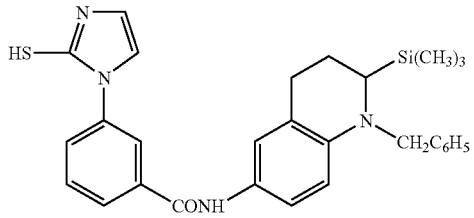
43
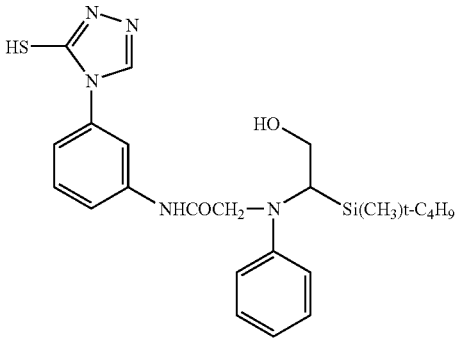
44
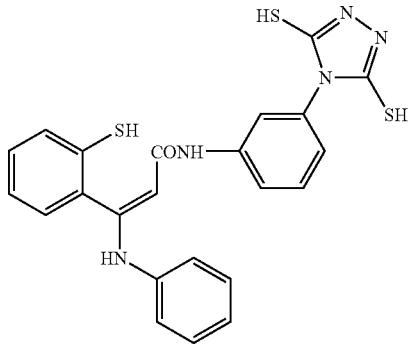
45
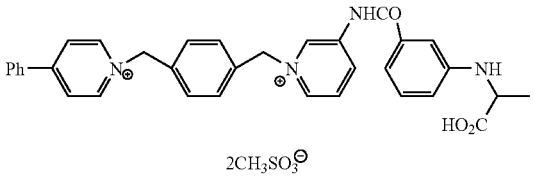
46
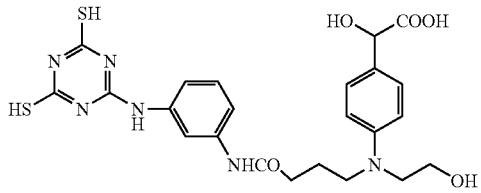
47
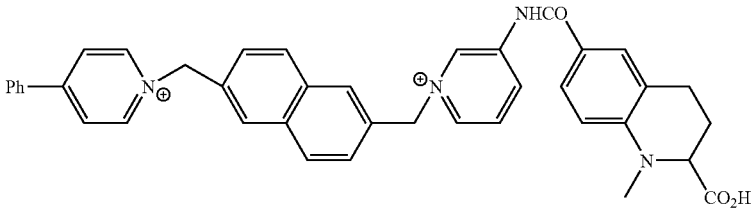

The compounds of type 1 and type 2 according to the present invention may be added at any stage during the emulsion preparation or photosensitive material production. For example, the addition may be effected at grain formation, desalting, chemical sensitization or coating. The compounds may be divided and added in multiple times during the above stages. The addition stage is preferably after completion of grain formation but before desalting, during chemical sensitization (just before initiation of chemical sensitization to just after termination thereof) or prior to coating. The addition stage is more preferably during chemical sensitization or prior to coating.

The compounds of type 1 and type 2 according to the present invention are preferably dissolved in water, a water soluble solvent such as methanol or ethanol or a mixed solvent thereof before addition. In the dissolving in water, with respect to compounds whose solubility is higher at higher or lower pH value, the dissolution is effected at pH value raised or lowered before addition.

The compounds of type 1 and type 2 according to the present invention, although preferably incorporated in emulsion layers, may be added to not only an emulsion layer but also a protective layer or an interlayer so as to realize diffusion at the time of coating operation. The timing of addition of compounds of the present invention may be before or after sensitizing dye addition, and at either stage the compounds are preferably incorporated in silver halide emulsion layers in an amount of $1\times10^{-9}$ to $5\times10^{-2}$ mol, more preferably $1\times10^{-8}$ to $2\times10^{-3}$ mol per mol of silver halides.

The present invention is preferably used in combination with the technique of increasing a light absorption with a spectral sensitizing dye, more preferably the technique of multilayer adsorption of sensitizing dye. The multilayer adsorption refers to adsorption (or laminating) of more than one layer of dye chromophore on the surface of silver halide grains.

The multilayer adsorption can be effected by, for example, the method of effecting adsorption of sensitizing dyes on the surface of silver halide grains in an amount greater than monolayer saturated coating amount by the use of intermolecular force, or the method of effecting adsorption on silver halide grains of a dye consisting of two or more separate nonconjugated dye chromophores coupled with each other through covalent bond, known as coupled dye. The particulars thereof are described in the following patents relating to multilayer adsorption.

JP-A's-10-239789, 11-133531, 2000-267216, 2000-275772, 2001-75222, 2001-75247, 2001-75221, 2001-75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173 and 2001-350442, and EP's 985965A, 985964A, 985966A, 985967A, 1085372A, 1085373A, 1172688A, 1199595A and 887700A1.

Moreover, the present invention is preferably used in combination with techniques described in JP-A's-10-239789, 2001-75222 and 10-171058.

In the light-sensitive material to which the method of the present invention can be employed, at least one blue-sensitive layer, at least one green-sensitive layer, at least one red-sensitive layer and at least one non-light-sensitive layer need only be formed on a support. A typical example is a silver halide photosensitive material having, on a support, at least one blue, green and red sensitive layer each consisting of a plurality of silver halide emulsion layers sensitive to substantially the same color but different in sensitivity, and at least one non-light-sensitive layer. This sensitive layer is a unit sensitive layer sensitive to one of blue light, green light, and red light. In a multilayered silver halide color photographic light-sensitive material, sensitive layers are generally arranged in the order of red-, green-, and blue-sensitive layers from a support. However, according to the intended use, this order of arrangement can be reversed, or sensitive layers sensitive to the same color can sandwich another sensitive layer sensitive to a different color. Non-light-sensitive layers can be formed between the silver halide sensitive layers and as the uppermost layer and the lowermost layer. These non-light-sensitive layers can contain, e.g., couplers, DIR compounds, and color amalgamation inhibitors to be described later. As a plurality of silver halide emulsion layers constituting each unit sensitive layer, as described in DE1,121,470 or GB923,045, the disclosures of which are incorporated herein by reference, high- and low-speed emulsion layers are preferably arranged such that the sensitivity is sequentially decreased toward a support. Also, as described in JP-A's-57-112751, 62-200350, 62-206541, and 62-206543, layers can be arranged such that a low-speed emulsion layer is formed apart from a support and a high-speed layer is formed close to the support.

More specifically, layers can be arranged, from the one farthest from a support, in the order of a low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in JP-B-55-34932, layers can be arranged in the order of a blue-sensitive layer/GH/RH/GL/RL from the one farthest from a support. Furthermore, as described in JP-A's-56-25738 and 62-63936, layers can be arranged in the order of a blue-sensitive layer/GL/RL/GH/RH from the one farthest from a support.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. When the layer structure is thus constituted by three layers having different sensitivities, these three layers can be arranged, in the same color-sensitive layer, in the order of a medium-speed emulsion layer/high-speed emulsion layer/low-speed emulsion layer from the one farthest from a support as described in JP-A-59-202464.

In addition, the order of a high-speed emulsion layer/low-speed emulsion layer/medium-speed emulsion layer or low-speed emulsion layer/medium-speed emulsion layer/high-speed emulsion layer can be used. Furthermore, the arrangement can be changed as described above even when four or more layers are formed.

A silver halide used in the present invention is silver iodobromide, silver iodochloride, or silver bromochloroiodide containing about 30 mol % or less of silver iodide. A silver halide is most preferably silver iodobromide or silver bromochloroiodide containing about 2 to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof.

A silver halide can consist of fine grains having a grain size of about 0.2 μm or less or large grains having a projected area diameter of about 10 μm, and an emulsion can be either a polydisperse or monodisperse emulsion.

A silver halide photographic emulsion usable in the present invention can be prepared by methods described in, e.g., "I. Emulsion preparation and types," Research Disclosure (RD) No. 17643 (December, 1978), pp. 22 and 23, RD No. 18716 (November, 1979), p. 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964, the disclosures of which are incorporated herein by reference.

Monodisperse emulsions described in, e.g., U.S. Pat. No. 3,574,628, U.S. Pat. No. 3,655,394, and GB1,413,748, the disclosures of which are incorporated herein by reference, are also favorable. Tabular grains having an aspect ratio of about 3 or more can also be used in the present invention. Tabular grains can be easily prepared by methods described in Gutoff, "Photographic Science and Engineering", Vol. 14, pp. 248 to 257 (1970); and U.S. Pat. No. 4,434,226, U.S. Pat. No. 4,414,310, U.S. Pat. No. 4,433,048, U.S. Pat. No. 4,439,520, and GB2,112,157, the disclosures of which are incorporated herein by reference.

It has been found that the sensitivity/graininess improving effect of compounds of the present invention can be enhanced when those are used in the same layer as that in which tabular grains having an average aspect ratio of 8 or more are used. In the present invention, the average aspect ratio of such tabular grains is preferably 8 or more and 100 or less, and more preferably 12 or more and 50 or less.

A crystal structure can be uniform, can have different halogen compositions in the interior and the surface layer thereof, or can be a layered structure. Alternatively, a silver halide having a different composition can be bonded by an epitaxial junction, or a compound except for a silver halide such as silver rhodanide or lead oxide can be bonded. A mixture of grains having various types of crystal shapes can also be used.

It is preferable that the above emulsion has dislocation lines. In the tabular grains, it is especially preferred that dislocation lines are viewed in the fringe portion thereof. Dislocation lines can be introduced by, for example, adding an aqueous solution such as an alkali iodide aqueous solution to form a high silver iodide layer, adding AgI fine grains, or a method as described in JP-A-5-323487.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is incorporated herein by reference. A method of preparing this core/shell internal latent image type emulsion is described in JP-A-59-133542, the disclosure of which is incorporated herein by reference. Although the thickness of a shell of this emulsion depends on the development conditions and the like, it is preferably 3 to 40 nm, and most preferably, 5 to 20 nm.

A silver halide emulsion is normally subjected to physical ripening, chemical sensitization, and spectral sensitization before being used. Additives for use in these steps are described in Research Disclosure (RD) Nos. 17643, 18716, and 307105, and the corresponding portions are summarized in a table to be presented later.

In a light-sensitive material of the present invention, it is possible to mix, in a single layer, two or more types of emulsions different in at least one of the characteristics, i.e., the grain size, grain size distribution, halogen composition, grain shape, and sensitivity, of a sensitive silver halide emulsion.

It is also preferable to apply surface-fogged silver halide grains described in U.S. Pat. No. 4,082,553, internally fogged silver halide grains described in U.S. Pat. No. 4,626,498 and JP-A-59-214852, and colloidal silver, to light-sensitive silver halide emulsion layers and/or substantially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A method of preparing the internally fogged or surface-fogged silver halide grain is described in U.S. Pat. No. 4,626,498 and JP-A-59-214852. A silver halide which forms the core of the internally fogged core/shell type silver halide grain can have a different halogen composition. As the internally fogged or surface-fogged silver halide, any of silver chloride, silver chlorobromide, silver iodobromide, and silver bromochloroiodide can be used. The average grain size of these fogged silver halide grains is preferably 0.01 to 0.75 μm, and most preferably, 0.05 to 0.6 μm. The grain shape can be a regular grain shape. Although the emulsion can be a polydisperse emulsion, it is preferably a monodisperse emulsion (in which at least 95% in weight, or number, of silver halide grains have grain sizes falling within the range of ±40% of the average grain size).

In the present invention, a non-light-sensitive fine-grain silver halide is preferably used. The non-light-sensitive fine-grain silver halide preferably consists of silver halide grains which are not exposed during imagewise exposure for obtaining a dye image and are not substantially developed during development. These silver halide grains are preferably not fogged in advance. In the fine-grain silver halide, the content of silver bromide is 0 to 100 mol %, and silver chloride and/or silver iodide can be added if necessary. The fine-grain silver halide preferably contains 0.5 to 10 mol % of silver iodide. The average grain size (the average value of equivalent-circle diameters of projected areas) of the fine-grain silver halide is preferably 0.01 to 0.5 μm, and more preferably, 0.02 to 0.2 μm.

The fine-grain silver halide can be prepared following the same procedures as for a common light-sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine-grain silver halide grain-containing layer.

The silver coating amount of a light-sensitive material of the present invention is preferably 8.0 g/m$^2$ or less.

Photographic additives usable in the present invention are also described in RDs, and the relevant portions are summarized in the following table.

| Additives | RD17643 | RD18716 | RD307105 |
|---|---|---|---|
| 1. Chemical sensitizers | page 23 | page 648, right column | page 866 |
| 2. Sensitivity increasing agents | | " | |
| 3. Spectral sensitizers, super sensitizers | pages 23–24 | page 648, right column to page 649, right column | pages 866–868 |
| 4. Brighteners | page 24 | page 647, right column | page 868 |
| 5. Light absorbents, filter dyes, ultraviolet absorbents | pages 25–26 | page 649, right column to page 650, left column | page 873 |
| 6. Binders | page 26 | page 651, left column | 873–874 |
| 7. Plasticizers, lubricants | page 27 | page 650, right column | page 876 |
| 8. Coating aids, surface active agents | pages 26–27 | " | pages 875–876 |
| 9. Antistatic agents | page 27 | " | pages 876–877 |
| 10. Matting agents | | | pages 878–879 |

Various dye forming couplers can be used in a light-sensitive material of the present invention, and the following couplers are particularly preferable.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and II-24 (column 19)) represented by formulas (II) to (IV) in column 7, lines 36 to 58 of U.S. Pat. No. 4,476,219, the disclosures of which are incorporated herein by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP456,257; M-4 and M-6 (page 26), and M-7 (page 27) in EP486,965; M-45 (page 19) in EP571,959A; (M-1) (page 6) in JP-A-5-204106; and M-22 in paragraph 0237 of JP-A-4-362631, the disclosures of which are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385, the disclosures of which are incorporated herein by reference.

Polymer couplers: P-1 and P-5 (page 11) in JP-A-2-44345, the disclosure of which is incorporated herein by reference.

Couplers for forming a colored dye with proper diffusibility are preferably those described in U.S. Pat. No. 4,366,237, GB2,125,570, EP96,873B, and DE3,234,533, the disclosures of which are incorporated herein by reference.

Couplers for correcting unnecessary absorption of a colored dye are preferably yellow colored cyan couplers (particularly YC-86 on page 84) represented by formulas (CI), (CII), (CIII), and (CIV) described on page 5 of EP456,257A1; yellow colored magenta couplers ExM-7 (page 202), EX-1 (page 249), and EX-7 (page 251) described in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by formula (A) in claim 1 of WO92/11575, the disclosures of which are incorporated herein by reference.

Examples of compounds (including a coupler) which react with a developing agent in an oxidized form to thereby release a photographically useful compound residue are as follows.

Development inhibitor release compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) (page 11)) represented by formula (1) in EP568,037A, and compounds (particularly I-(1) on page 29) represented by formulas (I), (II), and (III) described on pages 5 and 6 of EP440,195A2; bleaching accelerator release compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411; ligand release compounds: compounds (particularly compounds in column 12, lines 21 to 41) represented by LIG-X described in claim 1 of U.S. Pat. No. 4,555,478; leuco dye release compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE in claim 1 of U.S. Pat. No. 4,774,181; development accelerator or fogging agent release compounds: compounds (particularly (I-22) in column 25) represented by formulas (1), (2), and (3) in column 3 of U.S. Pat. No. 4,656,123, and ExZK-2 on page 75, lines 36 to 38 of EP450,637A2; compounds which release a group which does not function as a dye unless it splits off: compounds (particularly Y-1 to Y-19 in columns 25 to 36) represented by formula (I) in claim 1 of U.S. Pat. No. 4,857,447, the disclosures of which are incorporated herein by reference.

Preferred examples of additives other than couplers are as follows.

Dispersants of oil-soluble organic compounds: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of oil-soluble organic compounds: latexes described in U.S. Pat. No. 4,199,363; developing agent oxidized form scavengers: compounds (particularly I-(1), I-(2), I-(6), and I-(12) (columns 4 and 5)) represented by formula (I) in column 2, lines 54 to 62 of U.S. Pat. No. 4,978,606, and formulas (particularly a compound 1 (column 3)) in column 2, lines 5 to 10 of U.S. Pat. No. 4,923,787; stain inhibitors: formulas (I) to (III) on page 4, lines 30 to 33, particularly I-47, I-72, III-1, and III-27 (pages 24 to 48) in EP298321A; discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931; materials which reduce the use amount of a color enhancer or a color amalgamation inhibitor: I-1 to II-15, particularly I-46 on pages 5 to 24 of EP411324A; formalin scavengers: SCV-1 to SCV-28, particularly SCV-8 on pages 24 to 29 of EP477932A; film hardeners: H-1, H-4, H-6, H-8, and H-14 on page 17 of JP-A-1-214845, compounds (H-1 to H-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7 of U.S. Pat. No. 5,019,492;

antiseptic agents and mildewproofing agents: I-1 to III-43, particularly II-1, II-9, II-10, II-18, and III-25 in columns 3 to 15 of U.S. Pat. No. 4,923,790; stabilizers and antifoggants: I-1 to (14), particularly I-1, I-60, (2), and (13) in columns 6 to 16 of U.S. Pat. No. 4,923,793, and compounds 1 to 65, particularly the compound 36 in columns 25 to 32 of U.S. Pat. No. 4,952,483; chemical sensitizers: triphenylphosphine selenide and a compound 50 in JP-A-5-40324; dyes: a-1 to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11 and F-II-8 on pages 33 to 55 of EP445627A, III-1 to III-36, particularly III-1 and III-3 on pages 17 to 28 of EP457153A, fine-crystal dispersions of Dye-1 to Dye-124 on pages 8 to 26 of WO88/04794, compounds 1 to 22, particularly the compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) and compounds HBT-1 to HBT-10 (page 14) represented by formula (III) in EP520938A, and compounds (1) to (31) (columns 2 to 9) represented by formula (1) in EP521823A, the disclosures of which are incorporated herein by reference.

The present invention can be applied to various color photosensitive materials such as color negative films for general purposes or cinemas, color reversal films for slides and TV, color paper, color positive films and color reversal paper. Moreover, the present invention is suitable to lens equipped film units described in JP-B-2-32615 and Jpn. Utility Model Appln. KOKOKU Publication No. 3-39784.

Supports which can be suitably used in the present invention are described in, e.g., RD. No. 17643, page 28; RD. No. 18716, from the right column of page 647 to the left column of page 648; and RD. No. 307105, page 879.

The specified photographic speed referred to in the present invention is determined by the method described in JP-A-63-236035. The determining method is substantially in accordance with JIS K 7614-1981 except that the development processing is completed within 30 min to 6 hr after exposure for sensitometry and that the development processing is performed according to Fuji Color standard processing recipe CN-16.

In the photosensitive material of the present invention, the thickness of photosensitive silver halide layer closest to the support through surface of the photosensitive material is preferably 24 μm or less, more preferably 22 μm or less. Film swelling speed $T_{1/2}$ is preferably 30 sec or less, more preferably 20 sec or less. The film swelling speed $T_{1/2}$ is defined as the time that when the saturation film thickness refers to 90% of the maximum swollen film thickness attained by the processing in a color developer at 30° C. for 3 min 15 sec, is spent for the film thickness to reach ½ of the saturation film thickness. The film thickness means one measured under moisture conditioning at 25° C. in a relative humidity of 55% (two days). The film swelling speed $T_{1/2}$ can be measured by using a swellometer described in A. Green et al., Photogr. Sci. Eng., Vol. 19, No. 2, pp. 124 to 129. The film swelling speed $T_{1/2}$ can be regulated by adding a film hardener to gelatin as a binder, or by changing aging conditions after coating. The swelling ratio preferably ranges from 150 to 400%. The swelling ratio can be calculated from the maximum swollen film thickness measured under the above conditions in accordance with the formula:

(maximum swollen film thickness−film thickness)/film thickness.

In the light-sensitive material of the present invention, hydrophilic colloid layers (referred to as "back layers") having a total dry film thickness of 2 to 20 μm are preferably provided on the side opposite to the side having emulsion layers. These back layers preferably contain the aforementioned light absorbent, filter dye, ultraviolet absorbent, antistatic agent, film hardener, binder, plasticizer, lubricant, coating aid and surfactant. The swelling ratio of these back layers is preferably in the range of 150 to 500%.

The light-sensitive material according to the present invention can be developed by conventional methods described in the aforementioned RD. No. 17643, pages 28 and 29; RD. No. 18716, page 651, left to right columns; and RD No. 307105, pages 880 and 881.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol, more preferably 0.015 to 0.06 mol, and most preferably 0.02 to 0.05 mol per liter (hereinafter also referred to as "L") of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as a preservative of the color developing solution. When enhanced preserving properties are required, it is preferred to use hydroxylamine derivatives having substituents such as alkyl, hydroxyalkyl, sulfoalkyl and carboxyalkyl groups. Preferred examples thereof include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di(sulfoehtyl) hydroxylamine is most preferred. Although these may be used in combination with hydroxylamine, it is preferred that one or two or more members thereof be used in place of hydroxylamine.

These preservatives are preferably used in an amount of 0.02 to 0.2 mol, more preferably 0.03 to 0.15 mol, and most preferably 0.04 to 0.1 mol per L of the color developing solution. The replenisher of the color developing solution preferably contains the preservatives in an amount corresponding to 1.1 to 3 times the concentration of the mother liquor (processing tank solution) as in the color developing agent.

Sulfurous salts are used as tarring preventives for the color developing agent oxidation products in the color developing solution. Sulfurous salts are preferably used in the color developing solution in an amount of 0.01 to 0.05 mol, more preferably 0.02 to 0.04 mol per L. In the replenisher, sulfurous salts are preferably used in an amount corresponding to 1.1 to 3 times the above concentration.

The pH value of the color developing solution preferably ranges from 9.8 to 11.0, more preferably from 10.0 to 10.5. The pH of the replenisher is preferably set for a value 0.1 to 1.0 higher than the above value. Common buffers, such as carbonic acid salts, phosphoric acid salts, sulfosalicylic acid salts and boric acid salts, are used for stabilizing the above pH value.

Although the amount of the replenisher of the color developing solution preferably ranges from 80 to 1300 mL per $m^2$ of the lightsensitive material, the employment of smaller amount is desirable from the viewpoint of reduction of environmental pollution load. Specifically, the amount of the replenisher more preferably ranges from 80 to 600 mL, most preferably from 80 to 400 mL.

The bromide ion concentration in the color developer is usually 0.01 to 0.06 mol per L. However, this bromide ion concentration is preferably set at 0.015 to 0.03 mol per L in order to suppress fog and improve discrimination and graininess while maintaining sensitivity. To set the bromide ion concentration in this range, it is only necessary to add bromide ions calculated by the following equation to a replenisher. If C represented by formula below takes a negative value, however, no bromide ions are preferably added to a replenisher.

$$C=A-W/V$$

where

C: the bromide ion concentration (mol/L) in a color developer replenisher

A: the target bromide ion concentration (mol/L) in a color developer

W: the amount (mol) of bromide ions dissolving into the color developer from 1 $m^2$ of a light-sensitive material when the sensitive material is color-developed V: the replenishment rate (L) of the color developer replenisher for 1 $m^2$ of the light-sensitive material As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Compounds and processing conditions described on page 4, left lower column, line 16 to page 7, left lower column, line 6 of JP-A-4-125558 can be applied to the processing solution having bleaching capability for use in the present invention.

Bleaching agents having redox potentials of at least 150 mV are preferably used. Specifically, suitable examples thereof are those described in JP-A-5-72694 and JP-A-5-173312, and especially suitable examples thereof are 1,3-diaminopropanetetraacetic acid, Example 1 compounds listed on page 7 of JP-A-5-173312 and ferric complex salts.

For improving the biodegradability of bleaching agent, it is preferred that ferric complex salts of compounds listed in JP-A-4-251845, JP-A-4-268552, EP 588289, EP 591934 and JP-A-6-208213 be used as the bleaching agent. The concentration of these bleaching agents preferably ranges from 0.05 to 0.3 mol per liter of solution having bleaching capability, and it is especially preferred that a design be made at 0.1 to 0.15 mol per liter for the purpose of reducing the discharge to the environment. When the solution having bleaching capability is a bleaching solution, a bromide is preferably incorporated therein in an amount of 0.2 to 1 mol, more preferably 0.3 to 0.8 mol per liter.

Each component is incorporated in the replenisher of the solution having bleaching capability fundamentally at a concentration calculated by the following formula. This enables keeping the concentration in the mother liquor constant.

$$C_R=C_T\times(V_1+V_2)/V_1+C_P$$

$C_R$: concentration of each component in the replenisher, $C_T$: concentration of the component in the mother liquor (processing tank solution), $C_P$: component concentration consumed during processing, $V_1$: amount of replenisher having bleaching capability supplied per $m^2$ of photosensitive material (mL), and $V_2$: amount carried from previous bath by 1 $m^2$ of photosensitive material (mL).

In addition, a pH buffer is preferably incorporated in the bleaching solution, and it is especially preferred to incorporate a dicarboxylic acid of low order such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably 80 to 500 mL, and most preferably 100 to 300 mL of a bleaching replenisher per $m^2$ of photosensitive material. Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulae (I) and (II) of JP-A-6-301169 either individually or in combination in the processing solution having fixing capability. Further, the use of not only p-toluenesulfinic salts but also sulfinic acids listed in JP-A-1-224762 is preferred from the viewpoint of enhancing the preservability.

Although the incorporation of an ammonium as a cation in the solution having bleaching capability or solution having fixing capability is preferred from the viewpoint of enhancing the desilvering, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably 150 to 700 mL, and more preferably 200 to 600 mL per $m^2$ of the photosensitive material.

Silver is preferably recovered by installing any of various silver recovering devices in an in-line or off-line mode in the bleach-fix or fixation step. In-line installation enables processing with the silver concentration of solution lowered, so that the amount of replenisher can be reduced. It is also suitable to conduct an off-line silver recovery and recycle residual solution for use as a replenisher.

The bleach-fix and fixation steps can each be accomplished by the use of multiple processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5, more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

Descriptions made on page 12, right lower column, line 6 to page 13, right lower column, line 16 of JP-A-4-125558 mentioned above can preferably be applied to the washing and stabilization steps. In particular, with respect to the stabilizing solution, the use of azolylmethylamines described in EP 504609 and EP 519190 and N-methylolazoles described in JP-A-4-362943 in place of formaldehyde and the conversion of magenta coupler to two-equivalent form so as to obtain a surfactant solution not containing any image stabilizer such as formaldehyde are preferred from the viewpoint of protecting working environment.

Further, stabilizing solutions described in JP-A-6-289559 can preferably be used for reducing the adhesion of refuse to a magnetic recording layer applied to the photosensitive material.

The replenishing amount of washing and stabilizing solutions is preferably in the range of 80 to 1000 mL, more preferably 100 to 500 mL, and most preferably 150 to 300 mL, per $m^2$ of the photosensitive material from the viewpoint that washing and stabilizing functions are ensured and that the amount of waste solution is reduced to contribute to environment protection. In the processing conducted with the above replenishing amount, known mildewproofing agents such as thiabendazole, 1,2-benzoisothiazolin-3-one and 5-chloro-2-methylisothiazolin-3-one, antibiotics such as gentamicin, and water deionized by the use of, for example, an ion exchange resin are preferably used for preventing the breeding of bacteria and mildew. The joint use of deionized water, a mildewproofing agent and an antibiotic is more effective than single use thereof.

With respect to the solution placed in the washing or stabilizing solution tank, it is also preferred that the replenishing amount be reduced by conducting a reverse osmosis membrane treatment as described in JP-A's-3-46652, 3-53246, 3-55542, 3-121448 and 3-126030. A low-pressure reverse osmosis membrane is preferably used as the reverse osmosis membrane of the above treatment.

In the processing of the present invention, it is especially preferred that an evaporation correction of processing solution be carried out as disclosed in JIII (Japan Institute of Invention and Innovation) Journal of Technical Disclosure No. 94-4992. In particular, the method in which a correction is effected with the use of information on the temperature and humidity of developing machine installation environment in accordance with Formula 1 on page 2 thereof is preferred. Water for use in the evaporation correction is preferably procured from the washing replenishing tank. In that instance, deionized water is preferably used as the washing replenishing water.

Processing agents set forth on page 3, right column, line 15 to page 4, left column, line 32 of the above journal of technical disclosure are preferably used in the present invention. Film processor described on page 3, right column, lines 22 to 28 thereof is preferably used as the developing machine in the processing of the present invention.

Specific examples of processing agents, automatic developing machines and evaporation correction schemes preferably employed in carrying out of the present invention are described on page 5, right column, line 11 to page 7, right column, last line of the above journal of technical disclosure.

The processing agent for use in the present invention may be supplied in any form, for example, form of a liquid agent with the same concentration as in use or concentrated one, granules, powder, tablets, a paste or an emulsion. For example, a liquid agent stored in a container of low oxygen permeability is disclosed in JP-A-63-17453, vacuum packed powder or granules in JP-A's-4-19655 and 4-230748, granules containing a water soluble polymer in JP-A-4-221951, tablets in JP-A's-51-61837 and 6-102628 and a paste processing agent in PCT National Publication 57-500485. Although any of these can be suitably used, from the viewpoint of easiness in use, it is preferred to employ a liquid prepared in the same concentration as in use in advance.

Any one or a composite of polyethylene, polypropylene, polyvinyl chloride, polyethylene terephthalate, nylon, etc. is molded into the container for storing the above processing agents. These materials are selected in accordance with the required level of oxygen permeability. A material of low oxygen permeability is preferably used for storing an easily oxidized liquid such as a color developing solution, which is, for example, polyethylene terephthalate or a composite material of polyethylene and nylon. It is preferred that each of these materials be used in the container at a thickness of 500 to 1500 μm so that the oxygen permeability therethrough is 20 $mL/m^2 \cdot 24$ hrs·atm or less.

The processing solution for color reversal film to be employed in the present invention will be described below.

With respect to the processing of color reversal film, detailed descriptions are made in Public Technology No. 6 (Apr. 1, 1991) issued by Aztek, page 1, line 5 to page 10, line 5 and page 15, line 8 to page 24, line 2, any of which can be preferably applied thereto.

In the processing of color reversal film, an image stabilizer is added to a conditioning bath or a final bath. Examples of suitable image stabilizers include formalin, formaldehyde sodium bisulfite and N-methylolazoles. Formaldehyde sodium bisulfite and N-methylolazoles are preferred from the viewpoint of working environment, Among the N-methylolazoles, N-methyloltriazole is especially preferred. The contents of descriptions on color developing solution, bleaching solution, fixing solution, washing water, etc. made in connection with the processing of color negative films are also preferably applicable to the processing of color reversal films.

Processing agent E-6 available from Eastman Kodak and processing agent CR-56 available from Fuji Photo Film Co., Ltd. can be mentioned as preferred color reversal film processing agents including the above feature.

A magnetic recording layer preferably used in the present invention will be described below. This magnetic recording layer is formed by coating the surface of a support with an aqueous or organic solvent-based coating solution which is prepared by dispersing magnetic grains in a binder.

As the magnetic grains used in the present invention, it is possible to use, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, a ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferred. The grain can take the shape of any of, e.g., a needle, rice grain, sphere, cube, and plate. The specific area is preferably 20 $m^2/g$ or more, and more preferably, 30 $m^2/g$ or more as $S_{BET}$.

The saturation magnetization ($\sigma s$) of the ferromagnetic substance is preferably $3.0\times10^4$ to $3.0\times10^5$ A/m, and most preferably, $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032, the disclosure of which is incorporated herein by reference. A ferromagnetic grain whose surface is coated with an inorganic or organic substance described in JP-A-4-259911 or JP-A-5-81652, the disclosures of which are incorporated herein by reference, can also be used.

As a binder used in the magnetic grains, it is possible to use a thermoplastic resin, thermosetting resin, radiation-curing resin, reactive resin, acidic, alkaline, or biodegradable polymer, natural polymer (e.g., a cellulose derivative and sugar derivative), and their mixtures. These examples are described in JP-A-4-219569, the disclosure of which is incorporated herein by reference. The Tg of the resin is preferably −40° C. to 300° C., and its weight average molecular weight is preferably 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferred. Cellulosedi(tri)acetate is particularly preferred. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6-59357, the disclosure of which is incorporated herein by reference.

As a method of dispersing the magnetic substance in the binder, as described in JP-A-6-35092, the disclosure of which is incorporated herein by reference, a kneader, pin type mill, and annular mill are preferably used singly or together. Dispersants described in JP-A-5-088283, the disclosure of which is incorporated herein by reference, and other known dispersants can be used. The thickness of the magnetic recording layer is 0.1 to 10 μm, preferably 0.2 to 5 μm, and more preferably, 0.3 to 3 μm. The weight ratio of the magnetic grains to the binder is preferably 0.5:100 to 60:100, and more preferably, 1:100 to 30:100. The coating amount of the magnetic grains is 0.005 to 3 $g/m^2$, preferably 0.01 to 2 $g/m^2$, and more preferably, 0.02 to 0.5 $g/m^2$. The transmission yellow density of the magnetic recording layer is preferably 0.01 to 0.50, more preferably, 0.03 to 0.20, and most preferably, 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341436, the disclosure of which is incorporated herein by reference is preferred.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferred. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Light-sensitive materials having the magnetic recording layer are described in U.S. Pat. No. 5,336,589, U.S. Pat. No. 5,250,404, U.S. Pat. No. 5,229,259, U.S. Pat. No. 5,215,874, and EP 466,130, the disclosures of which are incorporated herein by reference.

A polyester support used in the present invention will be described below. Details of the polyester support and light-sensitive materials, processing, cartridges, and examples (to be described later) are described in Journal of Technical Disclosure No. 94-6023 (JIII; 1994, Mar. 15), the disclosure of which is incorporated herein by reference. Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferred. Polyethylene-2,6-naphthalate is most preferred among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of preferably 40° C. to less than Tg, and more preferably, Tg-20° C. to less than Tg. The heat treatment can be performed at a fixed temperature within this range or can be performed together with cooling. The heat treatment time is preferably 0.1 to 1500 hr. and more preferably, 0.5 to 200 hr. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A favorable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the light-sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferred.

An undercoat layer can include a single layer or two or more layers. Examples of an undercoat layer binder are copolymers formed by using, as a starting material, a monomer selected from vinyl chloride, vinylidene chloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoat layer are chromium salt (e.g., chromium alum), aldehydes (e.g., formaldehyde and glutaraldehyde), isocyanates, an active halogen compound (e.g., 2,4-dichloro-6-hydroxy-s-triazine), an epichlorohydrin resin, and an active vinylsulfone compound. $SiO_2$, $TiO_2$, inorganic fine grains, or polymethylmethacrylate copolymer fine grains (0.01 to 10 μm) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of preferably $10^7$ Ω·cm or less, and more preferably, $10^5$ Ω·cm or less and a grain size of 0.001 to 1.0 μm, fine grains of composite oxides (e.g., Sb, P, B, In, S, Si, and C) of these metal oxides, fine grains of sol metal oxides, or fine grains of composite oxides of these sol metal oxides.

The content in a light-sensitive material is preferably 5 to 500 mg/m$^2$, and particularly preferably, 10 to 350 mg/m$^2$. The ratio of a conductive crystalline oxide or its composite oxide to the binder is preferably 1/300 to 100/1, and more preferably, 1/100 to 100/5.

A light-sensitive material of the present invention preferably has a slip property. Slip agent-containing layers are preferably formed on the surfaces of both a light-sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a light-sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferred.

A light-sensitive material of the present invention preferably contains a matting agent. This matting agent can be added to either the emulsion surface or back surface and is most preferably added to the outermost emulsion layer. The matting agent can be either soluble or insoluble in processing solutions, and the use of both types of matting agents is preferred. Favorable examples are polymethylmethacrylate grains, poly(methylmethacrylate/methacrylic acid=9/1 or 5/5 (molar ratio)) grains, and polystyrene grains. The grain size is preferably 0.8 to 10 μm, and a narrow grain size distribution is favored. It is preferable that 90% or more of all grains have grain sizes 0.9 to 1.1 times the average grain size. To increase the matting property, it is preferable to simultaneously add fine grains with a grain size of 0.8 μm or smaller. Examples are polymethylmethacrylate grains (0.2 μm), poly(methylmethacrylate/methacrylic acid=9/1 (molar ratio, 0.3 μm) grains, polystyrene grains (0.25 μm), and colloidal silica grains (0.03 μm).

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A-1-312537 and JP-A-1-312538, the disclosures of which are incorporated herein by reference. It is particularly preferable that the resistance be $10^{12}$Ω or less at 25° C. and 25% RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of a 25 mm cartridge of 135 size to 22 mm or less. The volume of a cartridge case is 30 cm$^3$ or less, preferably 25 cm$^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. No. 4,834,306 and U.S. Pat. No. 5,226,613, the disclosures of which are incorporated herein by reference. Photographic films used in the present invention can be so-called raw films before being developed or developed photographic films. Also, raw and developed photographic films can be accommodated in the same new cartridge or in different cartridges.

A color photographic light-sensitive material of the present invention is also suitably used as a negative film for Advanced Photo System (to be referred to as APS hereinafter). Examples are the NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series (e.g., the EPION 300Z). A color photosensitive film of the present invention is also suited as a film with lens such as the Fuji Film FUJICOLOR UTSURUNDESU SUPER SLIM.

A photographed film is printed through the following steps in a mini-lab system.

(1) Reception (an exposed cartridge film is received from a customer)

(2) Detaching step (the film is transferred from the cartridge to an intermediate cartridge for development)

(3) Film development (4) Reattaching step (the developed negative film is returned to the original cartridge)

(5) Printing (prints of three types C, H, and P and an index print are continuously automatically printed on color paper [preferably the Fuji Film SUPER FA8])

(6) Collation and shipment (the cartridge and the index print are collated by an ID number and shipped together with the prints)

As these systems, the Fuji Film MINI-LAB CHAMPION SUPER FA-298, FA-278, FA-258, FA-238 and the Fuji Film FRONTIER digital lab system are preferred. Examples of a film processor for the MINI-LAB CHAMPION are the FP922AL, FP562B, FP562B,AL, FP362B, and FP362B,AL, and recommended processing chemicals are the FUJICOLOR JUST-IT CN-16L and CN-16Q. Examples of a printer processor are the PP3008AR, PP3008A, PP1828AR, PP1828A, PP1258AR, PP1258A, PP728AR, and PP728A, and a recommended processing chemicals are the FUJICOLOR JUST-IT CP-47L and CP-40FAII. In the FRONTIER system, the SP-1000 scanner & image processor and the LP-1000P laser printer & paper processor or the LP-1000W laser printer are used. A detacher used in the detaching step and a reattacher used in the reattaching step are preferably the Fuji Film DT200 or DT100 and AT200 or AT100, respectively.

APS can also be enjoyed by PHOTO JOY SYSTEM whose main component is the Fuji Film Aladdin 1000 digital image workstation. For example, a developed APS cartridge film is directly loaded into the Aladdin 1000, or image information of a negative film, positive film, or print is input to the Aladdin 1000 by using the FE-550 35 mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film PHOTO PLAYER AP-1. Image information can also be continuously input to a personal computer by loading a developed APS cartridge film into the Fuji Film PHOTO SCANNER AS-1. The Fuji Film PHOTO VISION FV-10 or FV-5 can be used to input a film, print, or three-dimensional object. Furthermore, image information recorded in a floppy disk, Zip disk, CR-R, or hard disk can be variously processed on a computer by using the Fuji Film PHOTO FACTORY application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferred.

Examples of the present invention will be described below. However, the present invention is not limited to these examples.

EXAMPLE 1

A support used in this example was formed by the following method.

(i) First Layer and Undercoat Layer

Glow discharge was performed on the two surfaces of a 90-μm thick polyethylenenaphthalate support at a processing ambient pressure of 26.6 Pa, an $H_2O$ partial pressure in the ambient gas of 75%, a discharge frequency of 30 kHz, an output of 2,500 W, and a processing intensity of 0.5 kV·A·min/m$^2$. One surface (back surface) of this support was coated with 5 mL/m$^2$ of a coating solution having the following composition as a first layer by using a bar coating method described in JP-B-58-4589, the disclosure of which is incorporated herein by reference.

Conductive fine-grain dispersion 50 parts by mass (a water dispersion having an $SnO_2/Sb_2O_5$ grain concentration of 10%, a secondary aggregate having a primary grain size of 0.005 μm and an average grain size of 0.05 μm)

| | |
|---|---|
| Gelatin | 0.5 parts by mass |
| Water | 49 parts by mass |
| Polyglycerolpolyglycidyl ether | 0.16 parts by mass |
| Poly(polymerization degree 20) oxyethylenesorbitanmonolaurate | 0.1 part by mass |

In addition, after the first layer was formed by coating, the support was wound on a stainless-steel core 20 cm in diameter and heated at 110° C. (Tg of PEN support: 119° C.) for 48 hr so as to be given thermal hysteresis, thereby performing annealing. After that, the side (emulsion surface side) of the support away from the first layer side was coated with 10 mL/m$^2$ of a coating solution having the following composition as an undercoat layer for emulsions, by using a bar coating method.

| | |
|---|---|
| Gelatin | 1.01 parts by mass |
| Salicylic acid | 0.30 parts by mass |
| Resorcin | 0.40 parts by mass |
| Poly (polymerization degree 10) oxyethylenenonylphenyl ether | 0.11 parts by mass |
| Water | 3.53 parts by mass |
| Methanol | 84.57 parts by mass |
| n-Propanol | 10.08 parts by mass |

Furthermore, second and third layers to be described later were formed in this order on the first layer by coating. Subsequently, the opposite side was coated with multiple layers of a color negative light-sensitive material having a composition to be described later, thereby making a transparent magnetic recording medium having silver halide emulsion layers.

(ii) Second Layer (Transparent Magnetic Recording Layer)

(1) Dispersion of Magnetic Substance 1,100 parts by mass of a Co-deposited γ-$Fe_2O_3$ magnetic substance (average long axis length: 0.25 μm, $S_{BET}$: 39 m$^2$/g, Hc: 6.56×10$^4$ A/m, σs: 77.1 Am$^2$/kg, σ r: 37.4 Am$^2$/kg), 220 parts by mass of water, and 165 parts by mass of a silane coupling agent [3-(poly(polymerization degree 10)oxyethynyl)oxypropyl trimethoxysilane] were added and well kneaded for 3 hr by an open kneader. This coarsely dispersed viscous solution was dried at 70° C. for 24 hr to remove water and heated at 110° C. for 1 hr to form surface-treated magnetic grains.

These grains were again kneaded for 4 hr by the following formulation by using an open kneader.

| | |
|---|---|
| Above-mentioned surface-treated magnetic grains | 855 g |
| Diacetylcellulose | 25.3 g |
| Methylethylketone | 136.3 g |
| Cyclohexanone | 136.3 g |

The resultant material was finely dispersed at 2,000 rpm for 4 hr by the following formulation by using a sand mill (1/4 G sand mill). Glass beads 1 mm in diameter were used as media.

| | |
|---|---|
| Above-mentioned kneaded solution | 45 g |
| Diacetylcellulose | 23.7 g |
| Methylethylketone | 127.7 g |
| Cyclohexanone | 127.7 g |

Furthermore, magnetic substance-containing intermediate solution was formed by the following formulation.

(2) Formation of Magnetic Substance-Containing Intermediate Solution

| | |
|---|---|
| Above-mentioned magnetic substance finely dispersed solution | 674 g |
| Diacetylcellulose solution (solid content 4.34%, solvent: methylethylketone/cyclohexanone = 1/1) | 24,280 g |
| Cyclohexanone | 46 g |

These materials were mixed, and the mixture was stirred by a disperser to form a "magnetic substance-containing intermediate solution".

An α-alumina polishing material dispersion of the present invention was formed by the following formulation.

(a) Sumicorundum AA-1.5 (Average Primary Grain Size 1.5 μm, Specific Surface Area 1.3 $m^2/g$)

Formation of Grain Dispersion

| | |
|---|---|
| Sumikorandom AA-1.5 | 152 g |
| Silane coupling agent KBM 903 (manufactured by Shin-Etsu Silicone) | 0.48 g |
| Diacetylcellulose solution (solid content 4.5%, solvent: methylethylketone/ cyclohexanone = 1/1) | 227.52 g |

The above formulation was finely dispersed at 800 rpm for 4 hr by using a ceramic-coated sand mill (¼ G sand mill). Zirconia beads 1 mm in diameter were used as media.

(b) Colloidal Silica Grain Dispersion (Fine Grains)

"MEK-ST" manufactured by Nissan Chemical Industries, Ltd. was used.

"MEK-ST" was a colloidal silica dispersion containing methylethylketone as a dispersion medium and having an average primary grain size of 0.015 μm. The solid content is 30%.

(3) Formation of Second Layer Coating Solution

| | |
|---|---|
| Above-mentioned magnetic substance-containing intermediate solution | 19,053 g |
| Diacetylcellulose solution (solid content 4.5%, solvent: methylethylketone/cyclohexanone = 1/1) | 264 g |
| Colloidal silicon dispersion "MEK-ST" [dispersion b] (solid content 30%) | 128 g |
| AA-1.5 dispersion [dispersion a] | 12 g |
| Millionate MR-400 (manufactured by Nippon Polyurethane K.K.) diluted solution (solid content 20%, diluent solvent: methylethylketone/cyclohexanone = 1/1) | 203 g |
| Methylethylketone | 170 g |
| Cyclohexanone | 170 g |

A coating solution formed by mixing and stirring the above materials was coated in an amount of 29.3 $mL/m^2$ by using a wire bar. The solution was dried at 110° C. The thickness of the dried magnetic layer was 1.0 μm.

(iii) Third Layer (Higher Fatty Acid Ester Slipping Agent-Containing Layer)

(1) Formation of Undiluted Dispersion

A solution A presented below was dissolved at 100° C. and added to a solution B. The resultant solution mixture was dispersed by a high-pressure homogenizer to form an undiluted dispersion of a slipping agent.

| | |
|---|---|
| **Solution A** | |
| Compound below $C_6H_{13}CH(OH)(CH_2)_{10}COOC_{50}H_{101}$ | 399 parts by mass |
| Compound below $n\text{-}C_{50}H_{101}O(CH_2CH_2O)_{16}H$ | 177 parts by mass |
| Cyclohexanone | 830 parts by mass |
| **Solution B** | |
| Cyclohexanone | 8,600 parts by mass |

(2) Formation of Spherical Inorganic Grain Dispersion

A spherical inorganic grain dispersion [c1] was formed by the following formulation.

| | |
|---|---|
| Isopropyl alcohol | 93.54 parts by mass |
| Silane coupling agent KBM903 (manufactured by Shin-Etsu Silicone) compound 1-1: $(CH_3O)_3Si—(CH_2)_3—NH_2$) | 5.53 parts by mass |
| Compound 1 | 2.93 parts by mass |
| SEAHOSTAR KEP50 | 88.00 parts by mass |

Compound 1

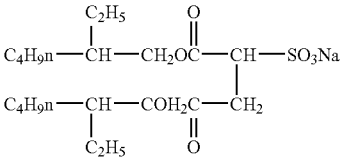

(amorphous spherical silica, average grain size 0.5 μm, manufactured by NIPPON SHOKUBAI Co., Ltd.)

The above formulation was stirred for 10 min, and the following was further added.

Diacetone Alcohol 252.93 Parts by Mass

Under ice cooling and stirring, the above solution was dispersed for 3 hr by using the "SONIFIER450 (manufactured by BRANSON K.K.)" ultrasonic homogenizer, thereby completing the spherical inorganic grain dispersion c1.

(3) Formation of Spherical Organic Polymer Grain Dispersion

A spherical organic polymer grain dispersion [c2] was formed by the following formulation.

| | |
|---|---|
| XC99-A8808 (manufactured by TOSHIBA SILICONE K.K. spherical crosslinked polysiloxane grain, average grain size 0.9 μm) | 60 parts by mass |
| Methylethylketone | 120 parts by mass |
| Cyclohexanone | 120 parts by mass |

Under ice cooling and stirring, the above solution was dispersed for 2 hr by using the "SONIFIER450 (manufactured by BRANSON K.K.)" ultrasonic homogenizer, thereby completing the spherical organic polymer grain dispersion c2.

(4) Formation of Third Layer Coating Solution

The following components were added to 542 g of the aforementioned slipping agent undiluted dispersion to form a third layer coating solution.

| | |
|---|---|
| Diacetone alcohol | 5,950 g |
| Cyclohexanone | 176 g |
| Ethyl acetate | 1,700 g |
| Above-mentioned SEEHOSTA KEP50 dispersion [c1] | 53.1 g |
| Above-mentioned spherical organic polymer grain dispersion [c2] | 300 g |
| FC431 (manufactured by 3M K.K., solid content 50%, solvent: ethyl acetate) | 2.65 g |
| BYK310 (manufactured by BYK Chemi Japan K.K., solid content 25%) | 5.3 g |

The above third layer coating solution was coated in an amount of 10.35 mL/m$^2$ on the second layer, dried at 110° C., and further dried at 97° C. for 3 min.

(iv) Coating of Light-Sensitive Layers

The opposite side of the back layers obtained as above was coated with a plurality of layers to make a color negative film.

(Compositions of Light-Sensitive Layers)

The number corresponding to each component indicates the coating amount in units of g/m$^2$. The coating amount of a silver halide is indicated by the amount of silver.

(Sample 101)

| 1st layer (1st antihalation layer) | | |
|---|---|---|
| Black colloidal silver | silver | 0.112 |
| Silver iodobromide emulsion grain (average grain diameter 0.07 μm, silver iodide content 2 mol %) | silver | 0.012 |
| Gelatin | | 0.890 |
| ExM-1 | | 0.045 |
| ExC-1 | | 0.004 |
| ExC-3 | | 0.002 |
| Cpd-2 | | 0.001 |
| F-8 | | 0.001 |
| HBS-1 | | 0.050 |
| HBS-2 | | 0.002 |
| **2nd layer (2nd antihalation layer)** | | |
| Black colloidal silver | silver | 0.050 |
| Gelatin | | 0.452 |
| ExF-1 | | 0.005 |
| F-8 | | 0.002 |
| Solid disperse dye ExF-7 | | 0.110 |
| HBS-1 | | 0.070 |
| **3rd layer (Interlayer)** | | |
| ExC-2 | | 0.050 |
| Cpd-1 | | 0.092 |
| Polyethylaclyrate latex | | 0.220 |
| HBS-1 | | 0.120 |
| Gelatin | | 0.700 |
| **4th layer (Low-speed red-sensitive emulsion layer)** | | |
| Em-C | silver | 0.500 |
| Em-D | silver | 0.330 |
| ExC-1 | | 0.180 |
| ExC-2 | | 0.012 |
| ExC-3 | | 0.070 |
| ExC-4 | | 0.120 |
| ExC-5 | | 0.015 |
| ExC-6 | | 0.010 |
| ExC-8 | | 0.055 |
| ExC-9 | | 0.024 |
| ExY-3 | | 0.010 |
| Cpd-2 | | 0.025 |
| Cpd-4 | | 0.023 |
| Cpd-7 | | 0.015 |
| UV-2 | | 0.054 |
| UV-3 | | 0.080 |
| UV-4 | | 0.020 |
| HBS-1 | | 0.260 |
| HBS-5 | | 0.035 |
| Gelatin | | 0.985 |
| **5th layer (Medium-speed red-sensitive emulsion layer)** | | |
| Em-B | silver | 0.935 |
| ExC-1 | | 0.135 |
| ExC-2 | | 0.075 |
| ExC-3 | | 0.020 |
| ExC-4 | | 0.100 |
| ExC-5 | | 0.010 |
| ExC-6 | | 0.010 |
| ExC-8 | | 0.015 |
| ExC-9 | | 0.003 |
| ExY-3 | | 0.005 |
| Cpd-2 | | 0.034 |
| Cpd-4 | | 0.025 |
| Cpd-7 | | 0.020 |
| HBS-1 | | 0.110 |
| Gelatin | | 0.850 |
| **6th layer (High-speed red-sensitive emulsion layer)** | | |
| Em-A | silver | 1.350 |
| ExC-1 | | 0.280 |
| ExC-3 | | 0.035 |
| ExC-6 | | 0.028 |
| ExC-8 | | 0.115 |
| ExC-9 | | 0.025 |
| ExY-3 | | 0.018 |
| Cpd-2 | | 0.065 |
| Cpd-4 | | 0.080 |
| Cpd-7 | | 0.034 |
| HBS-1 | | 0.340 |
| HBS-2 | | 0.130 |
| Gelatin | | 1.350 |

-continued

| | | |
|---|---|---|
| **7th layer (Interlayer)** | | |
| Cpd-1 | | 0.095 |
| Cpd-6 | | 0.370 |
| Solid disperse dye ExF-4 | | 0.030 |
| HBS-1 | | 0.050 |
| Polyethylacrylate latex | | 0.095 |
| Gelatin | | 0.910 |
| **8th layer (layer for donating interlayer effect to red-sensitive layer)** | | |
| Em-E | silver | 0.310 |
| Cpd-4 | | 0.032 |
| ExM-2 | | 0.120 |
| ExM-3 | | 0.014 |
| ExM-4 | | 0.010 |
| ExY-1 | | 0.015 |
| ExY-3 | | 0.005 |
| ExY-4 | | 0.040 |
| ExC-7 | | 0.020 |
| HBS-1 | | 0.215 |
| HBS-3 | | 0.005 |
| HBS-5 | | 0.035 |
| Gelatin | | 0.605 |
| **9th layer (Low-speed green-sensitive emulsion layer)** | | |
| Em-I | silver | 0.343 |
| Em-J | silver | 0.325 |
| Em-H | silver | 0.064 |
| ExM-2 | | 0.245 |
| ExM-3 | | 0.050 |
| ExM-4 | | 0.120 |
| ExY-1 | | 0.012 |
| ExY-3 | | 0.008 |
| ExC-7 | | 0.010 |
| HBS-1 | | 0.085 |
| HBS-3 | | 0.010 |
| HBS-4 | | 0.070 |
| HBS-5 | | 0.530 |
| Cpd-5 | | 0.010 |
| Cpd-7 | | 0.020 |
| Gelatin | | 1.410 |
| **10th layer (Medium-speed green-sensitive emulsion layer)** | | |
| Em-G | silver | 0.440 |
| ExM-2 | | 0.050 |
| ExM-3 | | 0.020 |
| ExM-4 | | 0.010 |
| ExY-3 | | 0.004 |
| ExC-6 | | 0.016 |
| ExC-7 | | 0.012 |
| ExC-8 | | 0.010 |
| HBS-1 | | 0.064 |
| HBS-3 | | 0.003 |
| HBS-4 | | 0.020 |
| HBS-5 | | 0.020 |
| Cpd-5 | | 0.004 |
| Cpd-7 | | 0.010 |
| Gelatin | | 0.420 |
| **11th layer (High-speed green-sensitive emulsion layer)** | | |
| Em-F | silver | 0.870 |
| Em-H | silver | 0.120 |
| ExC-6 | | 0.004 |
| ExC-8 | | 0.010 |
| ExM-1 | | 0.020 |
| ExM-2 | | 0.025 |
| ExM-3 | | 0.030 |
| ExY-3 | | 0.010 |
| ExY-4 | | 0.010 |
| Cpd-3 | | 0.006 |
| Cpd-4 | | 0.008 |
| Cpd-5 | | 0.010 |
| Cpd-7 | | 0.022 |
| HBS-1 | | 0.155 |
| HBS-3 | | 0.005 |
| HBS-4 | | 0.020 |
| HBS-5 | | 0.037 |

-continued

| | | |
|---|---|---|
| Polyethylacrylate latex | | 0.090 |
| Gelatin | | 0.985 |
| **12th layer (Yellow filter layer)** | | |
| Cpd-1 | | 0.080 |
| Solid disperse dye ExF-2 | | 0.070 |
| Solid disperse dye ExF-5 | | 0.006 |
| Oil-soluble dye ExF-6 | | 0.006 |
| HBS-1 | | 0.035 |
| Gelatin | | 0.630 |
| **13th layer (Low-speed blue-sensitive emulsion layer)** | | |
| Em-O | silver | 0.100 |
| Em-M | silver | 0.320 |
| Em-N | silver | 0.210 |
| ExC-1 | | 0.020 |
| ExC-7 | | 0.015 |
| ExY-1 | | 0.003 |
| ExY-2 | | 0.350 |
| ExY-3 | | 0.008 |
| ExY-4 | | 0.045 |
| ExY-5 | | 0.405 |
| Cpd-2 | | 0.103 |
| Cpd-3 | | 0.006 |
| HBS-1 | | 0.210 |
| HBS-5 | | 0.065 |
| Gelatin | | 1.430 |
| **14th layer (High-speed blue-sensitive emulsion layer)** | | |
| Em-K | silver | 0.780 |
| Em-L | silver | 0.110 |
| ExY-2 | | 0.080 |
| ExY-3 | | 0.010 |
| ExY-4 | | 0.072 |
| ExY-5 | | 0.090 |
| Cpd-2 | | 0.070 |
| Cpd-3 | | 0.001 |
| Cpd-7 | | 0.032 |
| HBS-1 | | 0.125 |
| Gelatin | | 0.670 |
| **15th layer (1st protective layer)** | | |
| Silver iodobromide emulsion grain (average grain diameter 0.07 μm, silver iodide content 2 mol %) | silver | 0.380 |
| UV-1 | | 0.210 |
| UV-2 | | 0.125 |
| UV-3 | | 0.195 |
| UV-4 | | 0.023 |
| UV-5 | | 0.208 |
| F-11 | | 0.009 |
| S-1 | | 0.086 |
| HBS-1 | | 0.170 |
| HBS-4 | | 0.052 |
| Gelatin | | 2.220 |
| **16th layer (2nd protective layer)** | | |
| H-1 | | 0.400 |
| B-1 (diameter 1.7 μm) | | 0.050 |
| B-2 (diameter 1.7 μm) | | 0.145 |
| B-3 | | 0.050 |
| S-1 | | 0.200 |
| Gelatin | | 0.650 |

In addition to the above components, to improve the storage stability, processability, resistance to pressure, antiseptic and mildewproofing properties, antistatic properties, and coating properties, the individual layers contained W-1 to W-13, B-4 to B-6, F-1 to F-19, lead salt, platinum salt, iridium salt, and rhodium salt.

Preparation of Dispersions of Organic Solid Disperse Dyes

ExF-2 in the 12th layer was dispersed by the following method.

| | |
|---|---|
| Wet cake (containing 17.6 mass % of water) of ExF-2 | 2.800 kg |
| Sodium octylphenyldiethoxymethane sulfonate (31 mass % aqueous solution) | 0.376 kg |
| F-15 (7% aqueous solution) | 0.011 kg |
| Water | 4.020 kg |
| Total | 7.210 kg |

(pH was adjusted to 7.2 by NaOH)

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill until the absorbance ratio of the dispersion was 0.29, thereby obtaining a solid disperse dye ExF-2. The average grain size of the fine dye grains was 0.29 μm.

Following the same procedure as above, solid disperse dyes ExF-4 and ExF-7 were obtained. The average grain sizes of the fine dye grains were 0.28 and 0.49 μm, respectively. ExF-5 was dispersed by a microprecipitation dispersion method described in Example 1 of EP549,489A, the disclosure of which is incorporated herein by reference. The average grain size was found to be 0.06 μm.

The sensitizing dyes used in examples of the present invention will be described below.

Sensitizing dye 1

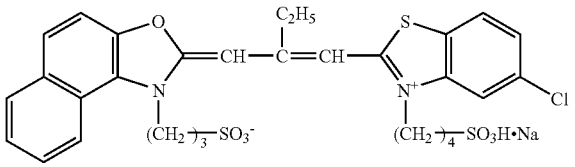

Sensitizing dye 2

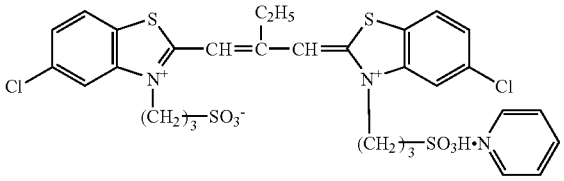

Sensitizing dye 3

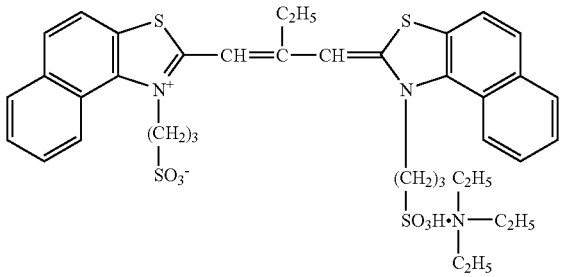

Sensitizing dye 4

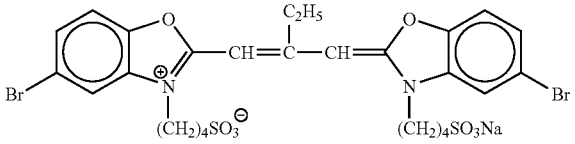

-continued

Sensitizing dye 5

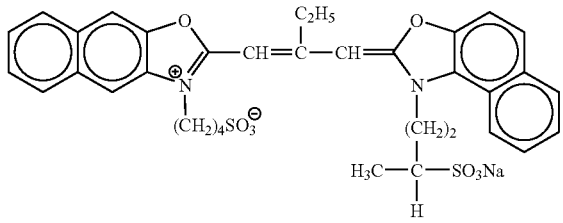

Sensitizing dye 6

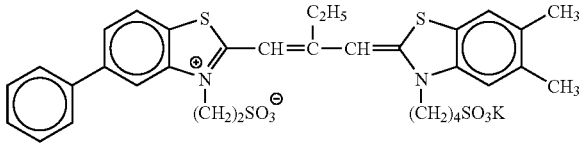

Sensitizing dye 7

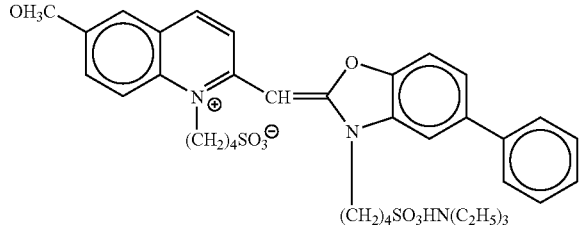

Sensitizing dye 8

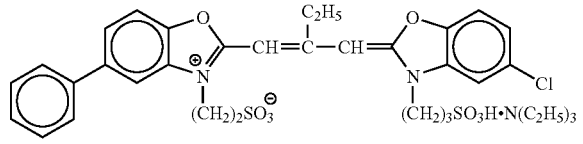

Sensitizing dye 9

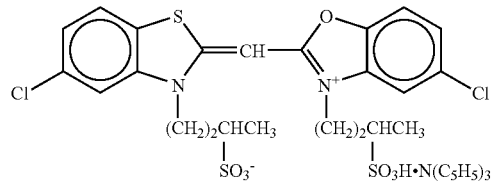

Sensitizing dye 12

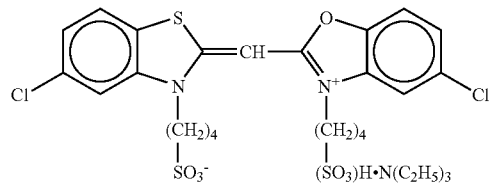

-continued
Sensitizing dye 13
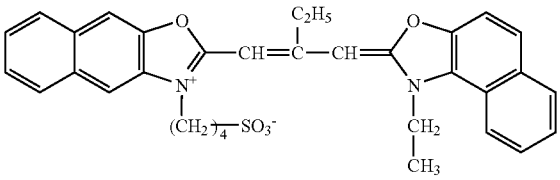
Sensitizing dye 14
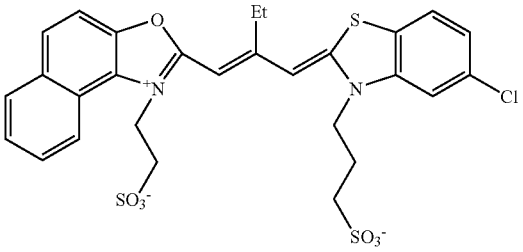
-continued
Sensitizing dye 15
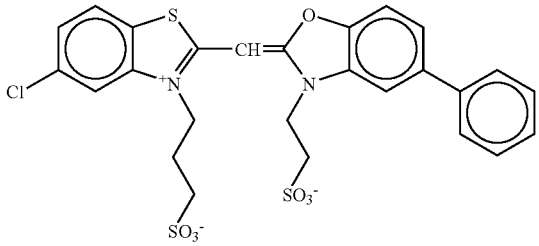
Sensitizing dye 16
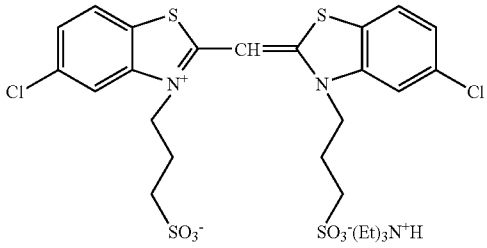
Other compounds used in examples of the present invention will be described below.
ExC-1
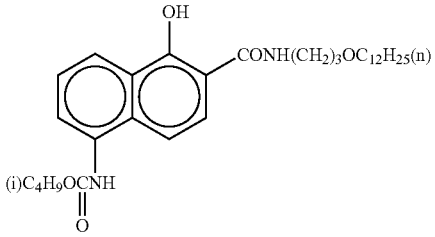
ExC-2
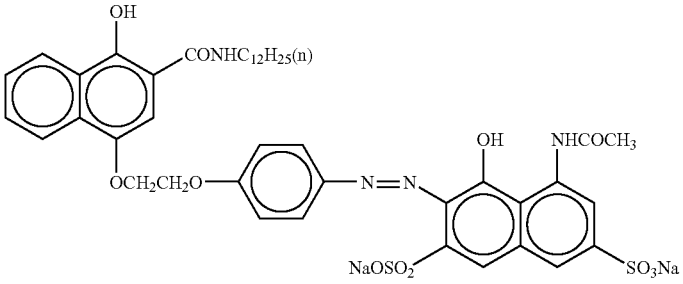
ExC-3
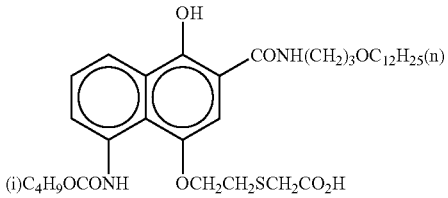
ExC-4
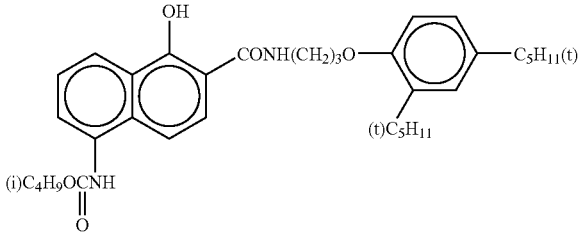

-continued
ExC-5
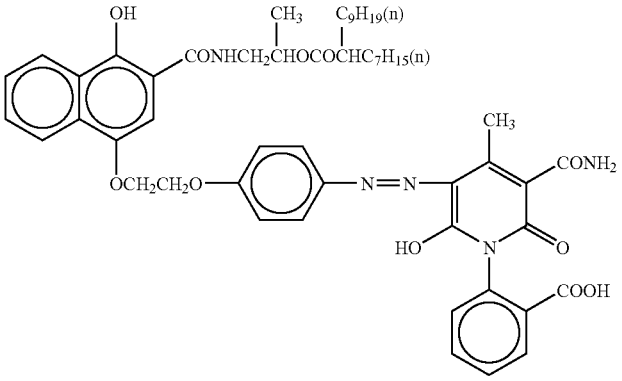
ExC-6
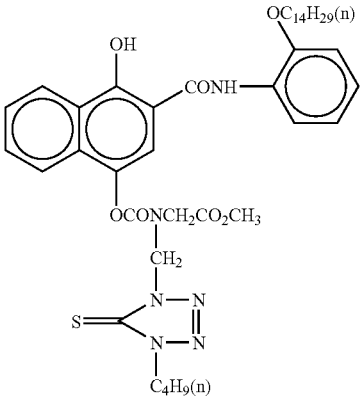
ExC-7
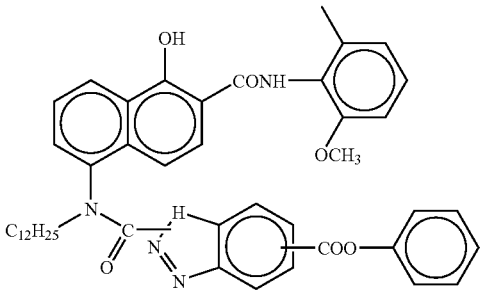
ExC-8
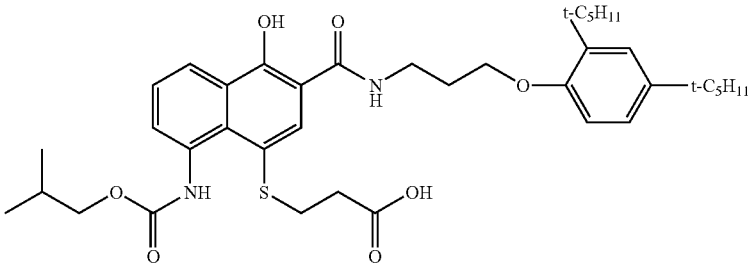
ExC-9
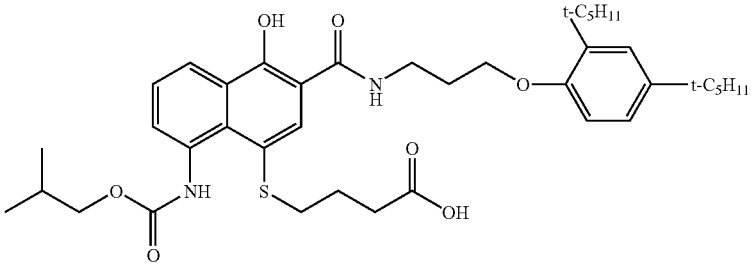

-continued
ExM-1
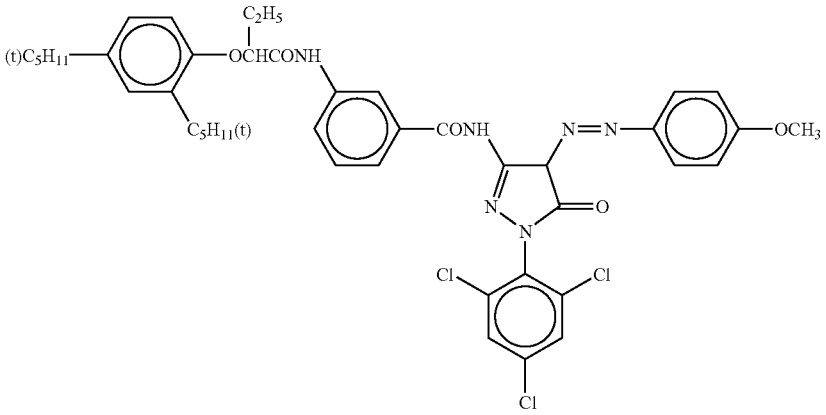
ExM-2
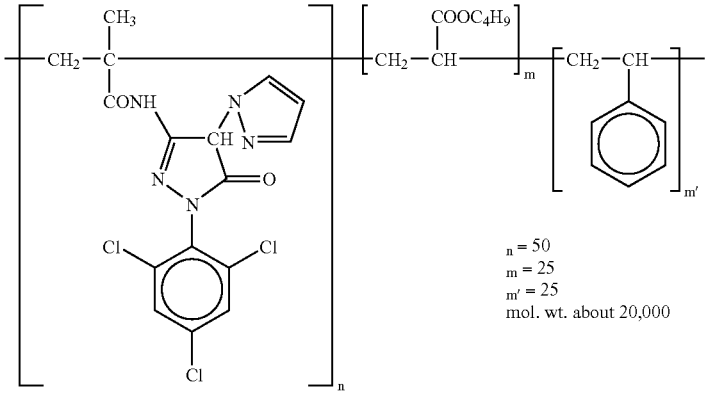
n = 50
m = 25
m′ = 25
mol. wt. about 20,000
ExM-3
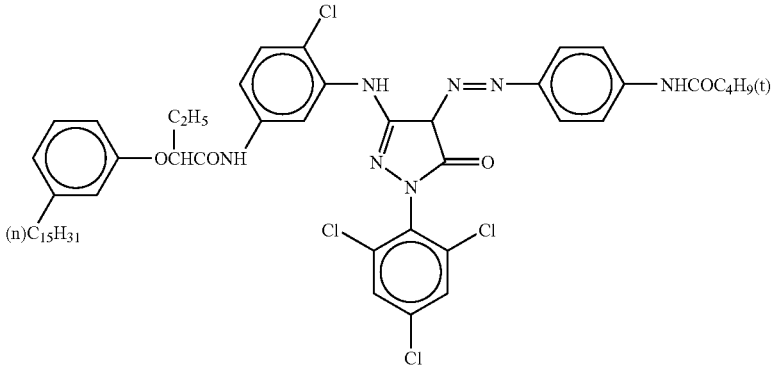
ExM-4
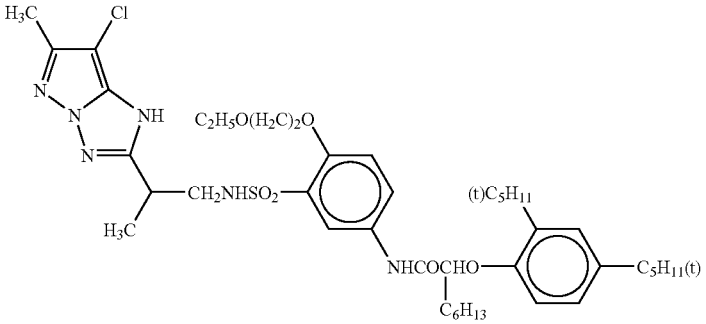

-continued
ExY-1
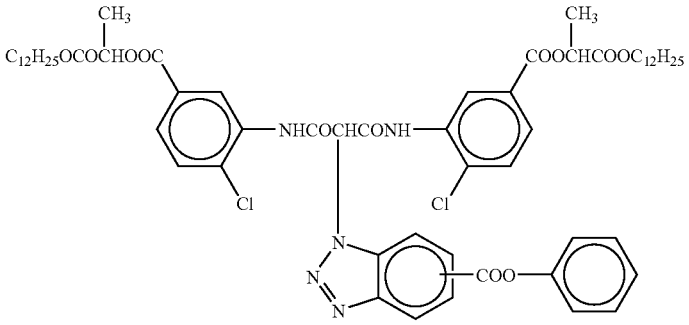
ExY-2
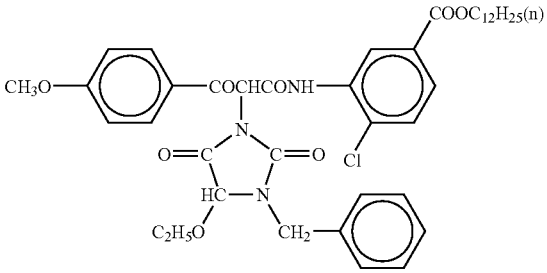
ExY-3
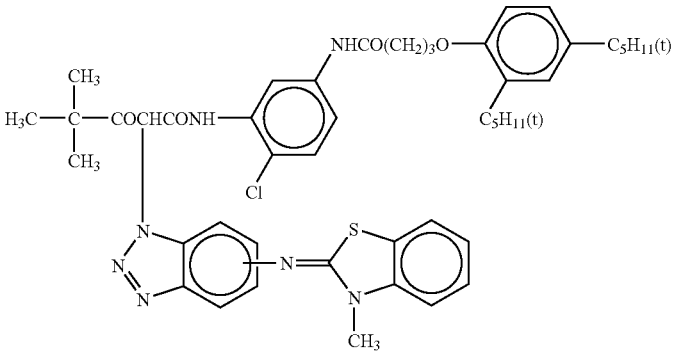
ExY-4
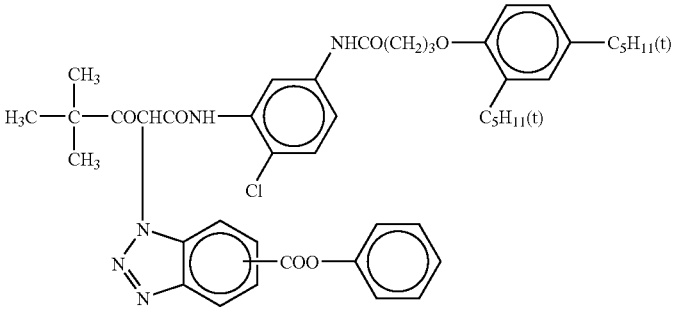
ExY-5
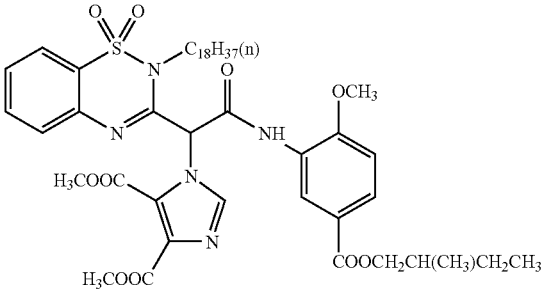

-continued
Cpd-1
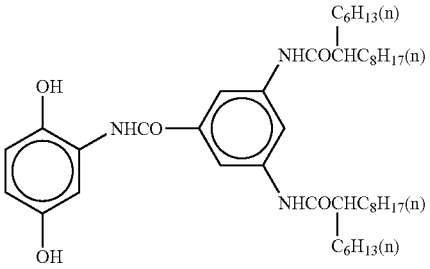
Cpd-2
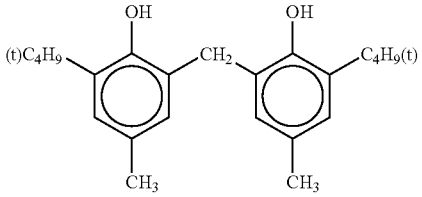
Cpd-3
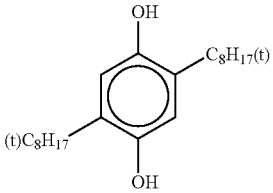
Cpd-4
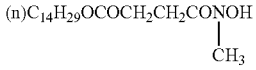
Cpd-5
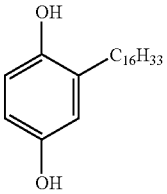
Cpd-6
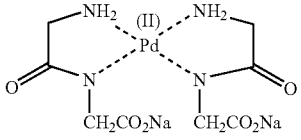
Cpd-7
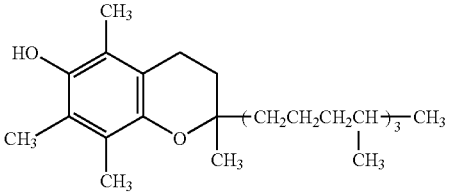
UV-1
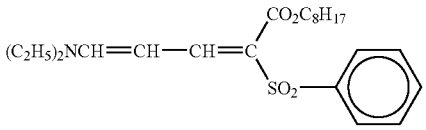
UV-2
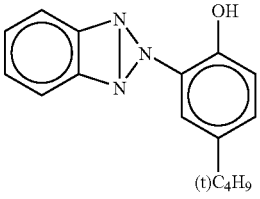
UV-3
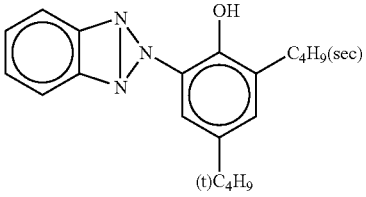
UV-4
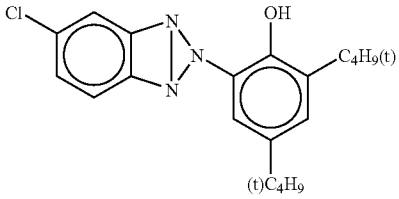

-continued

UV-5

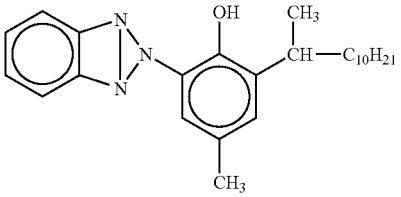

B-1

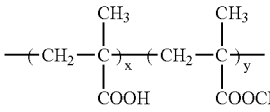

x/y = 10/90 (mass ratio)

Weight-average molecular weight: about 35,000

B-2

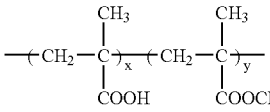

x/y = 40/60 (mass ratio)

Weight-average molecular weight: about 20,000

B-3

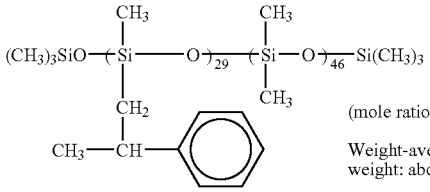

(mole ratio)

Weight-average molecular weight: about 8,000

B-4

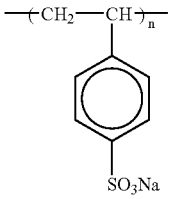

Weight-average molecular weight: about 750,000

B-5

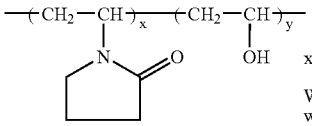

x/y = 70/30 (mass ratio)

Weight-average molecular weight: about 17,000

B-6

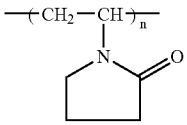

Weight-average molecular weight: about 10,000

HBS-1

Tricresyl phosphate

HBS-2

Di-n-butyl phthalate

HBS-3

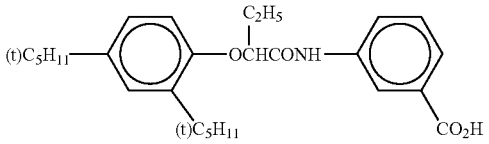

HBS-4

Tri (2-ethylhexyl) phosphate

-continued
HBS-5
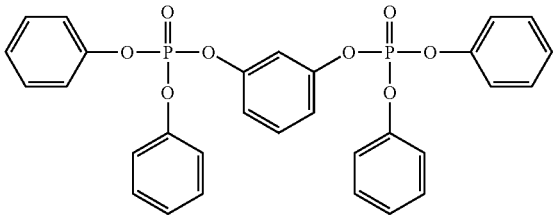
S-1
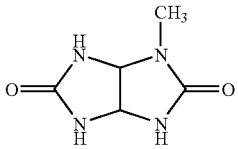
H-1
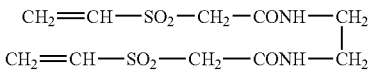
F-1
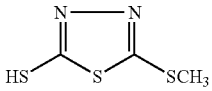
F-2
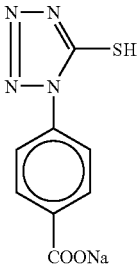
F-3
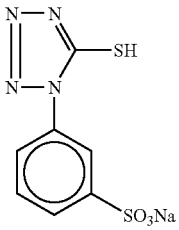
F-4
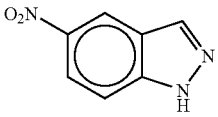
F-5
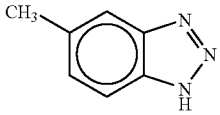
F-6
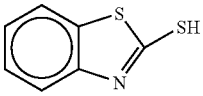
F-7
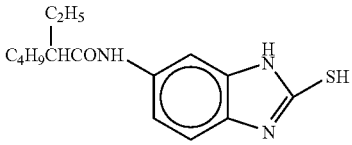
F-8
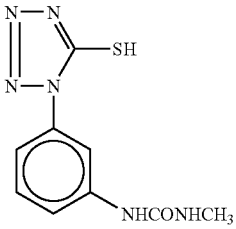
F-9
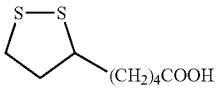
F-10
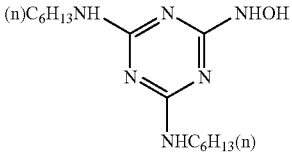

-continued
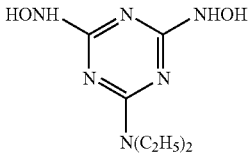
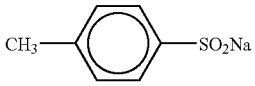
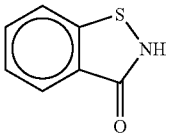
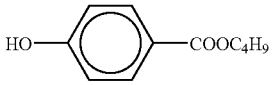
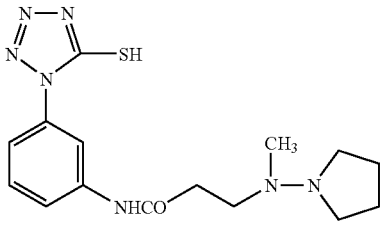
$C_8F_{17}SO_2NHCH_2CH_2CH_2OCH_2CH_2\overset{\oplus}{N}(CH_3)_3$
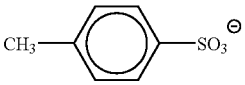
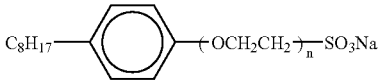
n = 2 to 4
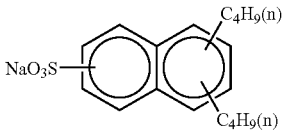
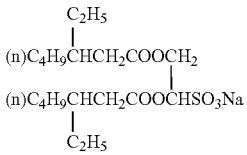
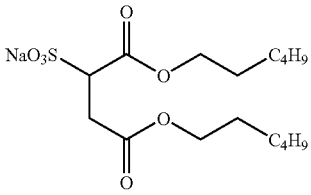
F-11
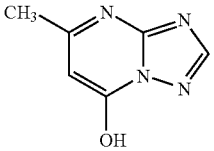
F-12
F-13
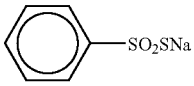
F-14
F-15
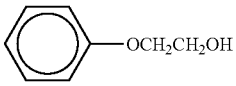
F-16
F-17
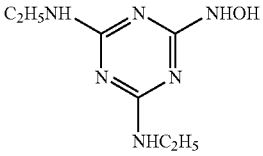
F-18
F-19
W-1
W-2
W-3
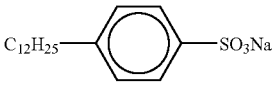
W-4
W-5
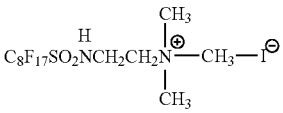
W-6
W-7
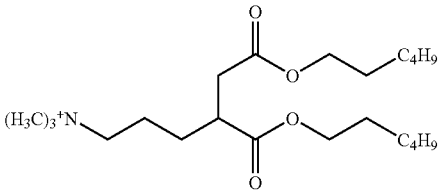
W-8

-continued
W-9
$nC_{10}H_{21}O-(CH_2CH_2O)_x-SO_3Na$
x = 1 to 3
W-10
$nC_{10}H_{21}O-(CH_2CH_2O)_z-C_4H_8SO_3Na$
z = 1 to 3
W-11
$-(CH_2CH(COOC_4H_9(n))_x-(CH_2CH(COOCH_3))_y-(CH_2CH(COOH))_z-$
x/y/z = 20/60/20 (mass ratio)
Weight-average molecular weight: about 36,000
W-12
$C_{11}H_{23}-CH=CH-CH_2-SO_3Na$ 60%
$C_{11}H_{23}-CH(OH)=CH_2-CH_2-SO_3Na$ 40%
W-13
$HO-(CH(CH_3)CH_2O)_{26.5}-(CH_2CH_2O)_{85.3}-(CH_2CH(CH_3)O)_{26.5}-H$
ExF-1
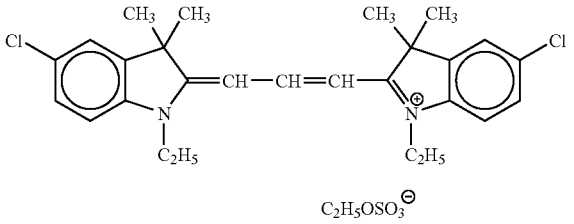
ExF-2
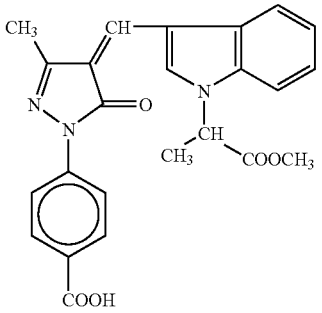
ExF-4
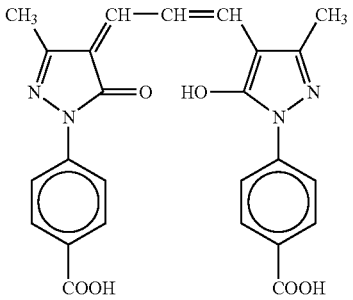
ExF-5
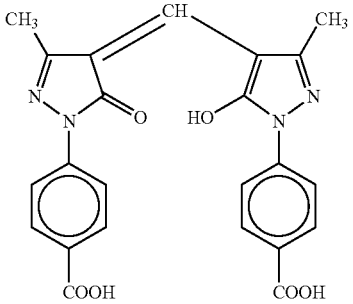
ExF-6
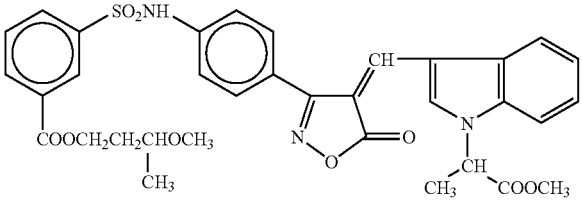

-continued

ExF-7

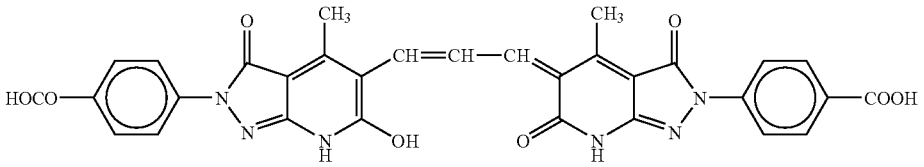

TABLE 1

Characteristics of silver halide grains contained in Em-A to Em-O

| Emulsion name | Layer used | Grain shape | ESD*1 (μm) | ECD(μm)*2/ VC(%)*3 |
|---|---|---|---|---|
| Em-A | High-speed red-sensitive layer | (111) main plane tabular grain | 0.95 | 2.20/32 |
| Em-B | Medium-speed red-sensitive layer | (111) main plane tabular grain | 0.69 | 1.30/35 |
| Em-C | Low-speed red-sensitive layer | (111) main plane tabular grain | 0.48 | 0.89/17 |
| Em-D | Low-speed red-sensitive layer | (111) main plane tabular grain | 0.31 | 0.40/20 |
| Em-E | Layer for donating interlayer effect to red-sensitive layer | (111) main plane tabular grain | 0.78 | 1.38/24 |
| Em-F | High-speed green-sensitive layer | (111) main plane tabular grain | 1.00 | 2.40/33 |
| Em-G | Medium-speed green-sensitive layer | (111) main plane tabular grain | 0.74 | 1.64/34 |
| Em-H | High and low-speed green-sensitive layers | (111) main plane tabular grain | 0.74 | 1.39/25 |
| Em-I | Low-speed green-sensitive layer | (111) main plane tabular grain | 0.55 | 0.79/30 |
| Em-j | Low-speed green-sensitive layer | (111) main plane tabular grain | 0.44 | 0.53/30 |
| Em-K | High-speed blue-sensitive layer | (111) main plane tabular grain | 1.60 | 3.00/25 |
| Em-L | High-speed blue-sensitive layer | (111) main plane tabular grain | 1.30 | 2.20/24 |
| Em-M | Low-speed blue-sensitive layer | (111) main plane tabular grain | 0.81 | 1.10/30 |
| Em-N | Low-speed blue-sensitive layer | (111) main plane tabular grain | 0.40 | 0.55/32 |
| Em-O | Low-speed blue-sensitive layer | (100) main plane cubic grain | 0.21 | 0.21/20 |

| Emulsion name | Av. thickness (μm)/ VC*4 (%) | Av. aspect ratio | Ratio of tabular grains*5 (%) | Av. thickness of core portion (μm) | Annual ring structure of core portion | Number of dislocation lines per one grain |
|---|---|---|---|---|---|---|
| Em-A | 0.12/14 | 18 | 97 | 0.09 | Absence | 20 |
| Em-B | 0.10/15 | 13 | 98 | 0.07 | Absence | 15 |
| Em-C | 0.09/12 | 10 | 99 | — | — | 10 |
| Em-D | 0.09/9.3 | 4.5 | 98 | — | — | 10 |
| Em-E | 0.15/13 | 9.2 | 97 | 0.12 | Presence | 20 |
| Em-F | 0.13/14 | 19 | 99 | 0.09 | Absence | 20 |
| Em-G | 0.10/15 | 16 | 96 | 0.07 | Absence | 15 |
| Em-H | 0.14/11 | 9.9 | 98 | 0.12 | Presence | 20 |
| Em-I | 0.14/13 | 5.5 | 97 | 0.11 | Presence | 30 |
| Em-J | 0.17/18 | 3.2 | 97 | 0.13 | Presence | 20 |
| Em-K | 0.31/21 | 10 | 99 | 0.16 | Presence | 15 |
| Em-L | 0.34/22 | 7 | 98 | 0.14 | Presence | 20 |
| Em-M | 0.23/18 | 4.7 | 97 | 0.13 | Presence | 20 |
| Em-N | 0.13/16 | 4.6 | 96 | 0.11 | Presence | 20 |
| Em-O | 0.21/20 | 1 | — | — | — | — |

*1ESD: average equivalent-sphere diameter
*2ECD: average equivalent-circular diameter
*3VC: variation coefficient
*4VC: variation coefficient
*5Ratio of tabular grains based on the total projected area occupied by all the grains (%)

TABLE 2

Characteristics of silver halide grains contained in Em-A to Em-O

| Emulsion name | Characteristics of grains occupying 70% or more based on the total projected area | Silver amount ratio of grain structure (%) and halogen composition (listed in order from center of grain) <> indicates epitaxial junction portion |
|---|---|---|
| Em-A | (111)main plane tabular grain | (11%)AgBr/(35%)$AgBr_{97}I_3$/(18%)AgBr/(9%)$AgBr_{62}I_{38}$/(27%)AgBr |
| Em-B | (111)main plane tabular grain | (7%)AgBr/(31%)$AgBr_{97}I_3$/(16%)AgBr/(12%)$AgBr_{62}I_{38}$/(34%)AgBr |
| Em-C | (111)main plane tabular grain | (1%)AgBr/(77%)$AgBr_{99}I_1$/(9%)$AgBr_{95}I_5$/(13%)<$AgBr_{63}Cl_{35}I_2$> |
| Em-D | (111)main plane tabular grain | (57%)AgBr/(14%)$AgBr_{96}I_4$/(29%)<$AgBr_{57}Cl_{41}I_2$> |
| Em-E | (111)main plane tabular grain | (13%)AgBr/(36%)$AgBr_{97}I_3$/(7%)AgBr/(11%)$AgBr_{62}I_{38}$/(33%)AgBr |
| Em-F | (111)main plane tabular grain | (11%)AgBr/(35%)$AgBr_{97}I_3$/(18%)AgBr/(4%)AgI/(32%)AgBr |

TABLE 2-continued

Characteristics of silver halide grains contained in Em-A to Em-O

| Emulsion name | Characteristics of grains occupying 70% or more based on the total projected area | Silver amount ratio of grain structure (%) and halogen composition (listed in order from center of grain) <> indicates epitaxial junction portion |
|---|---|---|
| Em-G | (111)main plane tabular grain | (7%)AgBr/(31%)$AgBr_{97}I_3$/(15%)AgBr/(14%)$AgBr_{62}I_{38}$/(33%)AgBr |
| Em-H | (111)main plane tabular grain | (14%)AgBr/(36%)$AgBr_{97}I_3$/(7%)AgBr/(11%)$AgBr_{62}I_{38}$/(32%)AgBr |
| Em-I | (111)main plane tabular grain | (15%)AgBr/(44%)$AgBr_{97}I_3$/(11%)AgBr/(5%)AgI/(25%)AgBr |
| Em-J | (111)main plane tabular grain | (60%)AgBr/(2%)AgI/(38%)AgBr |
| Em-K | (111)main plane tabular grain | (68%)$AgBr_{93}I_7$/(21%)AgBr/(1%)AgI/(10%)AgBr |
| Em-L | (111)main plane tabular grain | (8%)AgBr/(10%)$AgBr_{95}I_5$/(52%)$AgBr_{93}I_7$/(11%)AgBr/(2%)AgI/(17%) AgBr |
| Em-M | (111)main plane tabular grain | (12%)AgBr/(43%)$AgBr_{90}I_{10}$/(14%)AgBr/(2%)AgI/(29%)AgBr |
| Em-N | (111)main plane tabular grain | (58%)AgBr/(4%)AgI/(38%)AgBr |
| Em-O | (100)main plane cubic grain | (6%)AgBr/(94%)$AgBr_{96}I_4$ |

TABLE 3

Characteristics of silver halide grains contained in Em-A to Em-O

| Emulsion name | Av. silver iodide content(mol %)/ VC*1 of inter-grain (%) | Surface silver iodide content (mol %) | Av. silver chloride content (mol %)/ VC*1 of inter-grain (%) | Surface silver chloride content (mol %) | Twin plane spacing (μm)/ VC*1 (%) | (100) face ratio in side planes (%) | Ratio*2 of grains satisfying requirement A*3 (%) |
|---|---|---|---|---|---|---|---|
| Em-A | 4.5/10 | 3.90 | 0 | 0 | 0.011/30 | 20 | 55 |
| Em-B | 5.5/11 | 5.00 | 0 | 0 | 0.010/30 | 30 | 75 |
| Em-C | 1.5/10 | 3.70 | 4.7/8.0 | 16 | 0.010/31 | 25 | — |
| Em-D | 1.1/11 | 5.00 | 12/9.0 | 23 | 0.009/29 | 25 | — |
| Em-E | 5.3/10 | 5.90 | 0 | 0 | 0.012/30 | 35 | 20 |
| Em-F | 5.1/10 | 3.90 | 0 | 0 | 0.012/30 | 20 | 60 |
| Em-G | 6.3/13 | 5.60 | 0 | 0 | 0.010/30 | 30 | 65 |
| Em-H | 5.3/14 | 5.97 | 0 | 0 | 0.011/30 | 30 | 25 |
| Em-I | 6.3/12 | 7.39 | 0 | 0 | 0.016/32 | 20 | 15 |
| Em-J | 2.0/14 | 5.68 | 0 | 0 | 0.016/32 | 35 | 18 |
| Em-K | 5.8/7.0 | 3.88 | 0 | 0 | 0.010/29 | 40 | 25 |
| Em-L | 6.1/8.0 | 5.50 | 0 | 0 | 0.017/33 | 20 | 20 |
| Em-M | 6.3/9.0 | 1.90 | 0 | 0 | 0.019/30 | 30 | 15 |
| Em-N | 4.1/10 | 5.50 | 0 | 0 | 0.020/31 | 30 | 20 |
| Em-O | 3.8/9.0 | 4.50 | 0 | 0 | — | — | — |

*1VC: variation coefficient

*2Ratio of grains satisfying requirement A to all grains in number (%)

*3It is a silver iodobromide grain or a silver iodochlorobromide grain having a (111) main plane in which an equivalent circular diameter is 1.0 μm or more and the grain thickness is 0.15 μm orless, the grain having 10 or more dislocation lines. Further, the grain has a core portion having a thickness of 0.1 μm or less in which the core portion comprises silver iodobromide and does not contain an annual ring structure.

TABLE 4

Sensitizing dye and dopant used in Em-A to Em-O

| Emulsion name | Layer used | Sensitizing dye | Dopant |
|---|---|---|---|
| Em-A | High-speed red-sensitive layer | 2, 3, 14 | $K_2IrCl_6$, $K_4Fe(CN)_6$ |
| Em-B | Medium-speed red-sensitive layer | 1, 2, 3 | $K_2IrCl_6$, $K_2IrCl_5(H_2O)$, $K_4Ru(CN)_6$ |
| Em-C | Low-speed red-sensitive layer | 2, 3, 14 | $K_2IrCl_6$, $K_4Fe(CN)_6$ |
| Em-D | Low-speed red-sensitive layer | 2, 3, 14 | $K_2IrCl_6$, $K_4Fe(CN)_6$ |
| Em-E | Layer for donating interlayer effect to red-sensitive layer | 7, 8 | $K_4Fe(CN)_6$ |
| Em-F | High-speed green-sensitive layer | 5, 6, 8 | $K_4Ru(CN)_6$ |
| Em-G | Medium-speed green-sensitive layer | 5, 6, 8 | $K_2IrCl_6$, $K_4Fe(CN)_6$ |
| Em-H | High and low-speed green-sensitive layers | 4, 5, 6, 8, 13 | $K_2IrCl_6$, $K_4Fe(CN)_6$ |
| Em-I | Low-speed green-sensitive layer | 4, 5, 6 | $K_2IrCl_6$ |
| Em-J | Low-speed green-sensitive layer | 6, 8, 13 | $K_2IrCl_6$, $K_4Fe$ $(CN)_6$ |
| Em-K | High-speed blue-sensitive layer | 16 | — |
| Em-L | High-speed blue-sensitive layer | 9 | — |
| Em-M | Low-speed blue-sensitive layer | 16 | — |

TABLE 4-continued

Sensitizing dye and dopant used in Em-A to Em-O

| Emulsion name | Layer used | Sensitizing dye | Dopant |
|---|---|---|---|
| Em-N | Low-speed blue-sensitive layer | 9, 15 | — |
| Em-O | Low-speed blue-sensitive layer | 12, 15 | $K_2IrCl_6$ |

The emulsions were loaded with optimum amounts of spectral sensitizing dyes as specified in Table 4 and underwent optimum gold sensitization, sulfur sensitization and selenium sensitization.

The thus obtained silver halide color photosensitive material is referred to as sample 101.

(Preparation of Samples 102 to 121)

These samples were prepared in the same manner as conducted in the preparation of the sample 101 except that the 4th, 5th, 6th, 8th, 9th, 10th, 11th, 13th and 14th layers of the sample 101 were loaded with compounds of the present invention as specified in Table 5.

The samples 101 to 121 were exposed through, manufactured by Fuji Photo Film Co., Ltd., gelatin filter SC-39 and continuous wedge for 1/100 sec.

The samples after the exposure were processed in the following manner.

(Processing Procedure)

| Step | Processing time | Processing temp. |
|---|---|---|
| Color development: | 3 min 15 sec | 38° C. |
| Bleaching: | 3 min 00 sec | 38° C. |
| Washing: | 30 sec | 24° C. |
| Fixing: | 3 min 00 sec | 38° C. |
| Washing (1): | 30 sec | 24° C. |
| Washing (2): | 30 sec | 24° C. |
| Stabilization: | 30 sec | 38° C. |
| Drying: | 4 min 20 sec | 55° C. |

The composition of the processing solution for use in each of the above steps is as follows:

| | (Unit: g) |
|---|---|
| (Color developer A) | |
| Diethylenetriaminepentaacetic acid | 1.0 |
| 1-Hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxyethylamino)-2-methylaniline sulfate | 4.5 |
| Water | q.s. ad 1.0 L |
| pH (adjusted with potassium hydroxide and sulfuric acid) | 10.05. |
| (Bleaching solution) | |
| Ethylenediaminetetraacetic acid ferric ammonium trihydrate salt | 100.0 |
| Ethylenediaminetetraacetic acid disodium salt | 10.0 |
| 3-Mercapto-1,2,4-triazole | 0.03 |
| Ammonium bromide | 140.0 |

-continued

| | (Unit: g) |
|---|---|
| Ammonium nitrate | 30.0 |
| Aq. ammonia (27%) | 6.5 mL |
| Water | q.s. ad 1.0 L |
| pH (adjusted with aq. ammonia and nitric acid) | 6.0. |
| (Fixer) | |
| Ethylenediaminetetraacetic acid disodium salt | 0.5 |
| Ammonium sulfite | 20.0 |
| Aq. soln. of ammonium thiosulfate (700 g/L) | 295.0 mL |
| Acetic acid (90%) | 3.3 |
| Water | q.s. ad 1.0 L |
| pH (adjusted with aq. ammonia and nitric acid) | 6.7. |
| (Stabilizer) | |
| p-Nonylphenoxypolyglycidol (glycidol av. polymn. deg. 10) | 0.2 |
| Ethylenediaminetetraacetic acid | 0.05 |
| 1,2,4-Triazole | 1.3 |
| 1,4-Bis(1,2,4-triazol-1-ylmethyl)piperazine | 0.75 |
| Hydroxyacetic acid | 0.02 |
| Hydroxyethylcellulose (Daicel Chemical Industries, Ltd. HEC SP-2000) | 0.1 |
| 1,2-Benzoisothiazolin-3-one | 0.05 |
| Water | q.s. ad 1.0 L |
| pH | 8.5. |

The sensitivity of red-sensitive layer, green-sensitive layer and blue-sensitive layer was defined as the logarithm of inverse number of exposure intensity required for cyan, magenta and yellow color image densities, respectively, to be minimum density +0.8, and expressed as the difference from that of the sample 101.

The graininess thereof was estimated by determining the RMS granularity of cyan, magenta and yellow color images at a density of fog+0.8 and expressed by the relative value providing that the graininess of the sample 101 was 100.

For estimation of any substantial sensitivity enhancement, when the RMS granularity changed in accordance with sensitivity increase, comparison was made while effecting RMS granularity matching through regulation of the amount of ExY-3 in the 4th, 5th, 6th, 8th, 9th, 10th, 11th, 13th and 14th layers.

The film dependence on processing was defined as the difference between sensitivity resulting from processing with the use of the following color developer B in place of the above color developer A and sensitivity resulting from processing with the use of the color developer A. The nearer to 0 this value, the favorably lower the film dependence on processing.

| (Color developer B) | (Unit: g) |
|---|---|
| Diethylenetriaminepentaacetic acid | 0.4 |
| 1-Hydroxyethylidene-1,1-diphosphonic acid | 3.0 |

-continued

| (Color developer B) | (Unit: g) |
|---|---|
| Sodium sulfite | 3.3 |
| Potassium carbonate | 37.6 |
| Potassium bromide | 2.4 |
| Potassium iodide | 2.4 mg |
| Hydroxylamine sulfate | 2.0 |
| 4-(N-ethyl-N-β-hydroxyethylamino)-2-methylaniline sulfate | 3.8 |
| Water | q. s. ad 1.0 L |
| pH (adjusted with potassium hydroxide and sulfuric acid) | 9.9. |

What is claimed is:

1. A silver halide color photosensitive material comprising a support and, superimposed thereon, a blue-sensitive layer unit, a green-sensitive layer unit and a red-sensitive layer unit, each of these light-sensitive layer units composed of at least one silver halide emulsion layer, together with at least one nonphotosensitive layer, wherein at least one compound (A) and at least one compound (B) are contained, the compound (A) being a heterocyclic compound of less than 4.5 C log P which when added, is capable of enhancing the sensitivity of the silver halide color photosensitive material as compared with that exhibited when not added,

TABLE 5

| Sample No. | Compound (A) [Additive amount] (mol/mol Ag) <ClogP> | compound (B) [Additive amount] (mol/mol Ag) <ClogP> |
|---|---|---|
| 101 (Comp.) | — | — |
| 102 (Comp.) | — | (b-4) [12 × $10^{-3}$] <10.880> |
| 103 (Comp.) | — | (D-4) [12 × $10^{-3}$] <11.357> |
| 104 (Comp.) | (a-1) [4 × $10^{-3}$] <−0.029> | — |
| 105 (Comp.) | (a-10) [4 × $10^{-3}$] <0.486> | — |
| 106 (Inv.) | (a-7) [4 × $10^{-3}$] <−3.727> | (b-2) [12 × $10^{-3}$] <4.908> |
| 107 (Inv.) | (a-11) [4 × $10^{-3}$] <2.579> | (b-6) [12 × $10^{-3}$] <6.421> |
| 108 (Inv.) | (a-6) [4 × $10^{-3}$] <−0.968> | (E-1) [12 × $10^{-3}$] <8.561> |
| 109 (Inv.) | (a-13) [4 × $10^{-3}$] <0.578> | (b-3) [12 × $10^{-3}$] <8.764> |
| 110 (Inv.) | (a-10) [4 × $10^{-3}$] <0.486> | (b-4) [12 × $10^{-3}$] <10.880> |
| 111 (Inv.) | (a-1) [4 × $10^{-3}$] <−0.029> | (b-4) [12 × $10^{-3}$] <10.880> |
| 112 (Inv.) | (a-1) [4 × $10^{-3}$] <−0.029> | (D-4) [12 × $10^{-3}$] <11.357> |
| 113 (Inv.) | (a-1) [4 × $10^{-3}$] <−0.029> | (b-4) [6 × $10^{-3}$] <10.880>, (D-4) [6 × $10^{-3}$] <11.357> |
| 114 (Inv.) | (a-1) [4 × $10^{-3}$] <−0.029> | (b-7) [6 × $10^{-3}$] <10.080>, (D-4) [6 × $10^{-3}$] <11.357> |
| 115 (Inv.) | (a-1) [4 × $10^{-3}$] <−0.029> | (b-8) [6 × $10^{-3}$] <11.410>, (D-4) [6 × $10^{-3}$] <11.357> |
| 116 (Inv.) | (a-1) [4 × $10^{-3}$] <−0.029> | (b-9) [6 × $10^{-3}$] <9.620>, (D-4) [6 × $10^{-3}$] <11.357> |
| 117 (Comp.) | — | (b-2) [12 × $10^{-3}$] <4.908>, (b-10) [12 × $10^{-3}$] <4.695> |
| 118 (Inv.) | (a-16) [12 × $10^{-3}$] <4.166> | (b-2) [12 × $10^{-3}$] <4.908> |
| 119 (Comp.) | (a-7) [4 × $10^{-3}$] <−3.727>, (a-16) [4 × $10^{-3}$] <4.166> | — — |
| 120 (Inv.) | (a-7) [4 × $10^{-3}$] <−3.727> | (b-10) [12 × $10^{-3}$] <4.695> |
| 121 (Inv.) | (a-16) [12 × $10^{-3}$] <4.166> | (b-10) [12 × $10^{-3}$] <4.695> |

| | Sensitivity | | | Graininess | | | Processing dependence | | |
|---|---|---|---|---|---|---|---|---|---|
| Sample No. | Red* | Green* | Blue* | Red* | Green* | Blue* | Red* | Green* | Blue* |
| 101 (Comp.) | 0.00 | 0.00 | 0.00 | 100 | 100 | 100 | −0.25 | −0.20 | −0.18 |
| 102 (Comp.) | +0.02 | +0.02 | +0.02 | 101 | 102 | 101 | −0.24 | −0.21 | −0.19 |
| 103 (Comp.) | +0.02 | +0.02 | +0.02 | 102 | 101 | 102 | −0.25 | −0.22 | −0.17 |
| 104 (Comp.) | +0.03 | +0.03 | +0.02 | 102 | 101 | 101 | −0.24 | −0.20 | −0.18 |
| 105 (Comp.) | +0.02 | +0.02 | +0.02 | 100 | 102 | 101 | −0.25 | −0.21 | −0.19 |
| 106 (Inv.) | +0.06 | +0.05 | +0.06 | 101 | 101 | 101 | −0.16 | −0.15 | −0.12 |
| 107 (Inv.) | +0.07 | +0.06 | +0.07 | 100 | 101 | 100 | −0.14 | −0.13 | −0.10 |
| 108 (Inv.) | +0.09 | +0.07 | +0.09 | 101 | 100 | 99 | −0.14 | −0.12 | −0.10 |
| 109 (Inv.) | +0.09 | +0.07 | +0.10 | 100 | 99 | 101 | −0.13 | −0.12 | −0.10 |
| 110 (Inv.) | +0.11 | +0.09 | +0.12 | 101 | 99 | 101 | −0.13 | −0.12 | −0.10 |
| 111 (Inv.) | +0.11 | +0.09 | +0.12 | 101 | 100 | 100 | −0.12 | −0.11 | −0.10 |
| 112 (Inv.) | +0.11 | +0.09 | +0.12 | 102 | 99 | 100 | −0.12 | −0.11 | −0.10 |
| 113 (Inv.) | +0.12 | +0.10 | +0.13 | 101 | 98 | 100 | −0.11 | −0.10 | −0.09 |
| 114 (Inv.) | +0.12 | +0.10 | +0.12 | 100 | 100 | 100 | −0.11 | −0.10 | −0.09 |
| 115 (Inv.) | +0.11 | +0.10 | +0.11 | 101 | 100 | 101 | −0.11 | −0.11 | −0.09 |
| 116 (Inv.) | +0.13 | +0.11 | +0.13 | 100 | 99 | 99 | −0.10 | −0.10 | −0.08 |
| 117 (Comp.) | +0.02 | +0.02 | +0.02 | 100 | 101 | 101 | −0.24 | −0.21 | −0.19 |
| 118 (Inv.) | +0.05 | +0.05 | +0.05 | 101 | 100 | 100 | −0.17 | −0.16 | −0.13 |
| 119 (Comp.) | +0.03 | +0.02 | +0.02 | 100 | 101 | 101 | −0.24 | −0.20 | −0.20 |
| 120 (Inv.) | +0.06 | +0.05 | +0.06 | 101 | 100 | 100 | −0.16 | −0.16 | −0.12 |
| 121 (Inv.) | +0.06 | +0.05 | +0.05 | 100 | 101 | 100 | −0.16 | −0.16 | −0.13 |

*Red: Red-sensitive layer, Green: Green-sensitive layer, Blue: Blue-sensitive layer It is apparent from Table 5 that the photosensitive material of the present invention not only realizes high sensitivity without detriment to graininess but also excels in film dependence on processing.

the compound (B) being a heterocyclic compound of 4.5 or greater C log P which when added, is capable of enhancing the sensitivity of the silver halide color photosensitive material as compared with that exhibited when not added, wherein the compound (A) does not substantially react with developing agent oxidation products.

2. The silver halide color photosensitive material according to claim 1, wherein the compound (A) and compound (B) satisfy the following requirements, the compound (A) being a heterocyclic compound of −2 to 3 C log P which when added, is capable of enhancing the sensitivity of the silver halide color photosensitive material as compared with that exhibited when not added, the compound (B) being a heterocyclic compound of 6 to 16 C log P which when added, is capable of enhancing the sensitivity of the silver halide color photosensitive material as compared with that exhibited when not added.

3. the silver halide color photosensitive material according to claim 1, wherein the compound (A) and compound (B) satisfy the following requirements, the compound (A) being a heterocyclic compound of −1 to 1 C log P which when added, is capable of enhancing the sensitivity of the silver halide color photosensitive material as compared with that exhibited when not added, the compound (B) being a heterocyclic compound of 7.5 to 15 C log P which when added, is capable of enhancing the sensitivity of the silver halide color photosensitive material as compared with that exhibited when not added.

4. The silver halide color photosensitive material according to claim 1, wherein the compound (A) is a heterocyclic compound having 1 to 3 heteroatoms as ring constituent atoms which does not react with developing agent oxidation products while the compound (B) is a heterocyclic compound having 1 to 3 heteroatoms as ring constituent atoms.

5. The silver halide color photosensitive material according to claim 2, wherein the compound (A) is a heterocyclic compound having 1 to 3 heteroatoms as ring constituent atoms which does not react with developing agent oxidation products while the compound (B) is a heterocyclic compound having 1 to 3 heteroatoms as ring constituent atoms.

6. The silver halide color photosensitive material according to claim 3, wherein the compound (A) is a heterocyclic compound having 1 to 3 heteroatoms as ring constituent atoms which does not react with developing agent oxidation products while the compound (B) is a heterocyclic compound having 1 to 3 heteroatoms as ring constituent atoms.

7. The silver halide color photosensitive material according to claim 1, wherein the compound (A) and the compound (B) both are a heterocyclic compound having 1 or 2 heteroatoms as ring constituent atoms which does not react with developing agent oxidation products.

8. The silver halide color photosensitive material according to claim 2, wherein the compound (A) and the compound (B) both are a heterocyclic compound having 1 or 2 heteroatoms as ring constituent atoms which does not react with developing agent oxidation products.

9. The silver halide color photosensitive material according to claim 3, wherein the compound (A) and the compound (B) both are a heterocyclic compound having 1 or 2 heteroatoms as ring constituent atoms which does not react with developing agent oxidation products.

* * * * *